US008197997B2

(12) United States Patent
Yanagawa et al.

(10) Patent No.: US 8,197,997 B2
(45) Date of Patent: Jun. 12, 2012

(54) ELECTROPHOTOGRAPHIC PHOTOCONDUCTOR, PRODUCTION METHOD THEREOF, IMAGE FORMING METHOD AND IMAGE FORMING APPARATUS USING PHOTOCONDUCTOR, AND PROCESS CARTRIDGE

(75) Inventors: Yoshiki Yanagawa, Numazu (JP); Yoshiaki Kawasaki, Susono (JP); Tetsuro Suzuki, Fuji (JP)

(73) Assignee: Ricoh Company, Ltd., Tokyo (JP)

( * ) Notice: Subject to any disclaimer, the term of this patent is extended or adjusted under 35 U.S.C. 154(b) by 931 days.

(21) Appl. No.: 12/281,230

(22) PCT Filed: Feb. 27, 2007

(86) PCT No.: PCT/JP2007/054146

§ 371 (c)(1),
(2), (4) Date: Aug. 29, 2008

(87) PCT Pub. No.: WO2007/100132

PCT Pub. Date: Sep. 7, 2007

(65) Prior Publication Data

US 2009/0035672 A1 Feb. 5, 2009

(30) Foreign Application Priority Data

Mar. 1, 2006 (JP) ..... 2006-054655

(51) Int. Cl.
*G03G 17/06* (2006.01)

(52) U.S. Cl. ..... 430/66; 430/69

(58) Field of Classification Search ..... 430/66, 430/58.5, 58.7

See application file for complete search history.

(56) References Cited

U.S. PATENT DOCUMENTS

| | | | | |
|---|---|---|---|---|
| 2001/0022904 | A1 * | 9/2001 | Hirabayashi et al. | 399/149 |
| 2003/0148199 | A1 * | 8/2003 | Shindoh et al. | 430/58.85 |
| 2004/0253527 | A1 * | 12/2004 | Suzuki et al. | 430/66 |
| 2005/0287465 | A1 | 12/2005 | Ohshima et al. | |
| 2006/0110668 | A1 * | 5/2006 | Kawasaki et al. | 430/58.7 |

FOREIGN PATENT DOCUMENTS

| | | |
|---|---|---|
| JP | 56 48637 | 5/1981 |
| JP | 64 1728 | 1/1989 |
| JP | 4 281461 | 10/1992 |
| JP | 8 15876 | 1/1996 |
| JP | 2000 66425 | 3/2000 |

(Continued)

OTHER PUBLICATIONS http://www.misumiusa.com/CategoryImages/Metric_2009_pdf/p1485.pdf, 2011, MISUMI Corporation.*

*Primary Examiner* — Mark F Huff
*Assistant Examiner* — Rashid Alam
(74) *Attorney, Agent, or Firm* — Oblon, Spivak, McClelland, Maier & Neustadt, L.L.P.

(57) ABSTRACT

To provide an electrophotographic photoconductor that comprises a support and a cross-linked layer formed over the support, wherein the cross-linked layer comprises at least light curable of radically polymerizable compound, the difference of maximum value of the post-exposure electrical potential and minimum value of the post-exposure electrical potential when writing is conducted under the condition that image static power is 0.53 mW, exposure energy is 4.0 erg/cm$^2$ for the electrophotographic photoconductor is within 30V.

9 Claims, 4 Drawing Sheets

FOREIGN PATENT DOCUMENTS

| | | | | |
|---|---|---|---|---|
| JP | 2000241998 | A | * | 9/2000 |
| JP | 2001 125297 | | | 5/2001 |
| JP | 3194392 | | | 6/2001 |
| JP | 3262488 | | | 12/2001 |
| JP | 2004 240305 | | | 8/2004 |
| JP | 2004 302450 | | | 10/2004 |
| JP | 2004 302451 | | | 10/2004 |
| JP | 2004 302452 | | | 10/2004 |
| JP | 2005 99688 | | | 4/2005 |
| JP | 2005 107401 | | | 4/2005 |
| JP | 2005 107490 | | | 4/2005 |
| JP | 2005 115322 | | | 4/2005 |
| JP | 2005 140825 | | | 6/2005 |
| JP | 2005 156784 | | | 6/2005 |
| JP | 2005 157026 | | | 6/2005 |
| JP | 2005 157297 | | | 6/2005 |
| JP | 2005141114 | A | * | 6/2005 |
| JP | 2005 189821 | | | 7/2005 |
| JP | 2005 189828 | | | 7/2005 |
| JP | 2005 189835 | | | 7/2005 |
| JP | 2006 11001 | | | 1/2006 |
| JP | 2006 11014 | | | 1/2006 |

* cited by examiner

ELECTROPHOTOGRAPHIC PHOTOCONDUCTOR, PRODUCTION METHOD THEREOF, IMAGE FORMING METHOD AND IMAGE FORMING APPARATUS USING PHOTOCONDUCTOR, AND PROCESS CARTRIDGE

TECHNICAL FIELD

The present invention relates to a long-lived, high-end electrophotographic photoconductor (hereinafter may be referred to as "photoconductor," "latent electrostatic image bearing member" or "image bearing member") that can provide high-quality image formation for prolonged periods, a method for producing the electrophotographic photoconductor, an image forming method, van image forming apparatus, and a process cartridge.

BACKGROUND ART

Recently, organic photoconductors (OPC) have been replacing inorganic photoconductor for their excellent performance and various advantages, and are often applied to copiers, facsimile machines, laser printers and complex machines thereof. Examples of the reasons for this include (1) optical property such as a wide range of the wavelength of light absorption and a large amount of light absorption, (2) electric property of high sensitive and stable charging property, (3) a wide range of material selection, (4) easiness to produce, (5) low cost, and (6) non-toxicity.

As reducing the diameter of a photoconductor is progressed by downsizing of image forming apparatuses recently and high-speed movements and maintenance-free of apparatuses are followed, highly durable photoconductors are being desired. Viewed from this point, as a surface layer of the organic photoconductor contains mainly low molecular charge transport materials and inactive polymers, the organic photoconductor is generally soft. Because of this chemical property, the organic photoconductor has a disadvantage of frequent wearing caused by mechanical overload through developing systems or cleaning systems, when the organic photoconductor is repeatedly used in the electrophotography process. Furthermore, because of increasing demand of high image quality, rubber hardness and contact pressure of cleaning blades are increased for the purpose of improving cleaning with the trend of reducing the diameter of toner particles, and such a requirement is a cause for accelerating the wear of the photoconductor. Thus wear of the photoconductor impairs sensitivity and electric property such as lowering of charging, and causes lowering of image densities and abnormal images of dirty backgrounds. Scratches due to localized wears cause striped-dirt images due to defective cleaning. The exhaustion of the life of the photoconductor is ratio-determined by wears and scratches and thereby the photoconductor are led to the replacement in the present condition.

Thus, for enhancing the durability of the organic photoconductor (OPC), it is indispensable to lower wear degree and it is in need of organic photoconductors that not only have a fine surface for superior cleaning and adding transferring but also have no long-term dependencies of places over electrophotographic property and maintain stable high performance. For this reason, this is the most urgent problem to be solved in the art.

Examples of the technology for improving wear resistance property of the photosensitive layer include (1) a method for using curable binder in a surface layer (see Patent Literature 1), (2) a method for using a high-molecular weight charge transport material in a surface layer (see Patent Literature 2) and (3) a method for using inorganic fillers dispersed in a surface layer (see Patent Literature 0.3). Among these methods, the surface layer described in the method (1) has a tendency of lowering the image density as residual potential is elevated by poor compatibility of the curable binder with charge transport materials and the presence of impurities such as a polymerization initiator and unreacted residues. Although both the surface layer described in the method (2) that contains a charge transportable polymer material and the surface layer described in the method (3) that contains dispersed inorganic fillers can improve wear resistance property to some extents, the current situation is that fully satisfactory durability required for organic photoconductors has not yet been obtained. Additionally, the surface layer described in the method (3) has a tendency of flowering image densities as residual potential is elevated by charge traps that exist on the inorganic filler surface. For this reason, any of these methods (1), (2), and (3) has not yet succeeded in fully achieving overall durability, including electric durability and mechanical durability that are required for organic photoconductors.

For improving wear resistance property and scratch resistant property of the surface layer described in the method (1), a photoconductor containing multi-functional curable acrylate monomers is proposed (see Patent Literature 4). Although this Patent Literature discloses a photoconductor in which its protective layer (or surface layer) disposed on the photosensitive layer contains the multi-functional curable acrylate monomer, it merely describes the fact that the protective layer may contain a charge transport material and fails to provide a specific description. Furthermore, when a low molecular weight charge transport material is simply contained in the protective layer, its compatibility with the cured material of the foregoing monomer becomes a problem. As a result, this may cause deposition of the low-molecular weight charge transport material and cracking in the surface layer, and finally lowering its mechanical strength. This Patent Literature also discloses that a polycarbonate resin is contained in the surface layer for increased compatibility; however, this causes a reduction in the content of the curable acrylic monomer and thus a sufficient wear resistance has not yet been obtained with this method. With regards to a photoconductor with no charge transport materials in the surface layer, the Patent Literature discloses that the surface layer is made thin for decreased exposed area potential, this photoconductor, however, has a short life because of the thin surface layer. Besides, the environmental stability of the charging potential and the exposed area potential is poor, and the values of the charging potential and the exposed area potential significantly fluctuate substantially depending on the environmental temperature and humidity, thereby failing to maintain sufficient values.

As an alternative wear resistance technology for the photosensitive layer, a method for using coating solution containing monomers having a carbon-carbon double bond, charge transport materials having a carbon-carbon double bond, and binder resins to form a charge transport layer is proposed (see Patent Literature 5). The proposed binder resin is classified into two types: one reactive to the charge transport materials having a carbon-carbon double bond and one not reactive to the charge transport materials having no carbon-carbon double bond. The photoconductor draws attention because of the simultaneous achievement of wear resistance property and superior electric property; however, when a non-reactive binder resin is used, the compatibility of the binder resin with the cured material produced by reaction of the monomer with the charge transport material becomes poor, surface unevenness occurs due to layer separation at the time of cross-linking, thereby causing the tendency of defective cleaning. In this case, specifically described one that not only prevents the binder resin from monomer curing and but also is used for producing a photoconductor is a bifunctional monomer; however, this bifunctional monomer has a small number of functional groups, thus resulting in failure to obtain a sufficient cross-linkage density and thereby wear resistance property is not yet satisfactory. Moreover, even in the case where a reactive binder is used, due to a small number of functional groups contained in the monomer and the binder resin, the simultaneous achievement of the bond amount of the charge transport materials and cross-linkage density becomes difficult, and thereby electric property and wear resistance property of the photoconductor are not satisfactory.

Besides, the photosensitive layer containing a compound of a cured hole transportable compound having two or more chain polymerizable functional groups in the same molecule is proposed (see Patent Literature 6). However, the photosensitive layer of the proposition generates strain within a curable because a bulky hole transportable compound has two or more chain polymerizable functional groups, enhances an internal stress, tends to generate surface layer roughness, and cracking over time, thereby failing to achieve sufficient durability.

Besides, the electrophotographic photoconductor having cured cross-linked layer of a radically polymerizable compound having three or more functionalities with no charge transport structure and a radically polymerizable compound having single functionality with charge transport structure is proposed (see Patent Literatures 7 to 20 for example). In these propositions, using a monofunctional radically polymerizable compound with charge transport structure controls mechanical and electrical durability and generation of cracking in the photosensitive layer. However, in case of forming this cross-linked layer, an acrylic monomer having a multiple number of acrylic functional groups is cured to achieve high wear resistance. In this case, the acrylic cured material significantly shrinks in volume; thereby adhesiveness with photosensitive layer, that is, a lower layer may become insufficient. Besides, when an image forming apparatus that poses a high mechanical hazard to the electrophotographic photoconductor is used, there is an issue of yielding peeling of the cross-linked layer and the electrophotographic photoconductor cannot maintain sufficient wear resistance for prolonged periods. There is no sufficient description about the photoconductor temperature during curing for the formation of the cross-linked layer, but there is only disclosed information of controlling the photoconductor temperature at the time of exposure so as not to exceed 50° C.; however, sufficient curing at around 50° C. of the photoconductor temperature may not be expected and there is no description of controlling photoconductor temperature controlling method, thus there is no way but to shorten the exposure for preventing the photoconductor temperature from exceeding 50° C. However, if the exposure time is shortened, promotion of sufficient polymerization reaction may not be expected, thereby high wear resistance for prolonged periods cannot be maintained. Furthermore, in case of sufficient polymerization reaction, there is no discussion about evenness of the photoconductor temperature. Homogeneous polymerization of the cross-linked layer is undone with subdued difference between maximum value and minimum value of the post-exposure electrical potential, and thereby stable photoconductor property for prolonged periods cannot be achieved.

Besides, there are proposals in which a prescribed photoconductor temperature at the time of exposure is set by forming a cross-linked surface layer by curing of a photopolymerizable monomer (see Patent Literatures 21 and 22). These propositions have no detailed explanation about the method for controlling temperature, but only description of temperature being controlled by air cooling in Examples; however, if air is used as coolant media, cooling efficiency becomes very low because of its low thermal conductivity, amount of heat which is generated by curing with powerful irradiation light cannot be reduced, longtime exposure becomes impossible, and thereby sufficient polymerization reaction is not completed. Besides, in case of method for controlling temperature, fluctuation of flow rate and cooling efficiency by method becomes bigger and thereby cured level of a cross-linked surface layer fluctuates. That is, the dependency of places of wear resistance and electric property is large, the difference between maximum value and minimum value of the post-exposure electrical potential with respect to electric property cannot be stemmed, and thereby stable property for prolonged periods cannot be maintained.

Consequently, any of electrophotographic photoconductors having a cross-linked layer which is chemically bonded with charge transport structure in these conventional technologies has not yet provided sufficient total property in the present state of affairs.

[Patent Literature 1] Japanese Patent Application Laid-Open (JP-A) No. 56-48637
[Patent Literature 2] JP-A No. 64-1728
[Patent Literature 3] JP-A No. 04-281461
[Patent Literature 4] Japanese Patent (JP-B) No. 3262488
[Patent Literature 5] JP-B No. 3194392
[Patent Literature 6] JP-A No. 2000-66425
[Patent Literature 7] JP-A No. 2004-302450
[Patent Literature 8] JP-A No. 2004-302451
[Patent Literature 9] JP-A No. 2004-302452
[Patent Literature 10] JP-A No. 2005-099688
[Patent Literature 11] JP-A No. 2005-107401
[Patent Literature 12] JP-A No. 2005-107490
[Patent Literature 13] JP-A No. 2005-115322
[Patent Literature 14] JP-A No. 2005-140825
[Patent Literature 15] JP-A No. 2005-156784
[Patent Literature 16] JP-A No. 2005-157026
[Patent Literature 17] JP-A No. 2005-157297
[Patent Literature 18] JP-A No. 2005-189821
[Patent Literature 19] JP-A No. 2005-189828
[Patent Literature 20] JP-A No. 2005-189835
[Patent Literature 21] JP-A No. 2001-125297
[Patent Literature 22] JP-A No. 2004-240305

DISCLOSURE OF INVENTION

An object of the present invention is to provide a long-lived, high-end electrophotographic photoconductor that maintains high wear resistance for prolonged periods, has almost no electric property fluctuation, has little dependencies of places of wear resistance and electric property, has excellent durability and stable electric property, can provide high-quality image forming for prolonged periods, a method for producing an electrophotographic photoconductor, an image forming method, an image forming apparatus, and a process cartridge.

To resolve the problems described above, the present inventors studied carefully and reached a conclusion that for an electrophotographic photoconductor having a cross-linked layer with at least a cured material obtained by irradiation of a radically polymerizable compound with light, when writing is conducted under the condition that image static power is 0.53 mW and exposure energy is 4.0 erg/cm$^2$ and the difference between the maximum value of the post-exposure electrical potential and the minimum value of the post-exposure electrical potential came within 30V, the problems could be resolved.

The present invention is based on the knowledge by the present inventors, the means for resolving the issues are as follows.

<1> An electrophotographic photoconductor, including: a support; and a cross-linked layer formed over the support, wherein the cross-linked layer includes a cured material of a cross-linked layer composition containing at least a radically polymerizable compound, and wherein when the photoconductor is exposed at a field static power of 0.53 mw and exposure energy of 4.0 erg/cm$^2$, the difference between the maximum and minimum values of post-exposure electrical potential is within 30V.

<2> The electrophotographic photoconductor according to <1>, wherein the maximum value (Vmax) of the post-exposure electrical potential is −60V or less.

<3> The electrophotographic photoconductor according to one of <1> and <2>, wherein the radically polymerizable compound includes both a radically polymerizable compound with charge transport structure and the radically polymerizable compound with no charge transport structure.

<4> The electrophotographic photoconductor according to <3>, wherein the number of radically polymerizable functional groups in a radically polymerizable compound with charge transport structure is 1.

<5> The electrophotographic photoconductor according to one of <3> and <4>, wherein the number of radically polymerizable functional groups in the radically polymerizable compound with no charge transport structure is 3 or more.

<6> The electrophotographic photoconductor according to any one of <1> to <5>, wherein the radically polymerizable functional group in radically polymerizable compound is any one of acryloyloxy group and methacryloyloxy group.

<7> The electrophotographic photoconductor according to any one of <1> to <6>, wherein the cross-linked layer is any one of a cross-linked surface layer, a cross-linked photosensitive layer, and a cross-linked charge transport layer.

<8> The electrophotographic photoconductor according to <7>, wherein a charge generating layer, a charge transport layer, and a cross-linked surface layer are sequentially disposed over the support.

<9> A method for producing an electrophotographic photoconductor including: forming a cross-linked layer by curing at least a radically polymerizable compound by irradiation with light, wherein the difference between the maximum and minimum values of the surface temperature over the entire surface of the electrophotographic photoconductor, measured just before completion of curing for the formation of the cross-linked layer, is within 30° C., and wherein the electrophotographic photoconductor is an electrophotographic photoconductor according to any one of <1> to <8>.

<10> The method for producing an electrophotographic photoconductor according to <9>, wherein the surface temperature of the electrophotographic photoconductor during curing for the formation of the cross-linked layer is 20° C. to 170° C.

<11> The method for producing an electrophotographic photoconductor according to any one of <9> and <10>, wherein the electrophotographic photoconductor is a hollow electrophotographic photoconductor, and a heating medium exists in the hollow space of the electrophotographic photoconductor during curing for the formation of the cross-linked layer.

<12> The method for producing an electrophotographic photoconductor according to <11>, wherein the heating medium is water.

<13> The method for producing an electrophotographic photoconductor according to one of <11> and <12>, wherein an elastic member is closely attached to the inside of the hollow electrophotographic photoconductor during curing for the formation of the cross-linked layer and the heating medium exists inside of the elastic member.

<14> The method for producing an electrophotographic photoconductor according to <13>, wherein the tensile strength of the elastic member is 10 kg/cm$^2$ to 400 kg/cm$^2$.

<15> The method for producing an electrophotographic photoconductor according to one of <13> and <14>, wherein JIS-A hardness of the elastic member is 10 to 100.

<16> The method for producing an electrophotographic photoconductor according to any one of <13> to <15>, wherein the thermal conductivity of the elastic member is 0.1 W/m·K to 10 W/m·K.

<17> The method for producing an electrophotographic photoconductor according to any one of <11> to <16>, wherein during curing for the formation of the cross-linked layer, the hollow electrophotographic photoconductor is placed so that the length of the electrophotographic photoconductor is substantially vertical.

<18> The method for producing an electrophotographic photoconductor according to any one of <11> to <17>, wherein the heating medium is circulated during curing for the formation of the cross-linked surface layer in a direction from top to bottom of the hollow electrophotographic photoconductor.

<19> The method for producing an electrophotographic photoconductor according to any one of <10> to <18>, wherein the exposure intensity for light curing is 1000 mW/cm$^2$ or more.

<20> An image forming apparatus including: an electrophotographic photoconductor according to any one of <1> to <8>; a latent electrostatic image forming unit to form a latent electrostatic image on a surface of the electrophotographic photoconductor; a developing unit configured to develop the latent electrostatic image using a toner to form a visible image; a transferring unit configured to transfer the visible image onto a recording medium; and a fixing unit configured to fix the transferred image to the recording medium.

<21> An image forming method including: forming a latent electrostatic image on a surface of an electrophotographic photoconductor according to any one of <1> to <8>; forming a visible image by developing the latent electrostatic image using a toner; transferring the visible image onto a recording medium; and fixing the visible image to the recording medium.

<22> A process cartridge including: an electrophotographic photoconductor according to any one of <1> to <8>, and at least one of a charging unit configured to charge a surface of the electrophotographic photoconductor, an exposing unit configured to expose the surface of the exposed photoconductor to form a latent electrostatic image thereon, a developing unit configured to develop the latent electrostatic image on the electrophotographic photoconductor using toner to form a visible image, a transferring unit, a cleaning unit, and a charge elimination unit.

Figure 1:
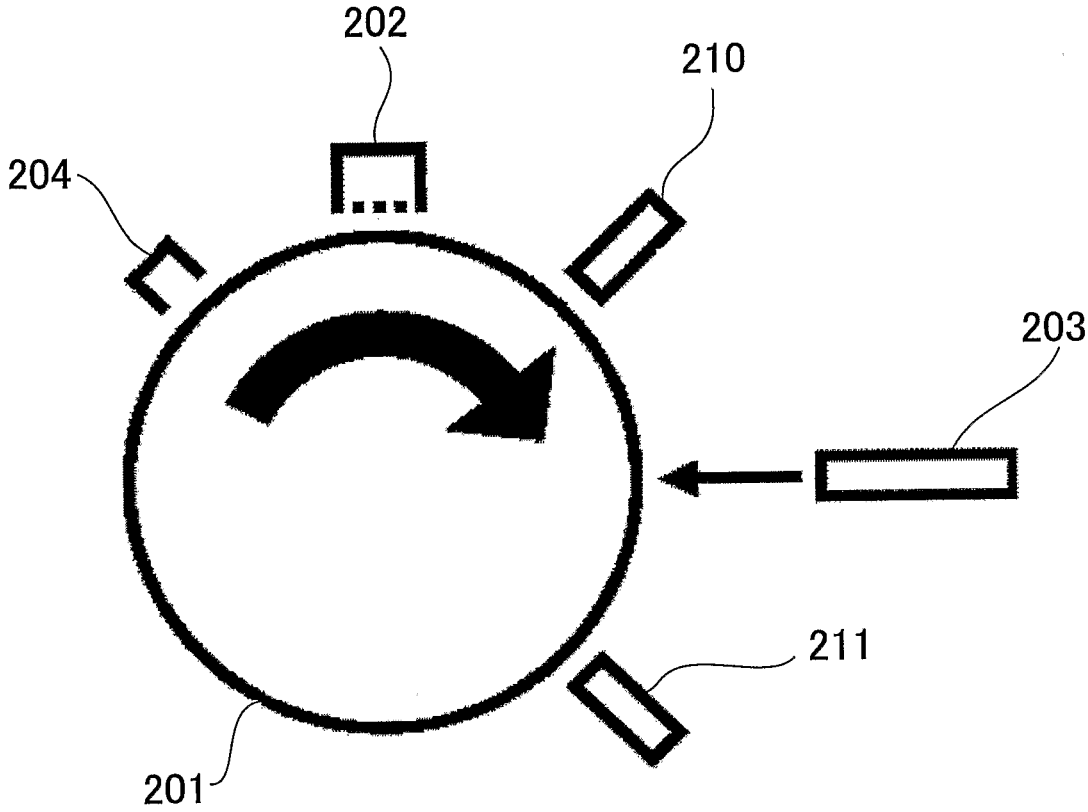
FIG. 1 is a block diagram of potential property evaluation equipment after exposure.

BEST MODE FOR CARRYING OUT THE INVENTION (Electrophotographic Photoconductor)

The electrophotographic photoconductor of the present invention includes a support, at least a cross-linked surface layer disposed over the support, and other layers as necessary.

The cross-linked layer is not particularly limited and may be properly selected according to the application. However, a laminated photoconductor may include a cross-linked charge transport layer, a cross-linked surface layer, or the like. A single-layer photoconductor may suit a cross-linked photosensitive layer, a cross-linked surface layer, or the like. Of these, the cross-linked surface layer is particularly preferable to the others.

For the electrophotographic photoconductor, when writing is conducted under the condition that the image static power is 0.53 mW and exposure energy is 4.0 erg/cm$^2$, the difference between the maximum value of the post-exposure electrical potential and the minimum value of the post-exposure electrical potential is within 30V, preferably within 20V, more preferably within 10V. This leads to obtain an electrophotographic photoconductor that can have a cross-linked layer having uniform property and compatibility between wear resistance and stable electrostatic property for prolonged periods.

If the difference between maximum value and minimum value is above 30V, uneven density may occur at the time of image outputting that is easily visible for unevenness of exposed area potential like half tone. From the viewpoint of wear resistance, the level of polymerization reaction becomes different from parts where the post-exposure electrical potential is high to parts where the post-exposure electrical potential is low, and more specifically, in parts where exposed area potential is high by promoting polymerization reaction, the cross-linked surface layer has property of high hardness, whereas in parts where exposed area potential is low, hardness becomes low. Therefore, stable wear resistance cannot be attained under the environment of actual use, wear volume of parts where hardness is low (parts where exposed area potential is low) becomes large, indistinctive uneven density at the initial state becomes clarified over time.

Here, the image static power means exposure that scans in the main scanning direction only (only polygon mirror rotates) and does not scan in the vertical scanning direction (photoconductor does not rotate in the circumferential direction).

For the electrophotographic photoconductor, when writing is conducted under the condition that the image static power is 0.53 mW and exposure energy is 4.0 erg/cm$^2$, the maximum value (Vmax) of the post-exposure electrical potential is preferably within −60V, more preferably within −80V. If Vmax exceeds −60V, polymerization reaction within cross-linked layer may not progress sufficiently and significant improvement of wear resistance may not be achieved. Halftone density may be difficult to acquire with an increase of shrinkage over the thickness of the cross-linked layer.

Here, the post-exposure electrical potential can be measured using for instance a property evaluation apparatus disclosed in JP-A No. 2000-275872, which is capable of evaluation of the sensitivity property of the electrophotographic photoconductor; however the evaluation apparatus is not limited to this and any evaluation apparatus which can measure the post-exposure electric potential can be used.

FIG. 1 shows a configuration example of the property evaluation apparatus. The property evaluation apparatus for the electrophotographic photoconductor in FIG. 1 is equipped with a charging unit 202, an exposure unit 203, and a neutralization unit 204 around a photoconductor 201, is equipped with a surface potential meter 210 between the charging unit 202 and the exposure unit 203, is equipped with a surface potential meter 211 between the exposure unit 203 and the neutralization unit 204.

The drum-shaped photoconductor 201 is attached to the drive mechanism unit so as to be rotatable. The charging unit 202, the neutralization unit 204, the surface potential meter 210, and the surface potential meter 211 are installed to a common table so as to be movable to the circumferential direction, the radial direction, and the longitudinal direction of the photoconductor 201.

The exposure unit 203 includes a laser writing device, is movable to the radial direction and the longitudinal direction of the drum-shaped photoconductor 201 (movable to the circumferential direction only when the photoconductor is rotated), wherein the radial direction of the photoconductor 201 is designed to have an interval by the distance of the photoconductor surface and the focal length of laser writing fθ lens.

With the property evaluation apparatus having a configuration as shown in FIG. 1, when the sensitivity of the photoconductor 201 is measured, the surface of the photoconductor 201 is neutralized by a neutralization unit 204 through rotating the polygon mirror of an exposure unit 203 as well as the photoconductor 201 at a constant rotating speed, the surface of the photoconductor 201 is charged until predetermined surface potential by the charging unit 202 is reached, and laser beam of the exposure unit 203 is applied to the charged photoconductor 201. By measuring the surface potential of the charged photoconductor 201 by the surface potential meter 210, by measuring the surface potential of the exposed photoconductor by the surface potential meter 211, and by calculating the exposed amount (Reached energy) required by potential decay from outer diameter of the photoconductor, linear speed of the photoconductor, resolution of the laser scan in the vertical scanning direction, charging time, deployed position of exposing time and the charging unit in the circumferential direction, and surface potential of the photoconductor, the relationship between the calculated exposure dose and measured exposed potential or electric change amount of before or after exposure is defined as the sensitivity of photoconductor.

<Cross-Linked Layer>

The cross-linked layer includes at least a radically polymerizable compound, and where necessary a cured material of a cross-linked layer composition containing other ingredient(s).

-Radically Polymerizable Compound-

The radically polymerizable compound preferably contains a radically polymerizable compound with no charge transport structure and a radically polymerizable compound with charge transport structure.

The radically polymerizable compound with charge transport structure means a compound which contains no hole transport structure such as triallyl amine, hydrazone, pyrazoline, carbazolyl, electron transport structure such as fused polycyclic quinone, diphenoquinone, and electron attracting aromatic rings having cyano group or nitro group, etc., and a radically polymerizable functional group. The radically polymerizable functional group can be any if the group is radically polymerizable, i.e., has a carbon-carbon double bond.

Examples of the radically polymerizable functional group include 1-substituted ethylene functional group and 1,1-substituted ethylene functional group represented by the following Formula (a).

(1) Examples of 1-substituted ethylene functional group are functional groups represented by the following Formula (a). (If the functional group has no aryl group segment, or arylene group segment, the functional group is connected to the aryl group segment or the arylene group segment.

$$CH_2{=}CH{-}X_1{-} \quad (a)$$

wherein $X_1$ represents an arylene group such as phenylene group, naphthylene group, which may be substituted, alkynylene group which may be substituted, —CO— group, —COO— group, —CON ($R^{10}$)— group (wherein $R^{10}$ represents a hydrogen atom, an alkyl group such as methyl group and ethyl group, aralkyl group such as benzyl group, naphthylmethyl group and phenethyl group, or aryl group such as phenyl group and naphthyl group), or —S— group.

Specific examples of these substituents include vinyl group, styryl group, 2-methyl-1,3-butadienyl group, vinylcarbonyl group, acryloyloxy group, acryloylamide group, vinylthioether group.

(2) Examples of 1,1-substituted ethylene functional group include those represented by the following Formula (b)

$$CH_2{=}C(Y){-}X_2{-} \quad (b)$$

wherein Y represents an alkyl group which may be substituted, aralkyl group which may be substituted, aryl group such as phenyl group, and naphthyl group which may be substituted, halogen atom, cyano group, nitro group, alkoxy group such as methoxy group and ethoxy group, —$COOR^{11}$ group (wherein $R^{11}$ represents a hydrogen atom, alkyl group such as methyl group and ethyl group which may be substituted, aralkyl group such as benzyl, naphthylmethyl and phenethyl groups which may be substituted, aryl group such as phenyl group and naphthyl group which may be substituted), or —$CONR^{12}R^{13}$ (wherein $R^{12}$ and $R^{13}$ represent a hydrogen atom, alkyl group such as methyl group and ethyl group which may be substituted, aralkyl group such as benzyl group, naphthylmethyl group, and phenethyl group which may be substituted, aryl group such as phenyl group and naphthyl group which may be substituted, and may be identical or different), $X_2$ represents a substituent identical to $X_1$ in the Formula (a), a single bond, or alkylene group, provided that at least one of Y and $X_2$ is oxycarbonyl group, cyano group, alkenylene group, or aromatic ring.

Specific examples of these substituents include α-chloro acryloyloxy group, methacryloyloxy group, α-cyanoethylene group, α-cyanoacryloyloxy group, α-cyanophenylene group, methacryloylamino group.

Examples of substituents by which the subsituents $X_1$, $X_2$, and Y are further substituted include a halogen atom, nitro group, cyano group, alkyl groups such as methyl group, ethyl group, alkoxy groups such as methoxy group, ethoxy group, aryloxy groups such as phenoxy group, aryl groups such as phenyl group, naphthyl group, and aralkyl groups such as benzyl group, and phenethyl group.

Among these radically polymerizable functional groups, acryloyloxy group and methacryloyloxy group are particularly useful. Compounds having one or more acryloyloxy groups may be obtained, for example, by ester reaction or ester exchange reaction using compounds having one or more hydroxy groups in the molecule, acrylic acid or salt, acrylic acid halide and acrylic acid ester. Besides, compounds having one or more methacryloyloxy groups may be obtained similarly. The radically polymerizable functional group in a monomer having two or more functionalities may be identical or different. Among these radically polymerizable functional groups, acryloyloxy group and methacryloyloxy group are particularly useful. The number of a radically polymerizable functional group in a single molecule can be one or more, but the number of a radically polymerizable functional group is preferably one in general to control internal stress of the cross-linked surface layer, to easily obtain smooth surface nature, and to sustain good electric property. By using charge transport compound having these radically polymerizable functional groups, both durability improvement and electric property that is stable for prolonged periods are attained. As charge transport structure of charge transport compound having a radically polymerizable functional group, triallyl amine structure suits from high mobility perspective, and among triallyl amine structures, compounds shown in the following general Formula (2) or (3) structure can maintain electric property such as sensitivity and residual potential in a good condition.

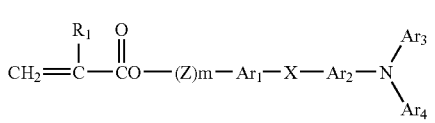

(2)

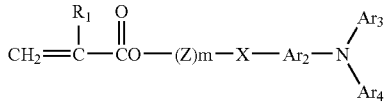

(3)

In Structural Formula (2) and (3), $R_1$ represents a hydrogen atom, a halogen atom, cyano group, nitro group, alkyl group which may be substituted, aralkyl group which may be substituted, aryl group which may be substituted, alkoxy group, —$COOR_7$ (wherein $R_7$ represents a hydrogen atom, alkyl group which may be substituted, aralkyl group which may be substituted, or aryl group which may be substituted), halogenated carbonyl group, or $CONR_8R_9$ (wherein $R_8$ and $R_9$ each represents a hydrogen atom, halogen atom, alkyl group which may be substituted, aralkyl group which may be substituted, or aryl group which may be substituted and $R_8$ and $R_9$ may be identical or different).

$Ar_1$ and $Ar_2$ each represent the substituted or unsubstituted arylene group which may be identical or different.

$Ar_3$ and $Ar_4$ each represent the substituted or unsubstituted aryl group, which may be identical or different.

X represents a single bond, substituted or unsubstituted alkylene group, substituted or unsubstituted cycloalkylene group, substituted or unsubstituted alkylene ether bivalent group, oxygen atom, sulfur atom, or vinylene group; Z represents the substituted or unsubstituted alkylene group, substituted or unsubstituted alkylene ether bivalent group, or alkyleneoxycarbonyl bivalent group; "m" and "n" each represents an integer from 0 to 3.

The following are specific examples of compounds represented by the previous Formulae (2) and (3).

In the substituents of $R_1$ in the general Formulae (2) and (3), examples of the alkyl groups include methyl group, ethyl group, propyl group, butyl group, examples of the aryl groups include phenyl group, naphthyl group, examples of the aralkyl groups include benzyl group, phenethyl group, naphthylmethyl group, examples of the alkoxy groups include methoxy group, ethoxy group, and propoxy group. These groups may be substituted furthermore with a halogen atom, nitro group, cyano group, alkyl group such as methyl group, ethyl group etc., alkoxy group such as methoxy group, ethoxy group, aryloxy group such as phenoxy group, aryl group such as phenyl group, naphthyl group, aralkyl group such as benzyl group, phenethyl group.

Hydrogen atom and methyl group are particularly preferable among substituents of $R_1$.

$Ar_3$ and $Ar_4$ are substituted or unsubstituted aryl groups and examples of the aryl groups include fused polycyclic hydrocarbon groups, non-fused cyclic hydrocarbon groups, and heterocyclic groups.

The fused polycyclic hydrocarbon group is preferably one having 18 or less carbon atoms for ring formation and examples thereof include pentanyl group, indenyl group, naphthyl group, azulenyl group, heptarenyl group, biphenylenyl group, as-indacenyl group, s-indacenyl group, fluorenyl group, acenaphthylenyl group, pleiadenyl group, acenaphthenyl group, phenalenyl group, phenanthryl group, antholyl group, fluoranthenyl group, acephenanthrylenyl group, aceanthrylenyl group, triphenylenyl group, pyrenyl group, chrysenyl group, and naphthacenyl group.

Examples of the non-fused cyclic hydrocarbon groups include monovalent group for monocyclic hydrocarbon compounds such as benzene, biphenyl ether, polyethylenediphenyl ether, diphenylthioether and diphenylsulphone, the monovalent group for non-fused polycyclic hydrocarbon compounds such as biphenyl, polyphenyl, diphenylalkane, diphenylalkene, diphenylalkyne, triphenylmethane, distyrylbenzene, 1,1-diphenylcycloalkane, polyphenylalkane and polyphenylalkene, or the monovalent group for cyclic hydrocarbon compounds such as 9,9-diphenylfluorene.

Examples of the heterocyclic groups include monovalent groups such as carbazole, dibenzofuran, dibenzothiophene, oxadiazole, and thiadiazole.

The aryl groups represented by $Ar_3$ and $Ar_4$ may be substituted with any of substituent described in (1) to (8) below.

(1) Halogen atom, cyano group, nitro group.

(2) Alkyl groups, preferably straight-chained or branched alkyl groups of 1 to 12 carbon atoms, more preferably 1 to 8 carbon atoms, and most preferably 1 to 4 carbon atoms, wherein alkyl groups may be substituted with a fluorine atom, hydroxy group, cyano group, alkoxy group for 1 to 4 carbon atoms, phenyl group, or phenyl group substituted with a halogen atom, alkyl group for 1 to 4 carbon atoms or alkoxy group for 1 to 4 carbon atoms. Specific examples thereof include methyl group, ethyl group, n-butyl group, i-propyl group, t-butyl group, s-butyl group, n-propyl group, tri-fluoromethyl group, 2-hydroxyethyl group, 2-ethoxyethyl group, 2-cyanoethyl group, 2-methoxyethyl group, benzyl group, 4-chlorobenzyl group, 4-methylbenzyl group, 4-phenylbenzyl group.

(3) Alkoxy groups (—$OR_2$), wherein $R_2$ represents an alkyl group as described in (2). Specific examples thereof include methoxy group, ethoxy group, n-propoxy group, i-propoxy group, t-butoxy group, n-butoxy group, s-butoxy group, i-butoxy group, 2-hydroxyethoxy group, benzyloxy group, trifluoromethoxy group.

(4) Aryloxy Groups

Aryl groups may be phenyl group and naphthyl group, which may be substituted with alkoxy group for 1 to 4 carbon atoms, alkyl group for 1 to 4 carbon atoms, or a halogen atom. Specific examples thereof include phenoxy group, 1-naphthyloxy group, 2-naphthyloxy group, 4-methoxyphenoxy group, 4-methylphenoxy group.

(5) Alkylmercapto Groups or Arylmercapto Groups

Specific examples thereof include methylthio group, ethylthio group, phenylthio group, p-methylphenylthio group.

(6) Groups expressed by the following Structural Formula.

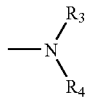

wherein $R_3$ and $R_4$ each independently represent a hydrogen atom, alkyl group as described in (2) or aryl group. Examples of the aryl group include phenyl group, biphenyl group, and naphthyl group which may be substituted with alkoxy group for 1 to 4 carbon atoms, alkyl group for 1 to 4 carbon atoms, or a halogen atom. $R_3$ and $R_4$ may form a ring together.

Specific examples thereof include amino group, diethylamino group, N-methyl-N-phenylamino group, N,N-diphenylamino group, N,N-di(tryl)amino group, dibenzylamino group, piperidino group, morpholino group, pyrrolidino group, (7) Alkylenedioxy groups or alkylenedithio groups such as methylenedioxy group or methylenedithio group.

(8) Substituted or unsubstituted styryl group, substituted or unsubstituted β-phenylstyryl group, diphenylaminophenyl group, ditolylaminophenyl group.

The arylene groups represented by $Ar_1$ and $Ar_2$ include divalent groups derived from aryl groups represented by $Ar_3$ and $Ar_4$.

X represents a single bond, substituted or unsubstituted alkylene group, substituted or unsubstituted cycloalkylene group, substituted or unsubstituted alkylene ether group, oxygen atom, sulfur atom, or vinylene group.

Examples of the substituted or unsubstituted alkylene groups are preferably straight-chain or branched-chain alkylene groups of 1 to 12 carbon atoms, preferably 1 to 8 carbon atoms, and more preferably 1 to 4 carbon atoms. The alkylene groups may be further substituted with a fluorine atom, hydroxy group, cyano group, and alkoxy groups of 1 to 4 carbon atoms, phenyl group, or phenyl group substituted with a halogen atom, alkyl group for 1 to 4 carbon atoms, or alkoxy group for 1 to 4 carbon atoms. Specific examples thereof include methylene group, ethylene group, n-butylene group, i-propylene group, t-butylene group, s-butylene group, n-propylene group, trifluoromethylene group, 2-hydroxyethylene group, 2-ethoxyethylene group, 2-cyanoethylene group, 2-methoxyethylene group, benzylidene group, phenylethylene group, 4-chlorophenylethylene group, 4-methylphenylethylene group, 4-biphenylethylene group.

Examples of the substituted or unsubstituted cycloalkylene groups include cyclic alkylene groups of 5 to 7 carbon atoms, wherein the cyclic alkylene groups may be substituted with a fluorine atom, hydroxide group, alkyl group for 1 to 4 carbon atoms, or alkoxy group for 1 to 4 carbon atoms. Specific examples thereof include cyclohexylidene group, cyclohexylene group, 3,3-dimethylcyclohexylidene group.

Examples of the substituted or unsubstituted alkylene ether bivalent group include alkyleneoxy bivalent group such as ethyleneoxy group, propyleneoxy group, di or poly (oxyalkylene) oxy bivalent group induced from such as diethylene glycol, tetraethylene glycol, tripropylene glycol, wherein alkylene ether bivalent group and alkylene group may be substituted with hydroxyl group, methyl group, ethyl group.

The vinylene group may be represented by the following Formula.

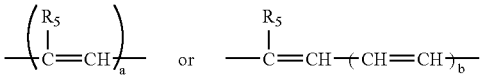

In the Structural Formula, $R_5$ represents a hydrogen atom, alkyl group that is identical to the one described in (2), or aryl group that is identical to the one represented by the $Ar_3$ and the $Ar_4$; "a" represents an integer of 1 or 2, and "b" represents an integer of 1 to 3.

Z represents the substituted or unsubstituted alkylene group, substituted or unsubstituted alkylene ether bivalent group, or alkyleneoxycarbonyl bivalent group. The substituted or unsubstituted alkylene groups include alkylene groups defined as X. The substituted or unsubstituted alkylene ether bivalent groups include alkylene ether bivalent groups defined as X. The alkyleneoxycarbonyl bivalent groups include caprolactone-modified bivalent groups.

Examples of the preferable radically polymerizable compounds with charge transport structure include compounds which have the structure of the following Structural Formula (4).

In compounds represented by the Structural Formula (4), substituents of Rb and Rc are preferably a methyl group or an ethyl group.

The radically polymerizable compounds with charge transport structure represented by the Structural Formulae (1), (2), and (3), particularly those represented by the Structural Formula (4) become incorporated into continuous polymer chains instead of being a terminal structure because polymerization is accomplished by opening a carbon-carbon double bond at both sides. The radically polymerizable compounds exist within cross-linked polymers formed with radically polymerizable monomers having three or more functionalities as well as in the cross-linking chain between main chains. This cross-linking chain contains intermolecular cross-linking chains between a polymer and other polymers, and intermolecular cross-linking chains between parts which have folded main chains within a polymer and other parts which originate from monomers polymerized in distant positions from the parts in the main chain. Whether radically polymerizable compounds having single functionality exist in the main chain or the cross-linking chain, the triarylamine structure attached to the chain having at least three aryl groups placed in a radial direction from the nitrogen atom is bulky; however, three aryl groups are not directly attached to the chains; instead they are indirectly attached to the chains through carbonyl group or the like, so that triarylamine structure is fixed flexibly in three-dimensional arrangement. Because the triarylamine structure has appropriate configuration within a molecule, it is presumed that the intramolecular structural strain is less and intramolecular structure can relatively escape the disconnection of charge transport path in the cross-linked surface layer of photoconductors.

Besides, in the present invention, specific acrylic acid ester compound represented in the following general Formula (5) may suit in use as a radically polymerizable compound with charge transport structure.

(4)

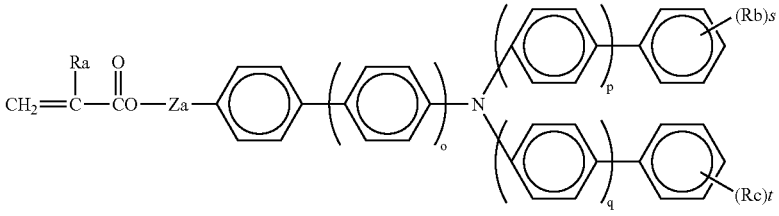

In the Structural Formula (4), "o," "p", and "q" each represents an integer of 0 or 1, Ra represents a hydrogen atom or methyl group, Rb and Rc may be identical or different, and represent alkyl groups of 1 to 6 carbon atoms. "s" and "t" each represents an integer of 0 to 3, and Za represents a single bond, methylene group, ethylene group, or groups expressed by the following Formulas:

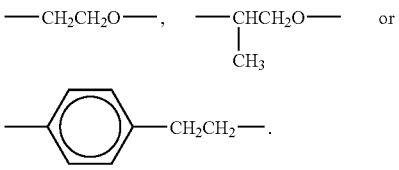

$$B_1—Ar_5\text{-}CH{=}CH—Ar_6—B_2 \quad (5)$$

In the general Formula (5), $Ar_5$ represents a monovalent or bivalent group having substituted or unsubstituted aromatic hydrocarbon skeleton. Examples of aromatic hydrocarbons include benzene, naphthalene, phenanthrene, biphenyl, 1,2,3,4-tetrahydronaphthalene.

Examples of substituent group include alkyl group of 1 to 12 carbon atoms, alkoxy group of 1 to 12 carbon atoms, benzyl group, and a halogen atom. The alkyl group, alkoxy group may further have halogen atom, and/or phenyl group as substituent group.

$Ar_6$ represents a monovalent or bivalent group having aromatic hydrocarbon skeleton with at least one tert-amino group, or monovalent or bivalent group having heterocyclic compound skeleton with at least one tert-amino group. The following general Formula (A) represents an aromatic hydrocarbons skeleton having the tert-amino group.

(A)

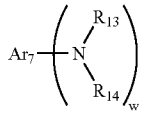

In the general Formula (A), $R_{13}$ and $R_{14}$ represent an acyl group, substituted or unsubstituted alkyl group, substituted or unsubstituted aryl group. $Ar_7$ represents an aryl group, and "w" represents an integer from 1 to 3.

Examples of acyl groups of $R_{13}$ and $R_{14}$ include acetyl group, propionyl group, and benzoyl group.

Substituted or unsubstituted alkyl groups of $R_{13}$, $R_{14}$ are similar to those for $Ar_5$.

Examples of the substituted or unsubstituted aryl groups for $R_{13}$ and $R_{14}$ include phenyl group, naphthyl group, biphenylyl group, tert-phenylyl group, pyrenyl group, fluorenyl group, 9,9-dimethyl-2-fluorenyl group, azulenyl group, antholyl group, triphenylenyl group, chrysenyl group, and functional group represented by the following general Formula (B).

(B)

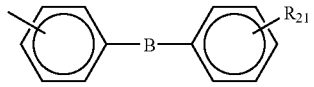

In the general Formula (B), B represents —O—, —S—, —SO—, —$SO_2$—, —CO—, or bivalent group represented by the following Formula.

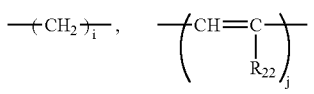

In the Formula, $R_{21}$ represents a hydrogen atom, substituted or unsubstituted alkyl group defined in $Ar_5$, alkoxy group, halogen atom, substituted or unsubstituted aryl group defined in $R_{13}$, amino group, nitro group, and cyano group. $R_{22}$ represents a hydrogen atom, substituted or unsubstituted alkyl group defined in $Ar_5$, and substituted or unsubstituted aryl group defined in $R_{13}$, "i" represents an integer of 1 to 12, and "j" represents an integer of 1 to 3.

Examples of alkoxy groups for $R_{21}$ include methoxy group, ethoxy group, n-propoxy group, i-propoxy group, n-butoxy group, i-butoxy group, s-butoxy group, t-butoxy group, 2-hydroxyethoxy group, 2-cyanoethoxy group, benzyloxy group, 4-methylbenzyloxy group, trifluoromethoxy group.

Examples of halogen atom for $R_{21}$ include fluorine atom, chlorine atom, bromine atom, iodine atom.

Examples of amino groups for $R_{21}$ include diphenylamino group, ditolylamino group, dibenzylamino group, 4-methylbenzyl group.

Examples of aryl group for $Ar_7$ include phenyl group, naphthyl group, biphenylyl group, tert-phenylyl group, pyrenyl group, fluorenyl group, 9,9-dimethyl-2-fluorenyl group, azulenyl group, antholyl group, triphenylenyl group, chrysenyl group, $Ar_7$, $R_{13}$, and $R_{14}$ may be substituted with the alkyl group, alkoxy group, halogen atom defined in $Ar_5$.

Examples of the heterocyclic compound skeleton having a tert-amino group include heterocyclic compounds having amine structure such as pyrrol, pyrazole, imidazole, triazole, dioxyazole, indole, isoindole, benzimidazole, benzotriazole, benzoisoxazine, carbazolyl, phenoxazine. These may have alkyl group, alkoxy group, and a halogen atom defined in $Ar_5$ as a substituent group.

In the general Formula (5), $B_1$ and $B_2$ each represents acryloyloxy group, methacryloyloxy group, vinyl group, acryloyloxy group, methacryloyloxy group, alkyl group having vinyl group, acryloyloxy group, methacryloyloxy group, and alkoxy group having vinyl group. Alkyl group and alkoxy group are applied to the $Ar_5$ aforementioned likewise. Note in the formula that either $B_1$ or $B_2$ appears; they do not appear at the same time.

In the acrylic acid ester compound shown in the general Formula (5), compounds represented by the following general Formula (6) are preferable.

(6)

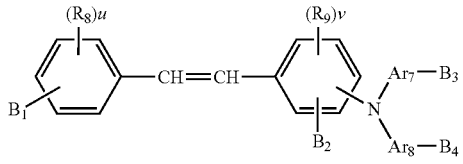

In the general Formula (6), $R_8$ and $R_9$ each represent the substituted or unsubstituted alkyl group, substituted or unsubstituted alkoxy group, and a halogen atom. $Ar_7$ and $Ar_8$ each represents the substituted or unsubstituted aryl group, arylene group, substituted or unsubstituted benzyl group. Alkyl group, alkoxy group, and a halogen atom are applied to the $Ar_5$ aforementioned likewise.

The aryl group is aryl group defined in $R_{13}$, $R_{14}$ likewise. The arylene group is bivalent group induced from the aryl group.

$B_1$ to $B_4$ are $B_1$, $B_2$ of the general Formula (5) likewise. Out of $B_1$ to $B_4$, only one of four exists and existence of two or more is excluded. "u" represents an integer of 0 to 5 and "v" represents an integer of 0 to 4.

The specific acrylic acid ester compounds have the following feature. It is a tert-amine compound having conjugate structure of stilbene type and has a developed conjugate system. Using the developed charge transport compound of the conjugate system, charge injection property of the cross-linked layer interface improves remarkably, and in case of cross-linking bond being fixed, intermolecular interaction is hardly interrupted, which charge mobility is in a good condition as well. It also has a highly radically polymerizable acryloyloxy group, or methacryloyloxy group within a molecule, promotes gelation promptly at the time of radical polymerization, and does not yield extreme cross-linking strain. Double bonds of stilbene part within molecules join partly polymerization. In addition, because polymerization property is lower than that of acryloyloxy group, or methacryloyloxy group, it prevents maximum strain from occurring by the time difference in cross-linking reaction. Furthermore, because it is possible to increase the number of cross-linking reactions per molecular weight by using a double bond within a molecule, it is possible to increase the cross-link density and attain further improvement of wear resistance. The double bond can adjust degree of polymerization according to cross-linking condition, so that it can produce optimal cross-linked layer easily. The cross-linking participation to radical polymerization is a specific property to acrylic acid ester compound, and does not happen in the described α-phenyl stilbene type structure.

From the above, the use of a radically polymerizable compound with charge transport structure shown in the general Formula (5), especially the general Formula (6), maintains superior electric property, can form a film of extreme high cross-link density without involving cracking, whereby it is possible to satisfy the properties of the photoconductor, to prevent fine silica particles from sticking to the photoconductor, and to reduce the occurrence of image failures such as white dots.

The following are non-exclusive examples of the radically polymerizable compounds with charge transport structure, which are used in the present invention.

TABLE 1-1

NO. 1

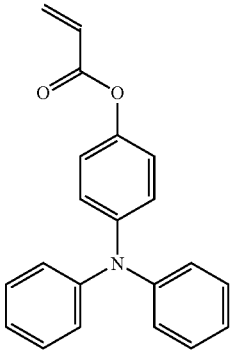

NO. 2

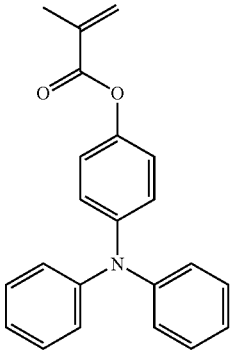

NO. 3

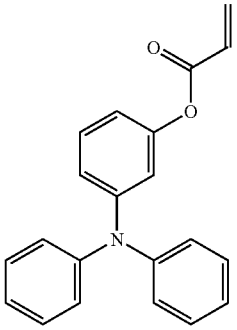

TABLE 1-1-continued

NO. 4

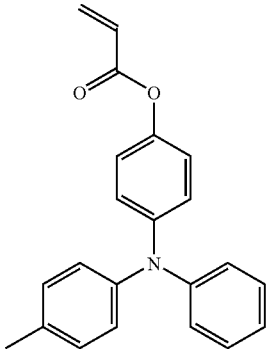

NO. 5

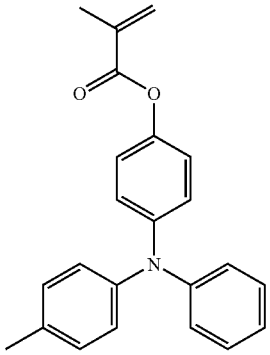

NO. 6

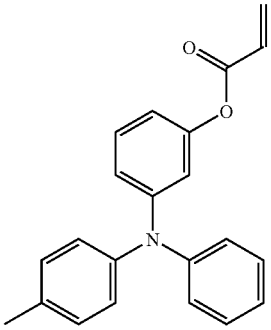

NO. 7

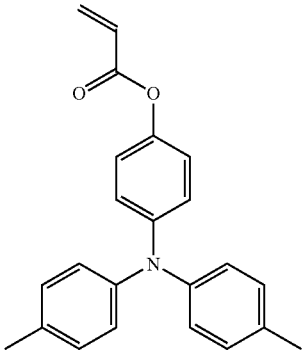

TABLE 1-1-continued
NO. 8
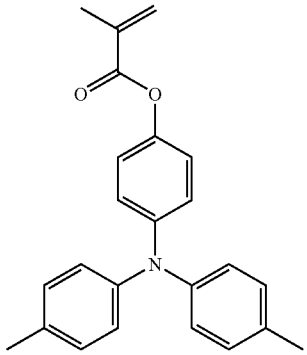
NO. 9
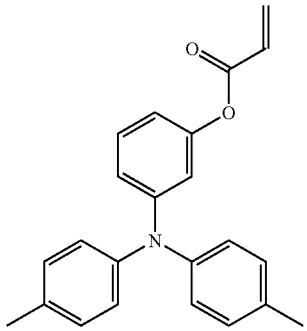
NO. 10
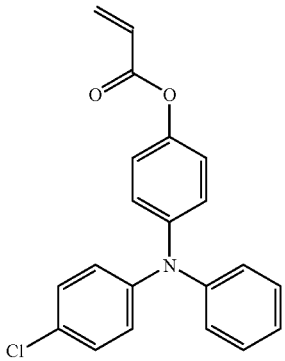
NO. 11
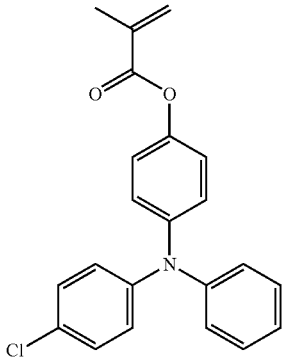
TABLE 1-1-continued
NO. 12
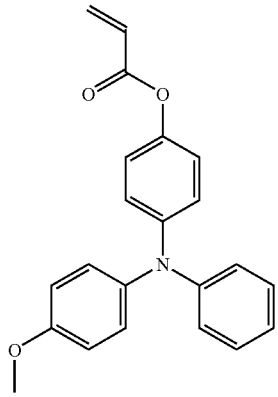
NO. 13
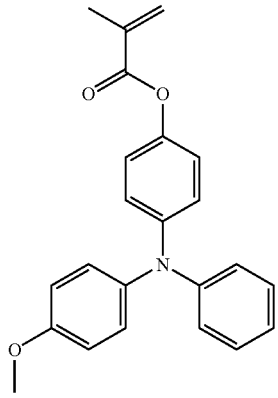
NO. 14
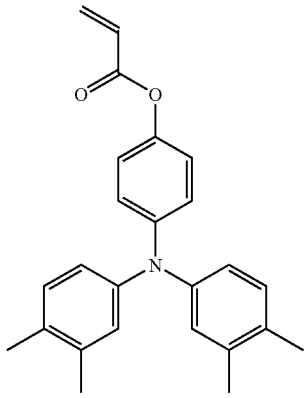
NO. 15
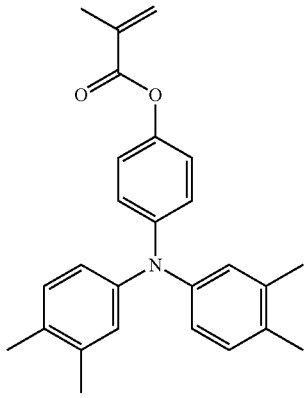

TABLE 1-1-continued
NO. 16
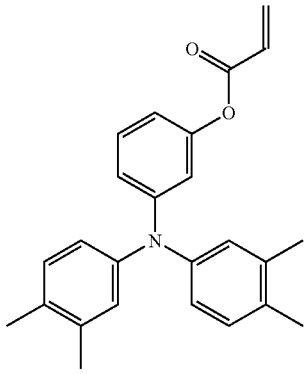
NO. 17
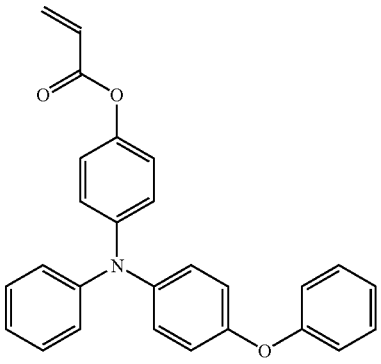
NO. 18
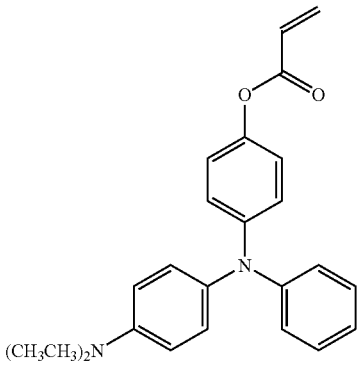
TABLE 1-1-continued
NO. 19
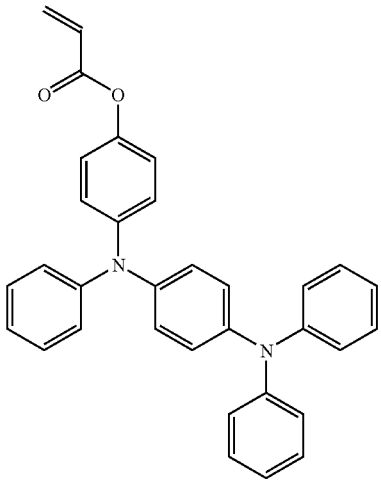
NO. 20
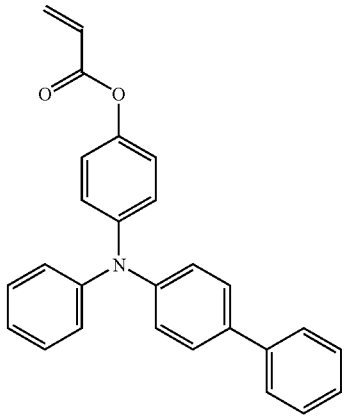
NO. 21
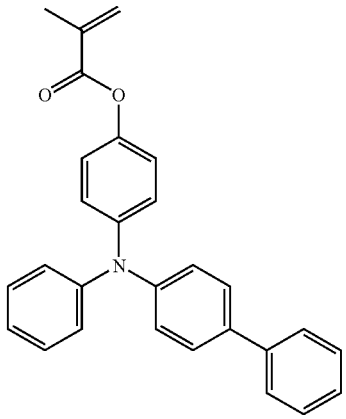

TABLE 1-1-continued
NO. 22
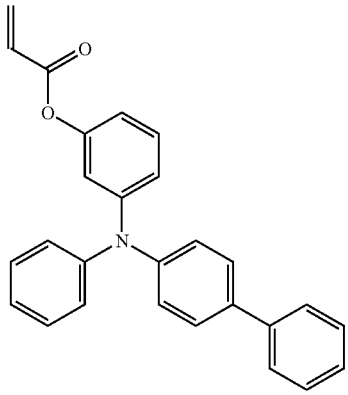
NO. 23
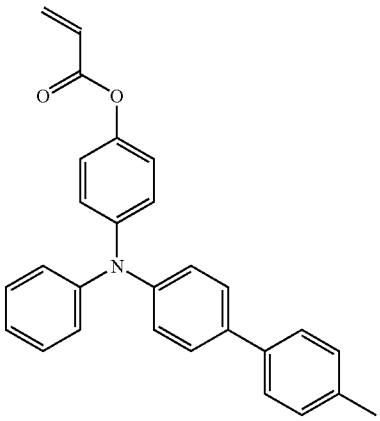
NO. 24
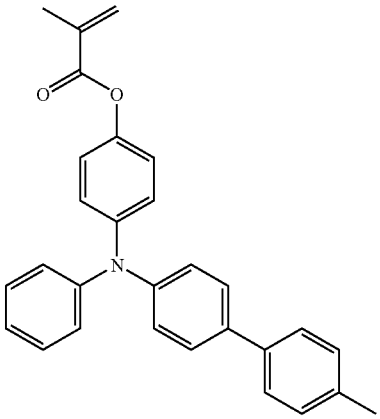
TABLE 1-1-continued
NO. 25
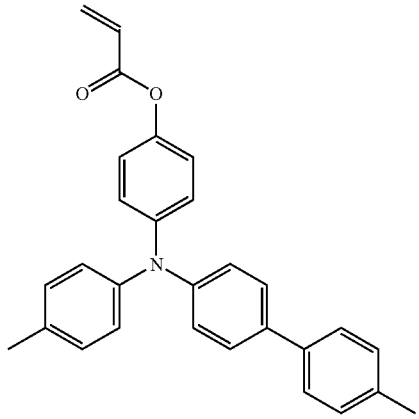
TABLE 1-2
NO. 26
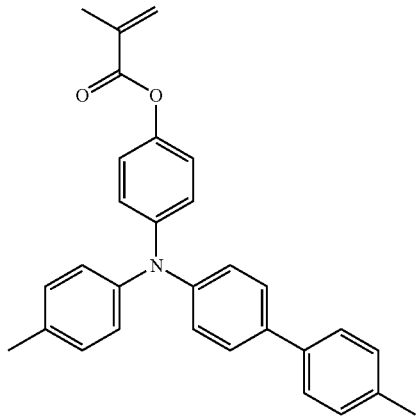
NO. 27
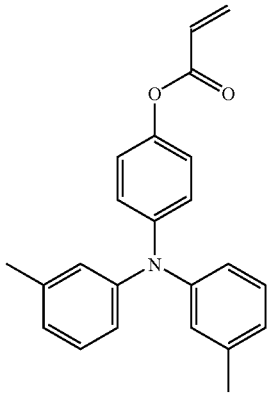

TABLE 1-2-continued
NO. 28
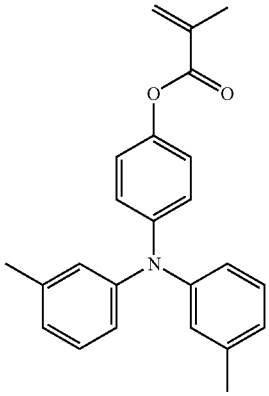
NO. 29
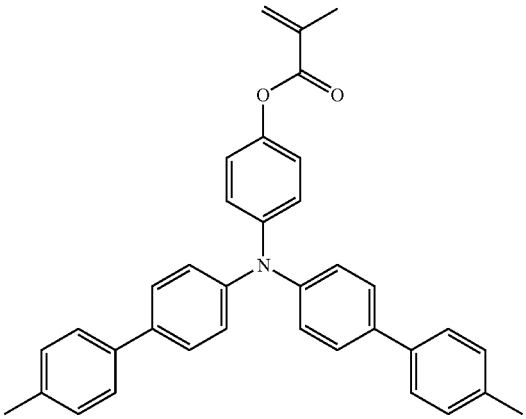
NO. 30
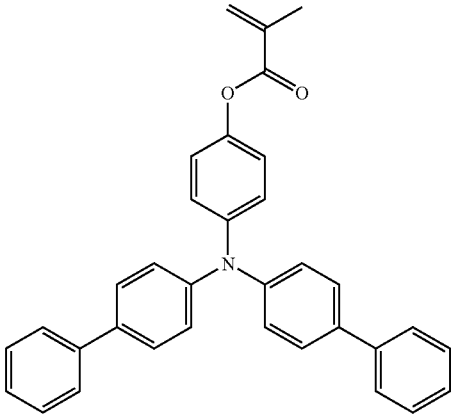
TABLE 1-2-continued
NO. 31
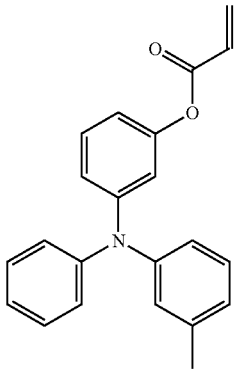
NO. 32
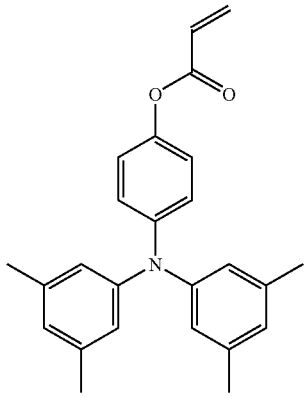
NO. 33
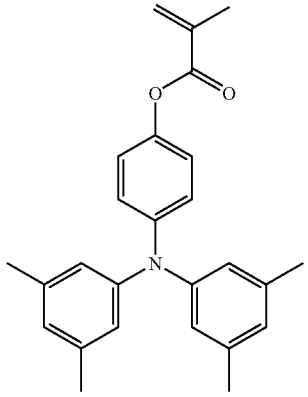
NO. 34
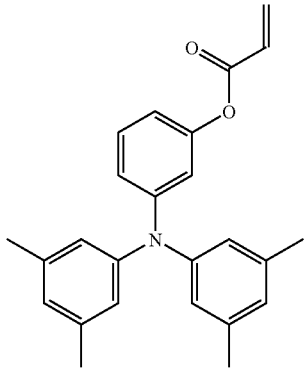

TABLE 1-2-continued
NO. 35
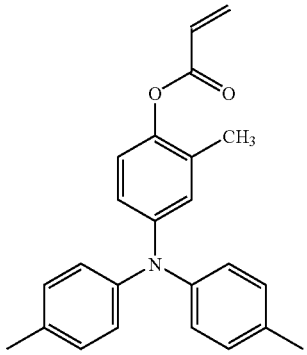
NO. 36
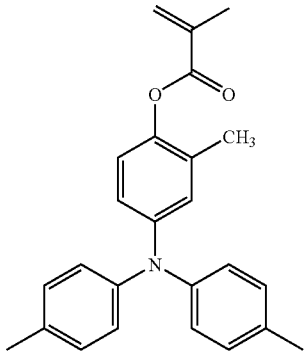
NO. 37
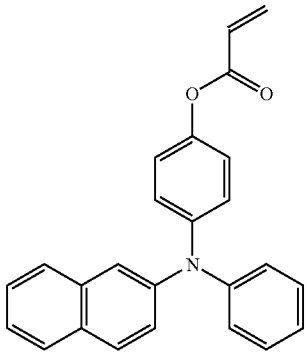
NO. 38
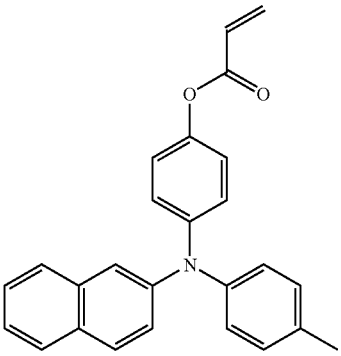
TABLE 1-2-continued
NO. 39
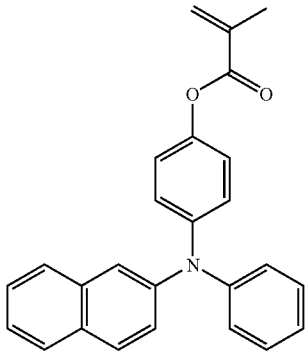
NO. 40
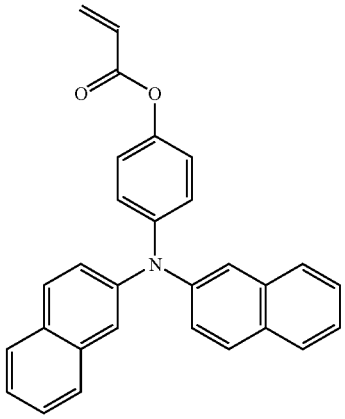
NO. 41
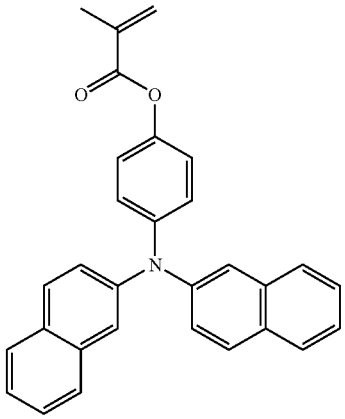

TABLE 1-3
NO. 42
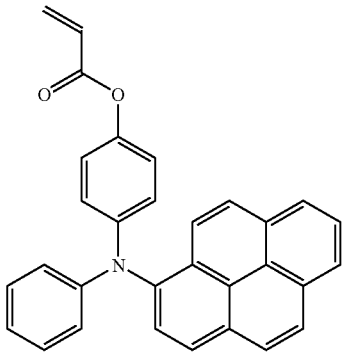
NO. 43
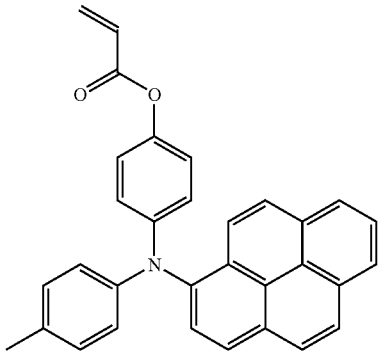
NO. 44
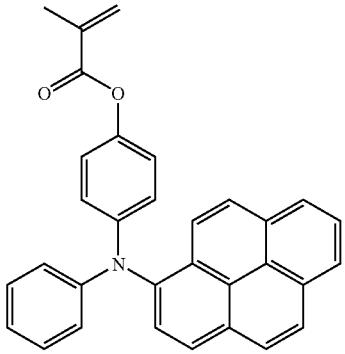
NO. 45
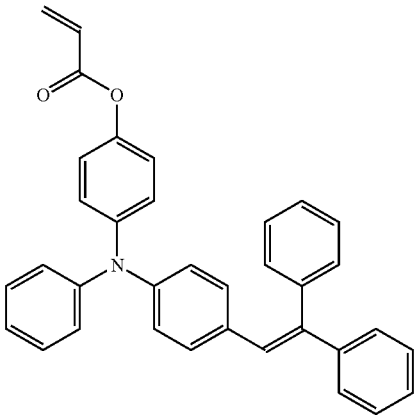
TABLE 1-3-continued
NO. 46
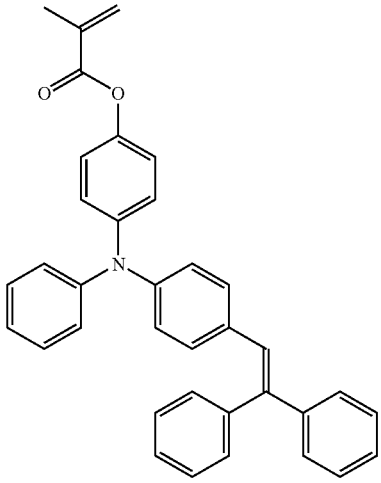
NO. 47
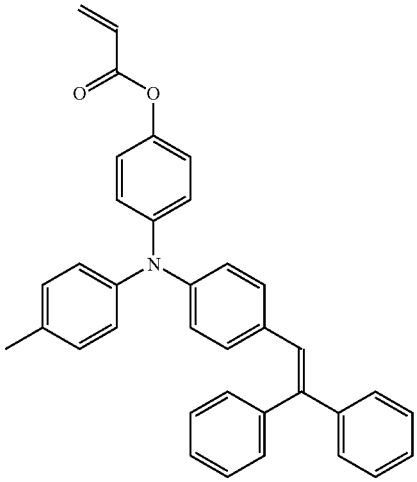
NO. 48
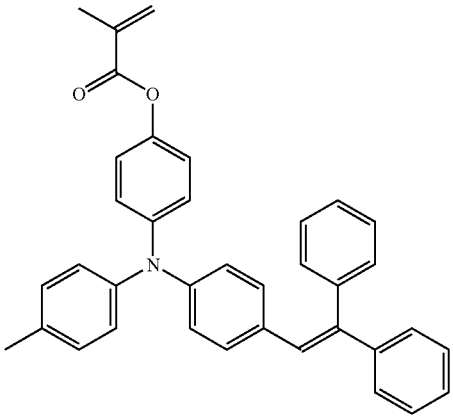

TABLE 1-3-continued
NO. 49
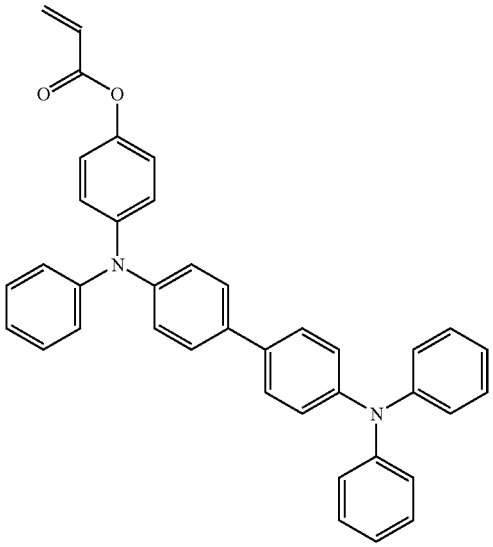
NO. 50
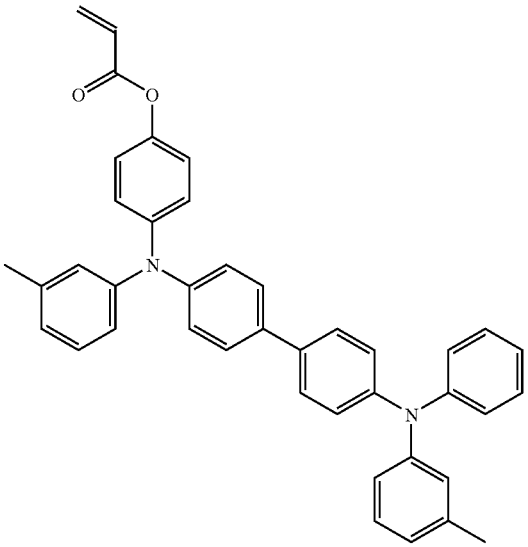
NO. 51
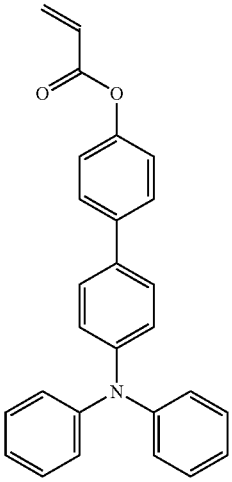
TABLE 1-3-continued
NO. 52
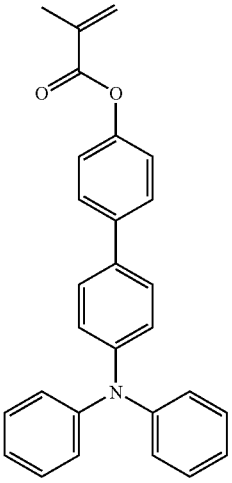
NO. 53
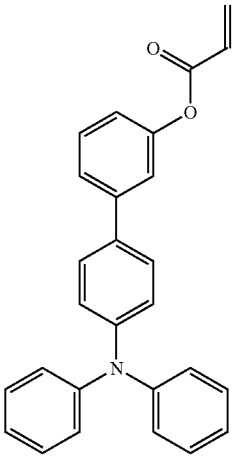
NO. 54
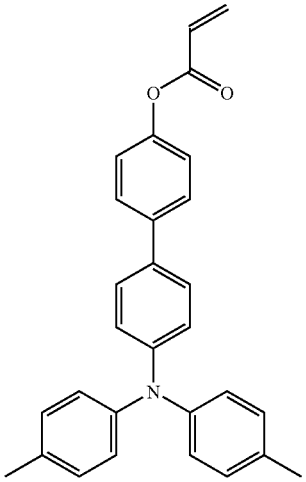

TABLE 1-3-continued
NO. 55
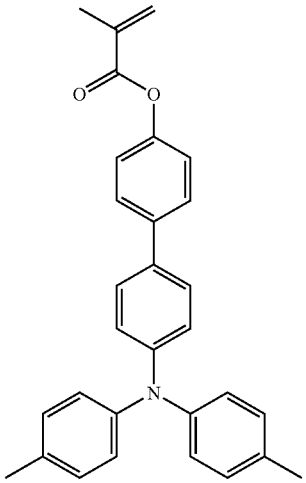
NO. 56
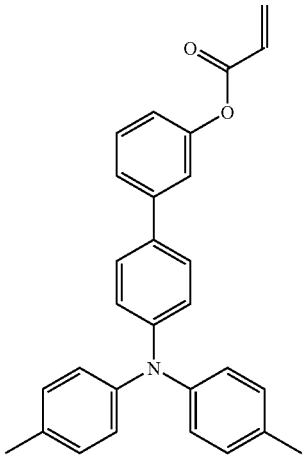
NO. 57
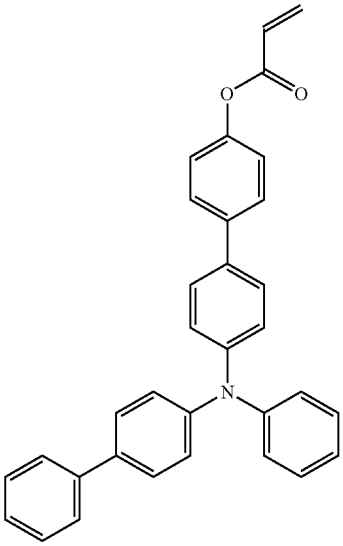
TABLE 1-4
NO. 58
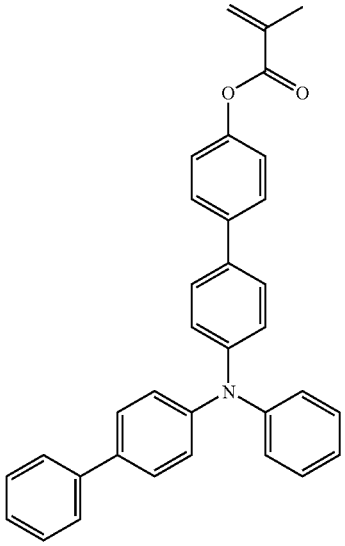
NO. 59
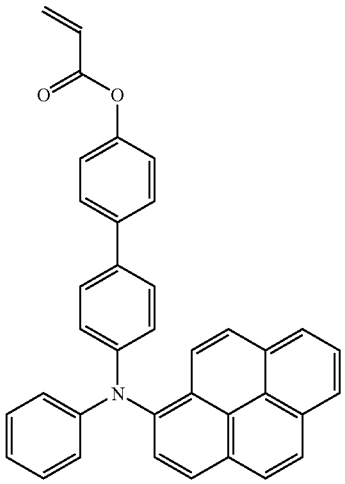
NO. 60
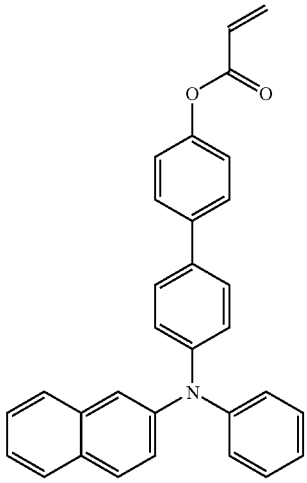

TABLE 1-4-continued
NO. 61
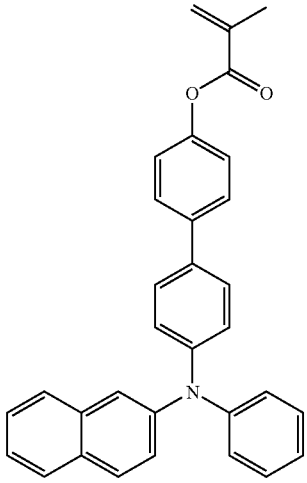
NO. 62
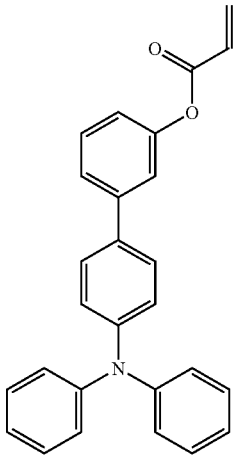
NO. 63
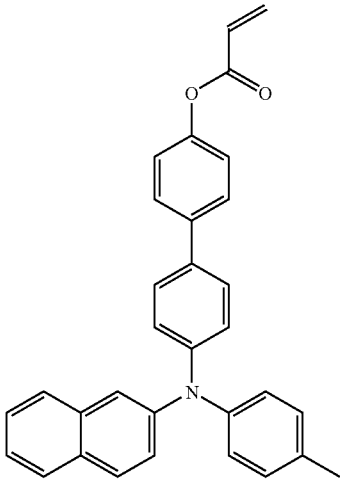
TABLE 1-4-continued
NO. 64
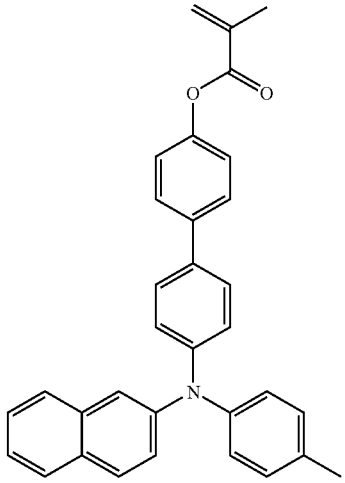
NO. 65
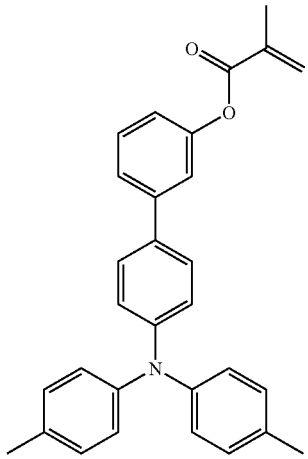
NO. 66
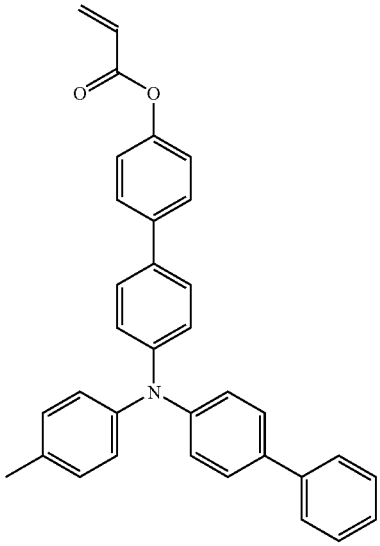

TABLE 1-4-continued
NO. 67
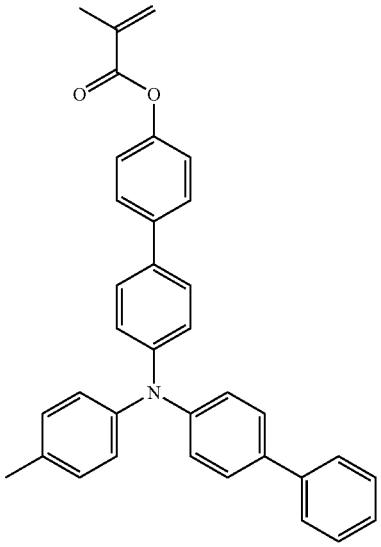
NO. 68
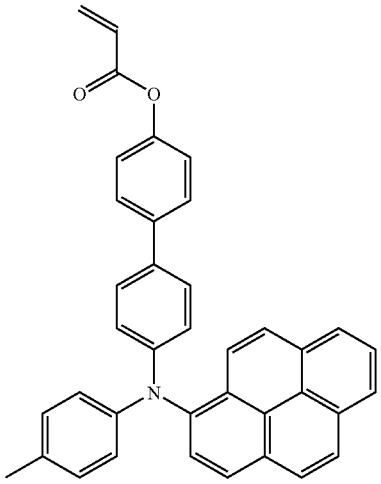
TABLE 1-4-continued
NO. 69
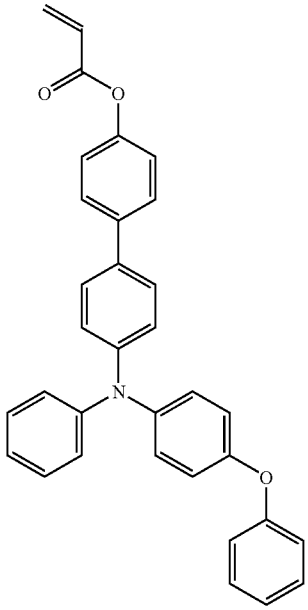
NO. 70
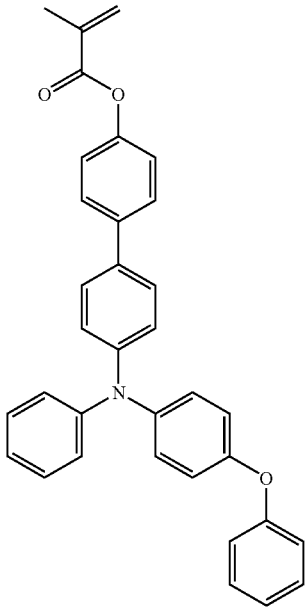

TABLE 1-4-continued
NO. 71
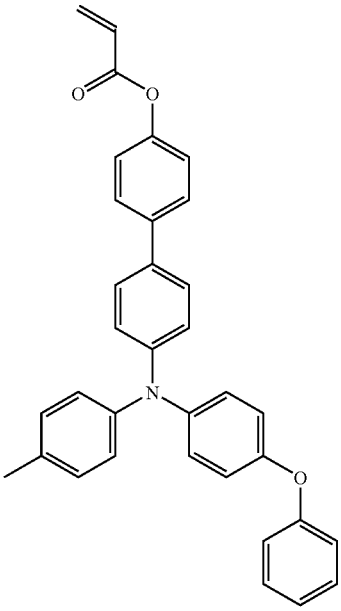
NO. 72
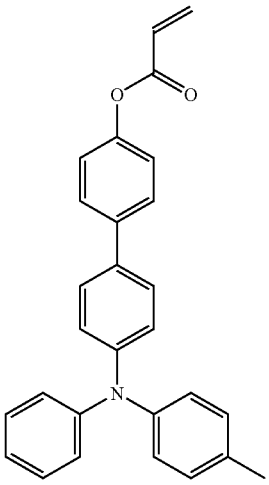
NO. 73
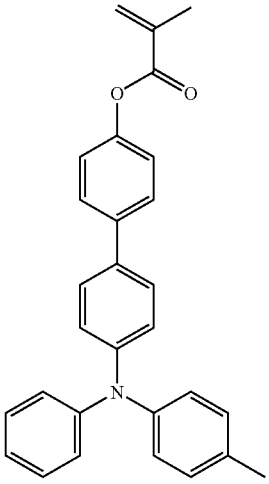
TABLE 1-4-continued
NO. 74
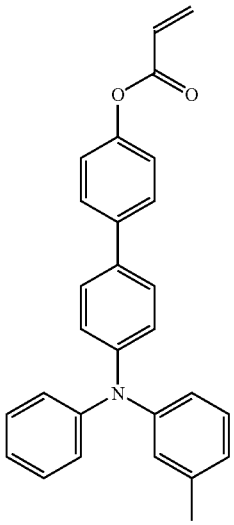
NO. 75
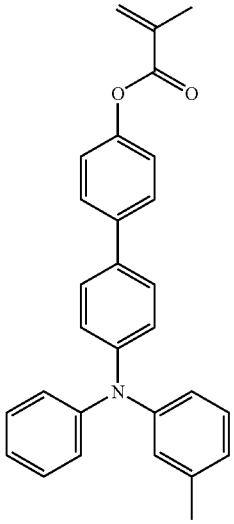
NO. 76
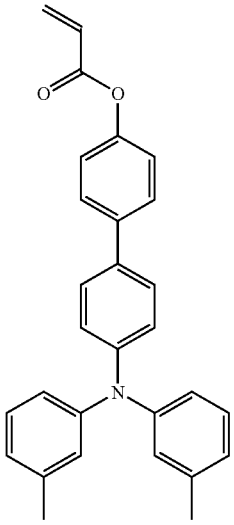

TABLE 1-4-continued
NO. 77
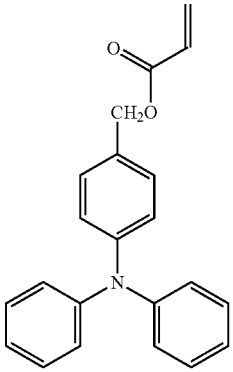
TABLE 1-5
NO. 78
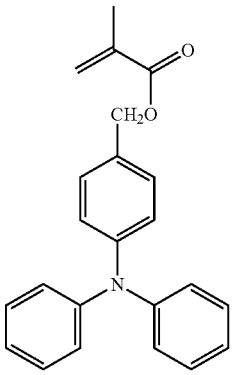
NO. 79
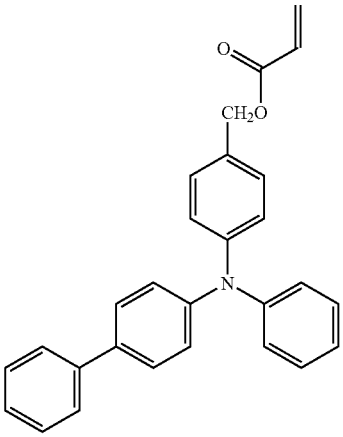
TABLE 1-5-continued
NO. 80
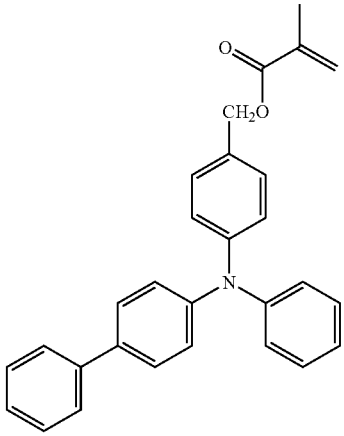
NO. 81
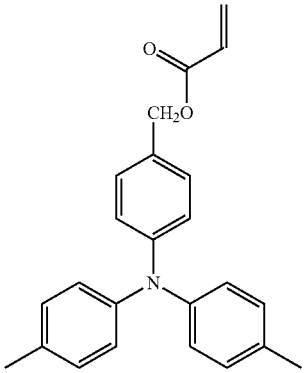
NO. 82
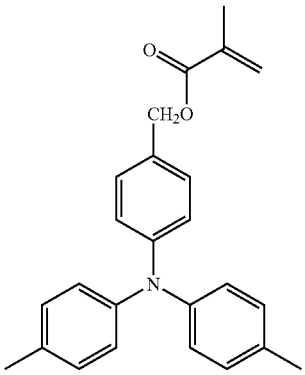
NO. 83
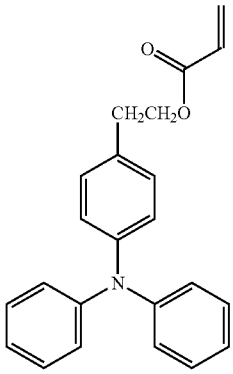

TABLE 1-5-continued
NO. 84
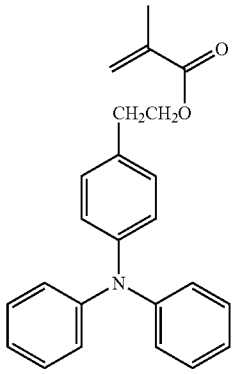
NO. 85
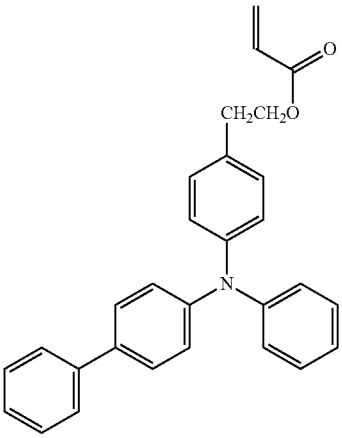
NO. 86
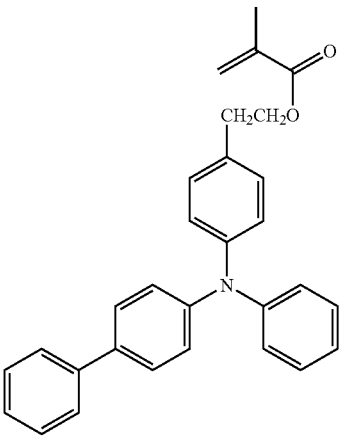
TABLE 1-5-continued
NO. 87
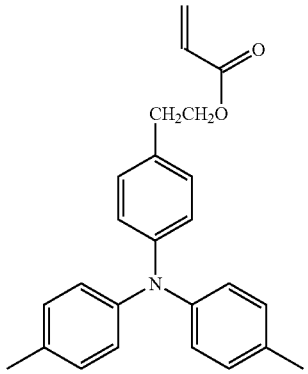
NO. 88
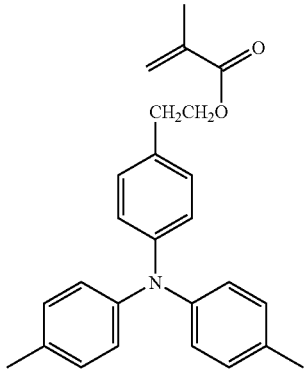
NO. 89
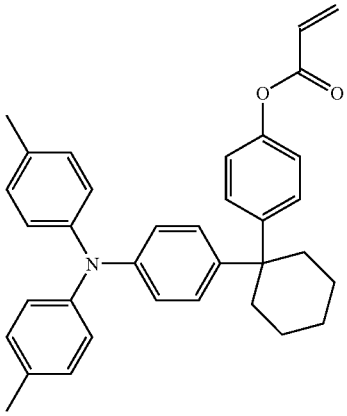
NO. 90
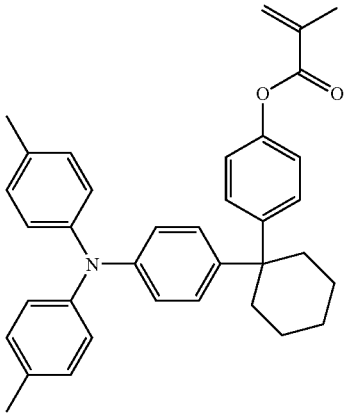

TABLE 1-5-continued
NO. 91
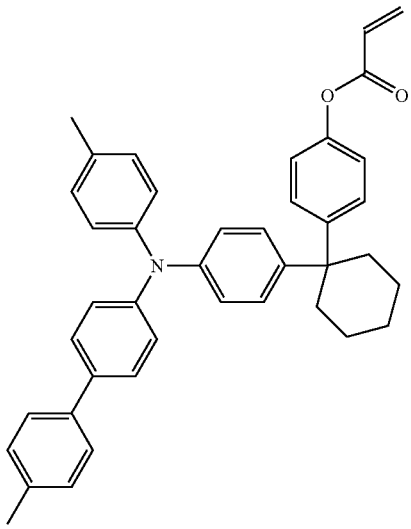
NO. 92
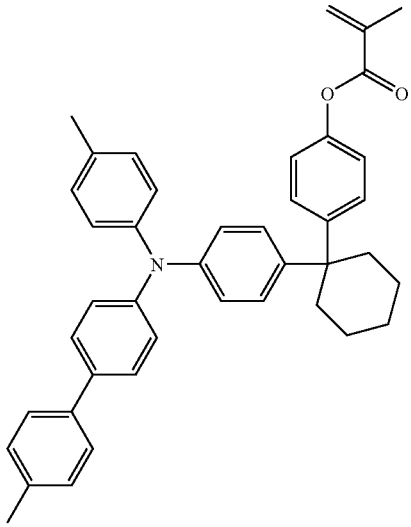
NO. 93
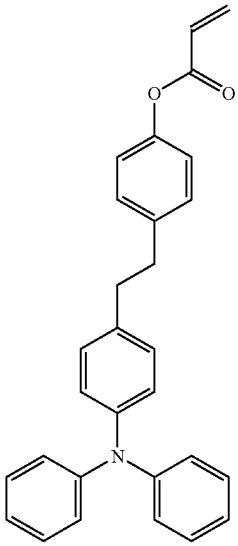
TABLE 1-5-continued
NO. 94
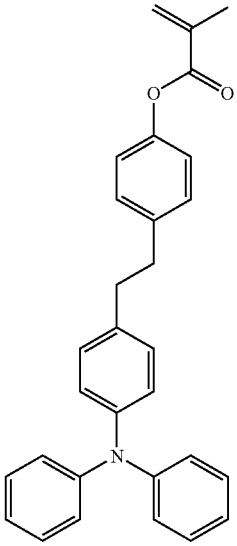
NO. 95
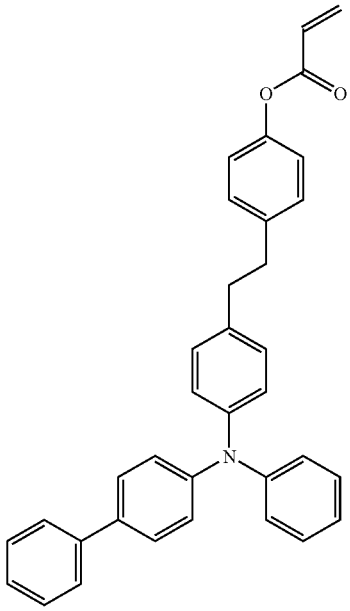

TABLE 1-5-continued
NO. 96
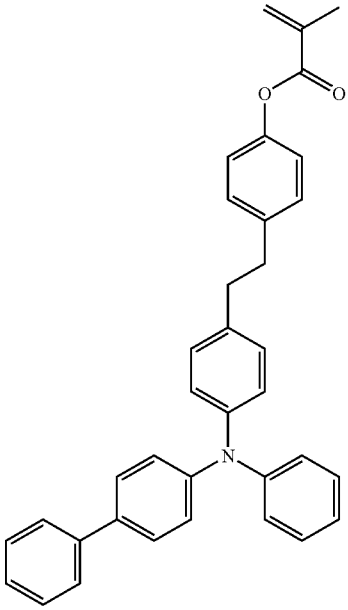
NO. 97
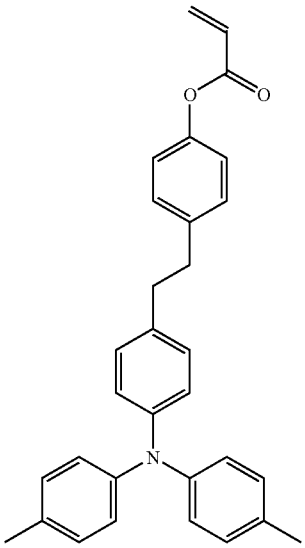
TABLE 1-6
NO. 98
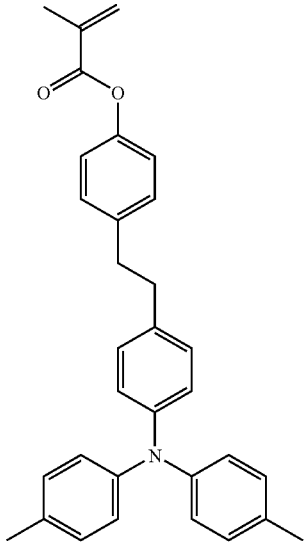
NO. 99
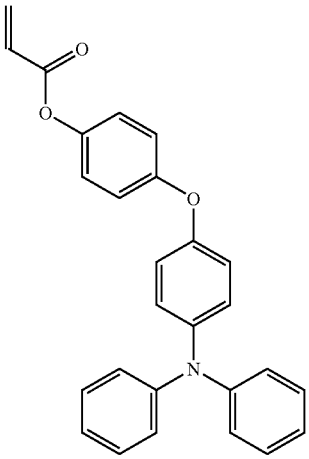
NO. 100
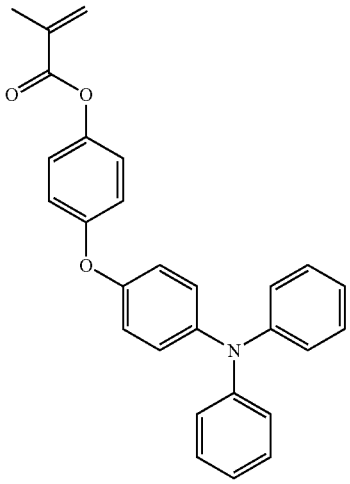

TABLE 1-6-continued
NO. 101
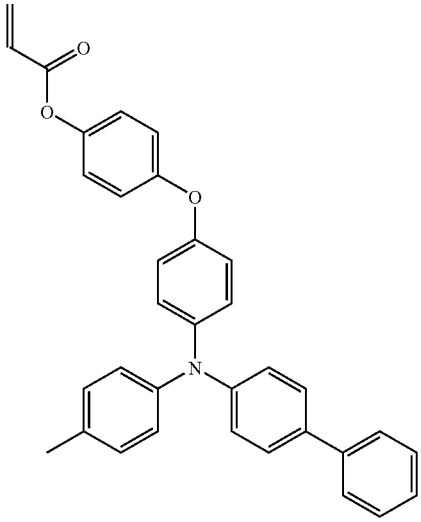
NO. 102
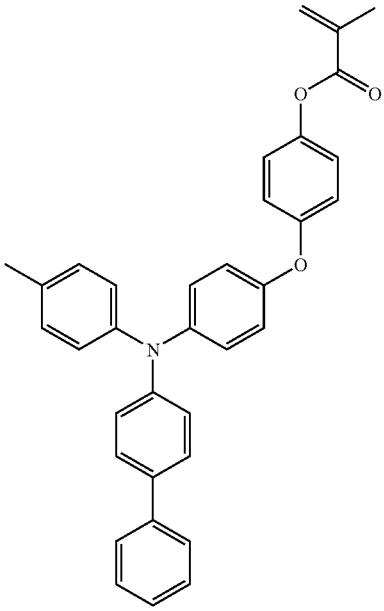
TABLE 1-6-continued
NO. 103
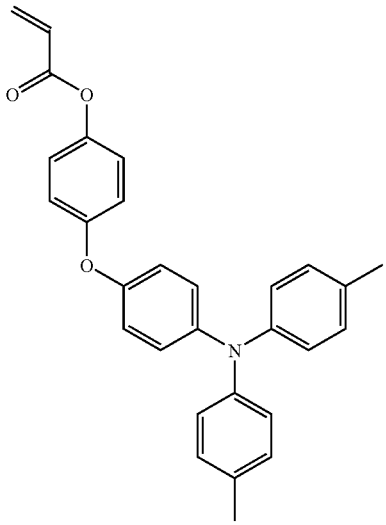
NO. 104
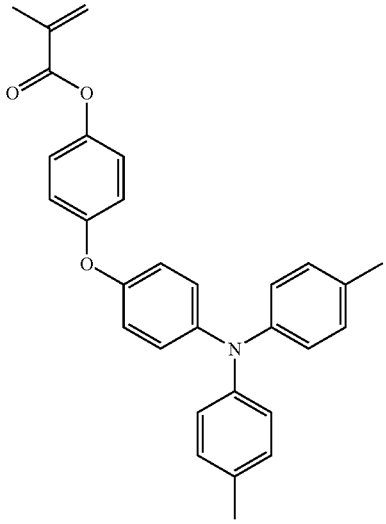
NO. 105
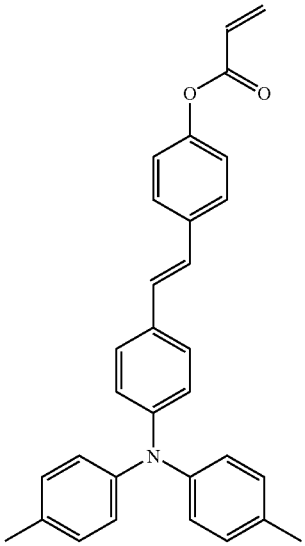

TABLE 1-6-continued
NO. 106
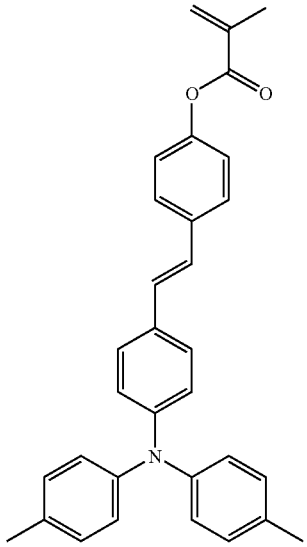
NO. 107
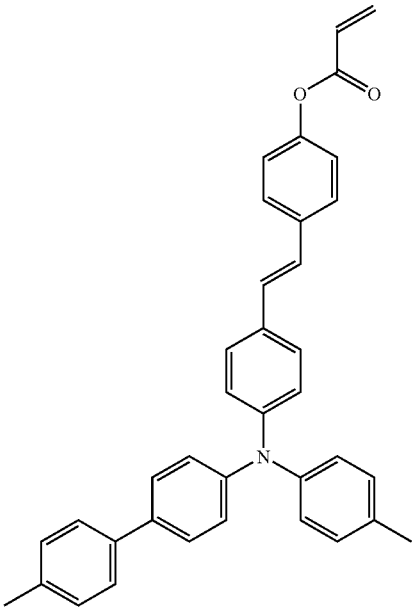
TABLE 1-6-continued
NO. 108
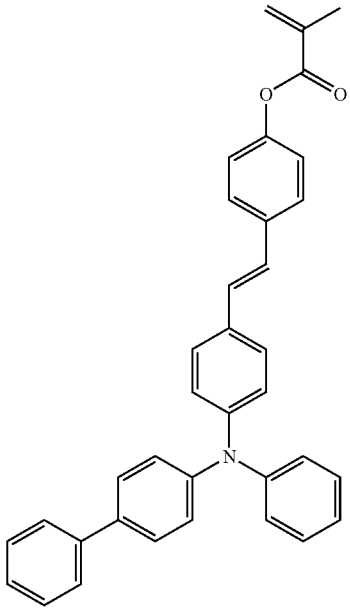
NO. 109
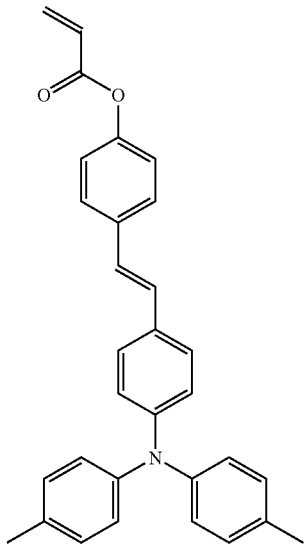

TABLE 1-7
NO. 110
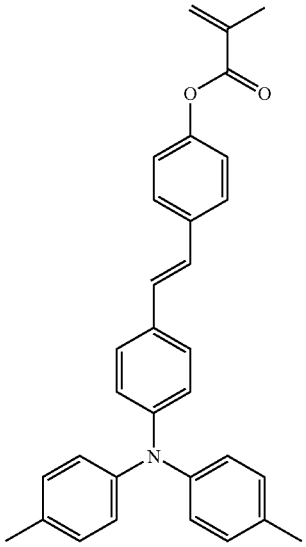
NO. 111
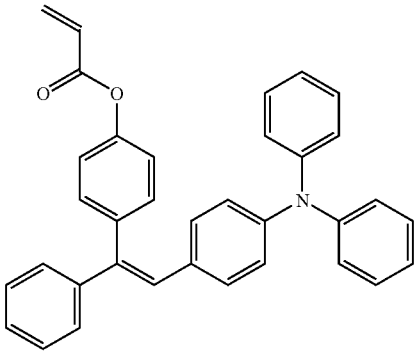
NO. 112
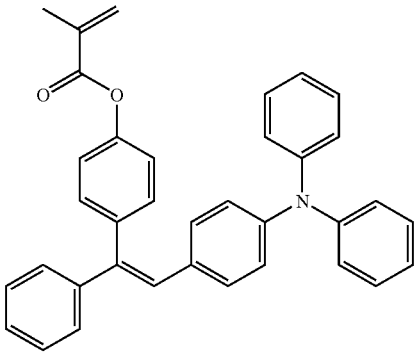
TABLE 1-7-continued
NO. 113
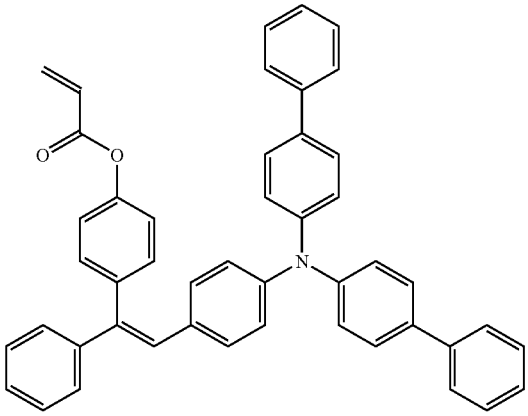
NO. 114
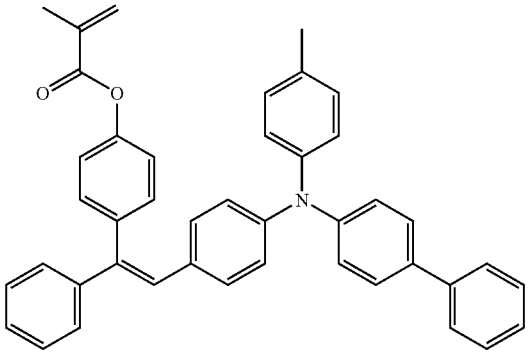
NO. 115
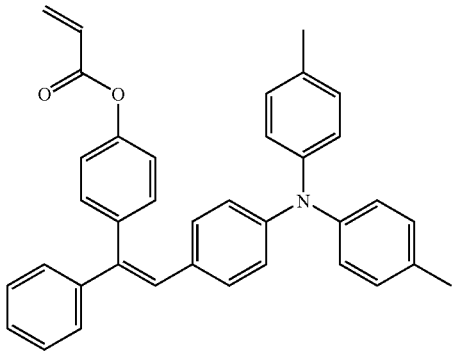
NO. 116
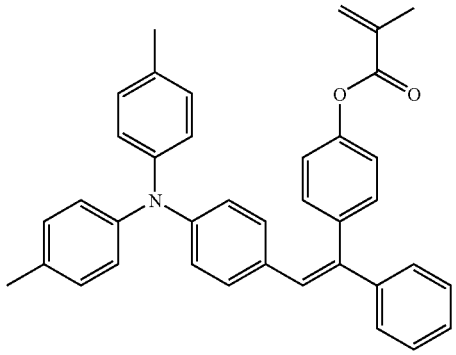

TABLE 1-7-continued
NO. 117
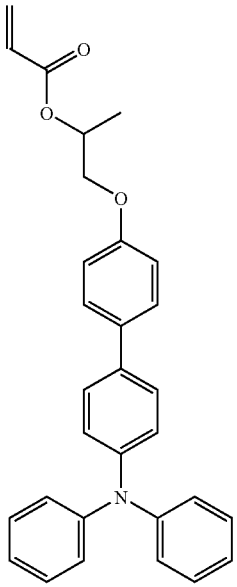
NO. 118
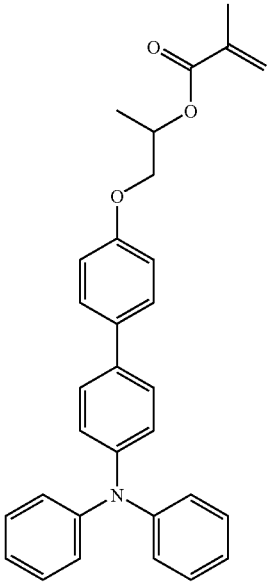
TABLE 1-7-continued
NO. 119
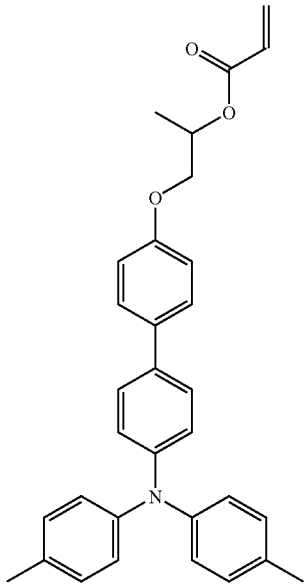
NO. 120
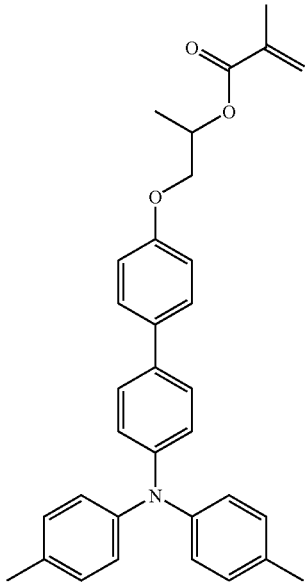

TABLE 1-7-continued
NO. 121
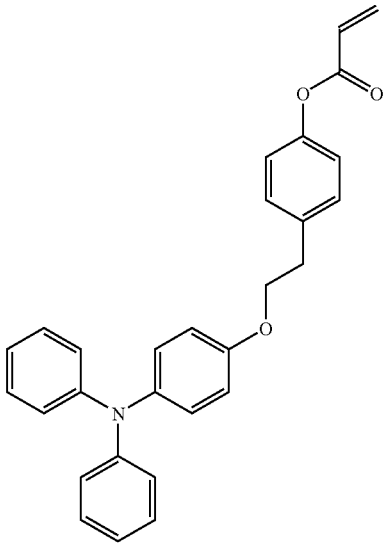
TABLE 1-8
NO. 122
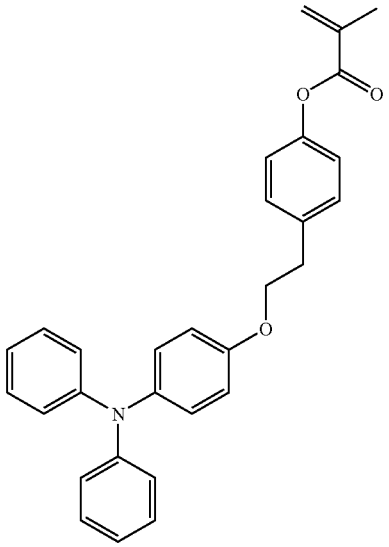
TABLE 1-8-continued
NO. 123
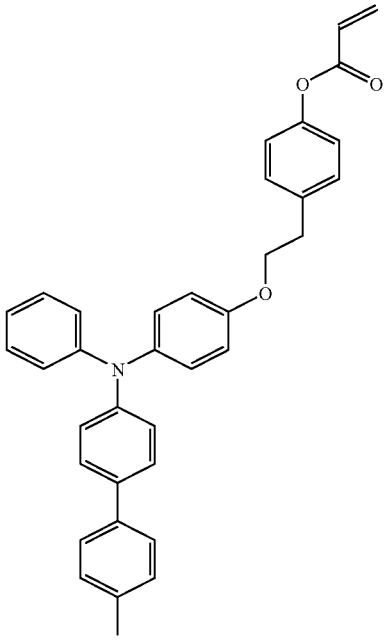
NO. 124
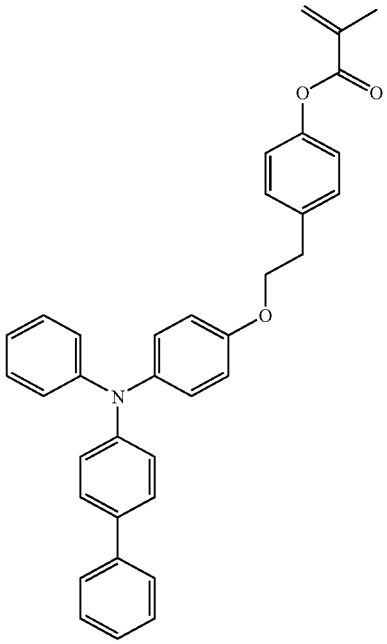

TABLE 1-8-continued
NO. 125
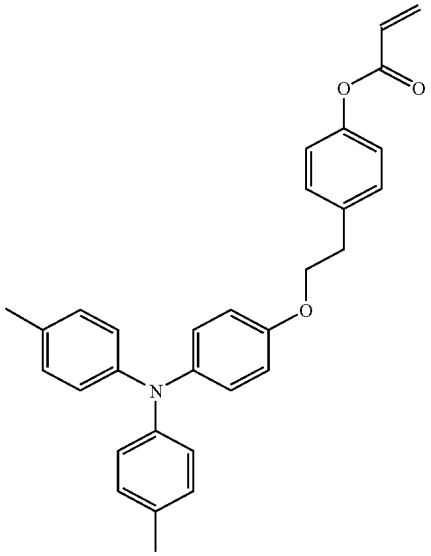
NO. 126
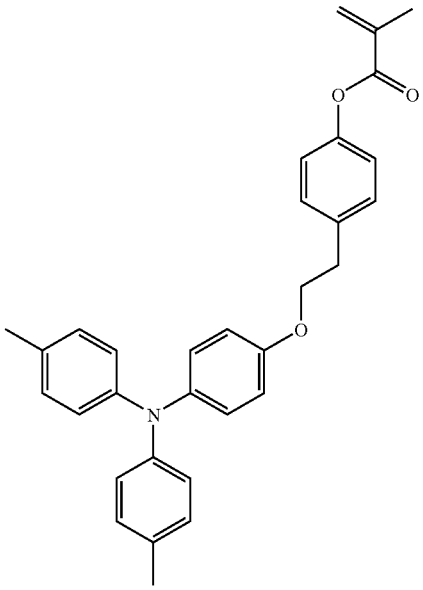
NO. 127
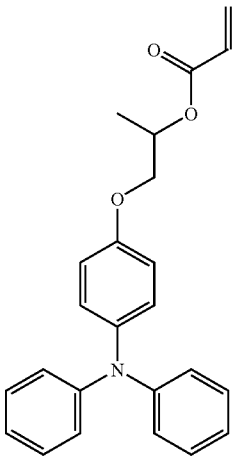
TABLE 1-8-continued
NO. 128
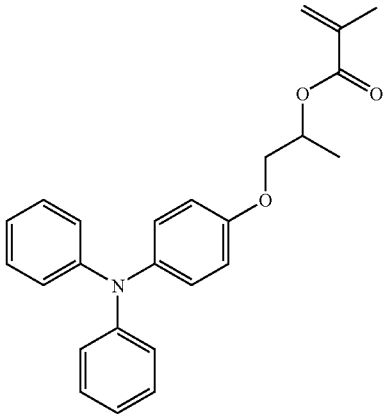
NO. 129
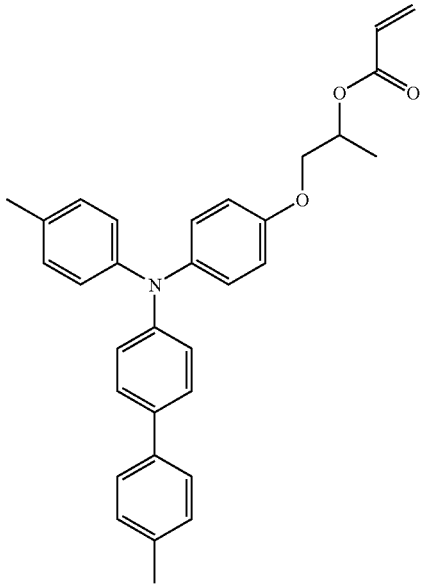

TABLE 1-8-continued
NO. 130
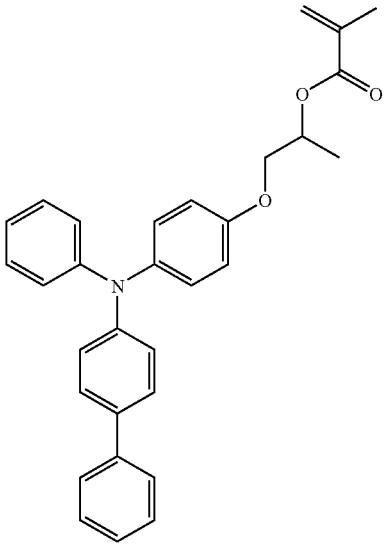
NO. 131
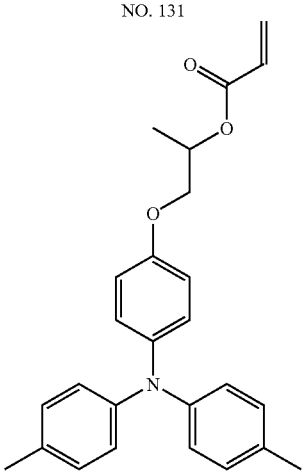
TABLE 1-8-continued
NO. 132
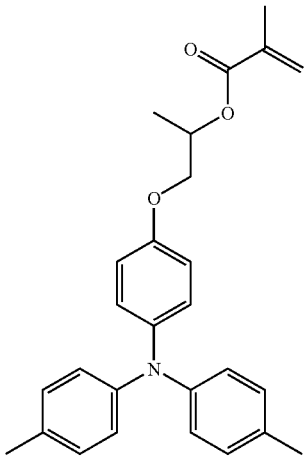
NO. 133
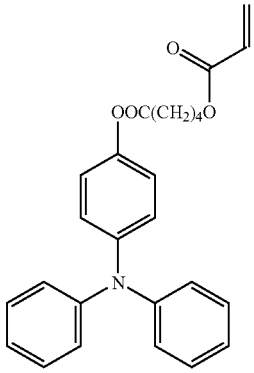
TABLE 1-9
NO. 134
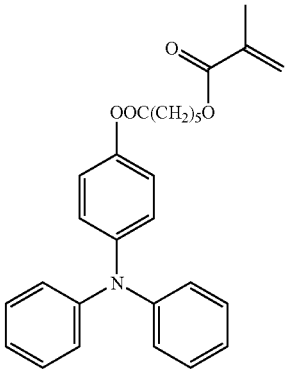
NO. 135
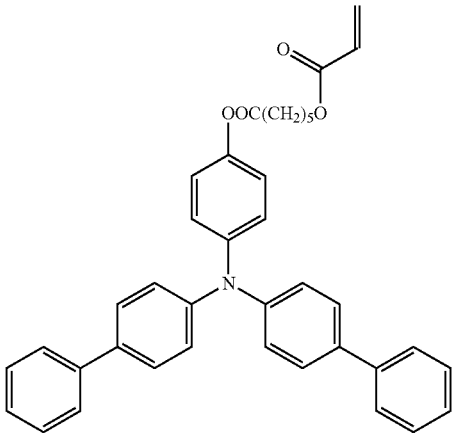

TABLE 1-9-continued
NO. 136
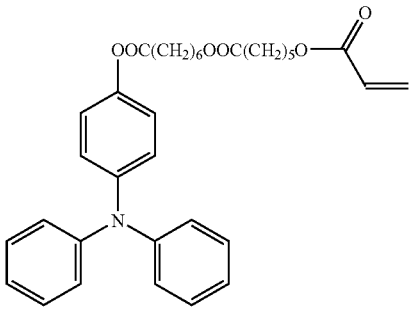
NO. 137
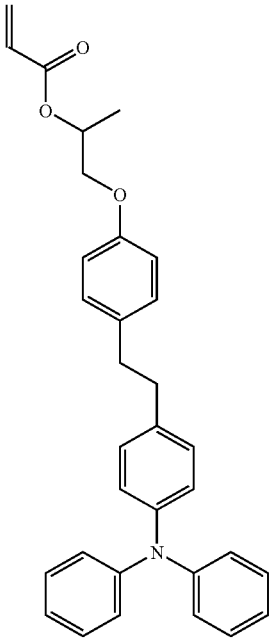
NO. 138
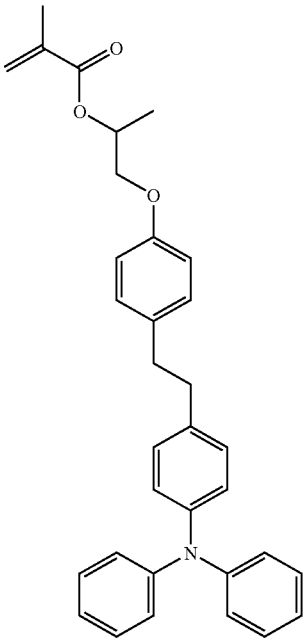
NO. 139
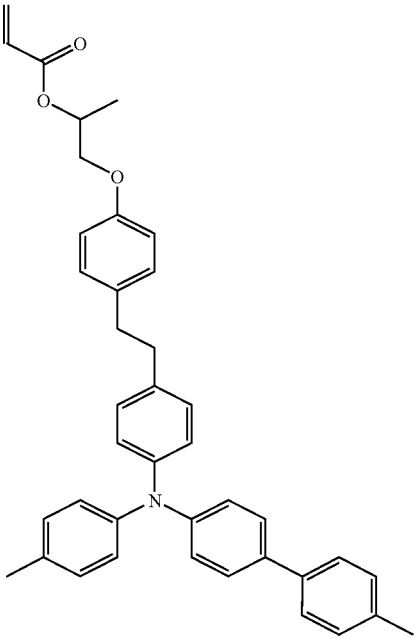

TABLE 1-9-continued
NO. 140
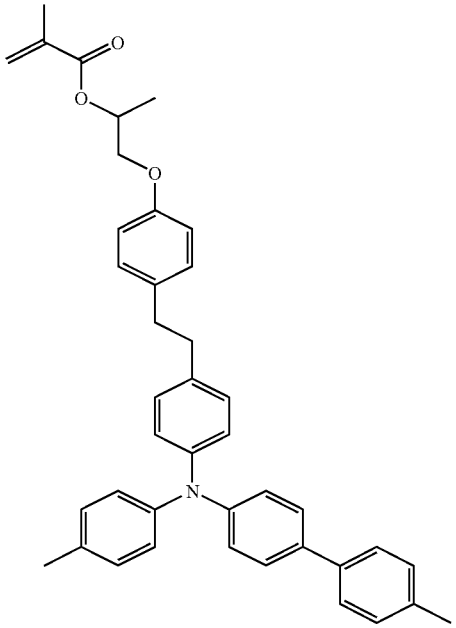
NO. 141
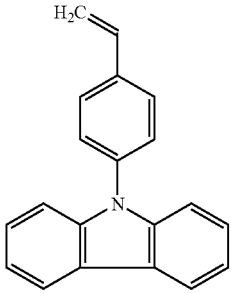
NO. 142
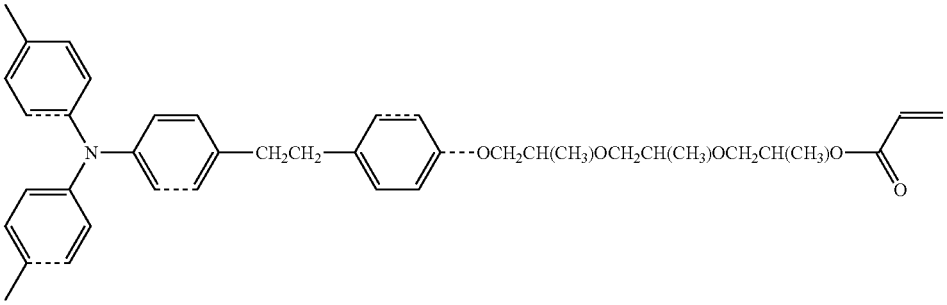
NO. 143
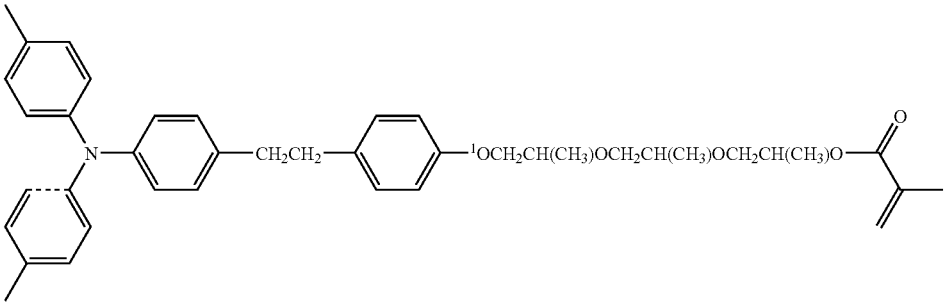
NO. 144
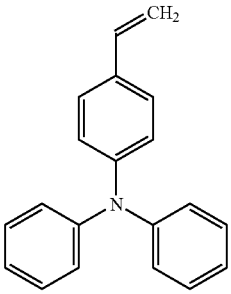
NO. 145
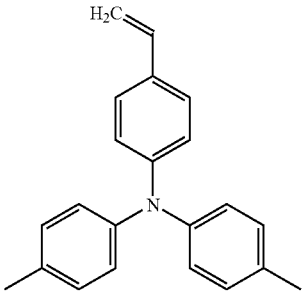

TABLE 1-9-continued
NO. 146
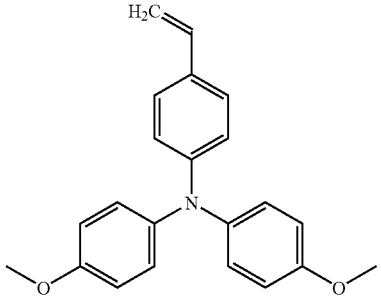
NO. 147
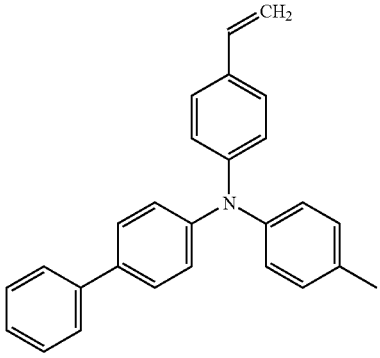
TABLE 1-10
NO. 148
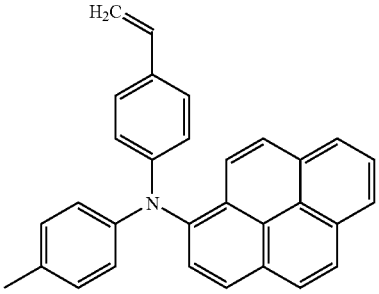
NO. 149
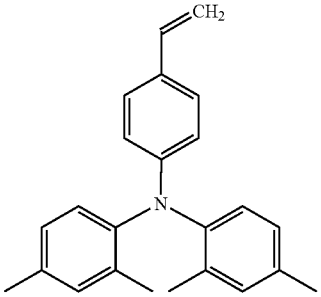
NO. 150
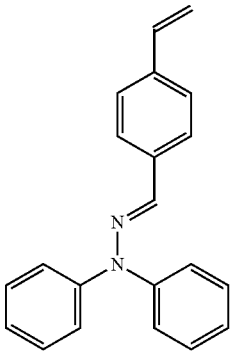
TABLE 1-10-continued
NO. 151
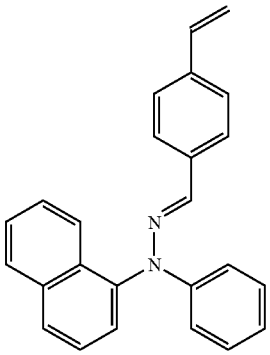
NO. 152
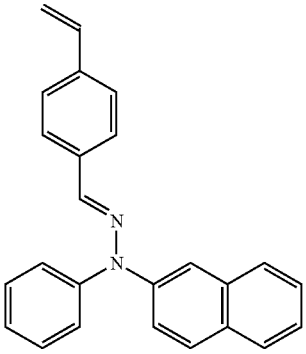
NO. 153
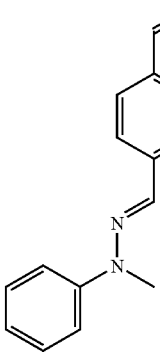

TABLE 1-10-continued
NO. 154
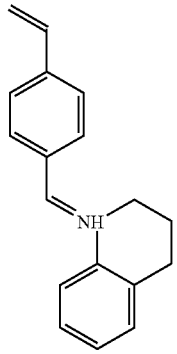
NO. 155
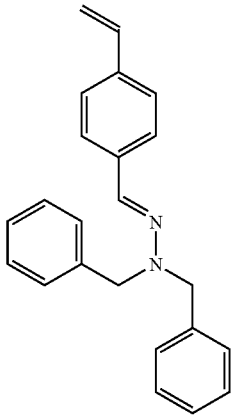
NO. 156
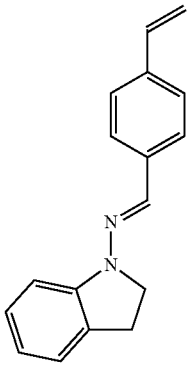
NO. 157
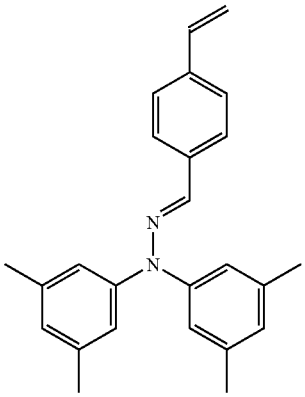
TABLE 1-10-continued
NO. 158
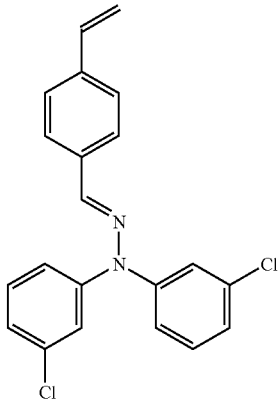
NO. 159
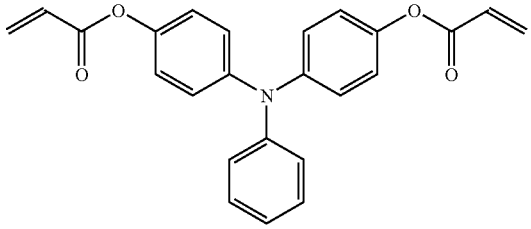
NO. 160
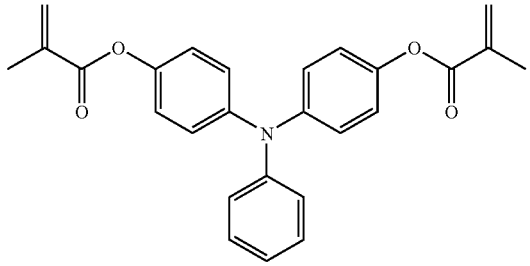
NO. 161
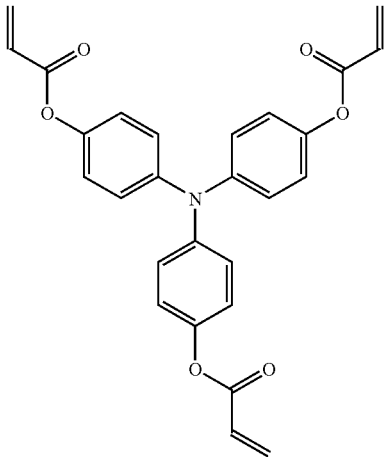

TABLE 1-10-continued
NO. 162
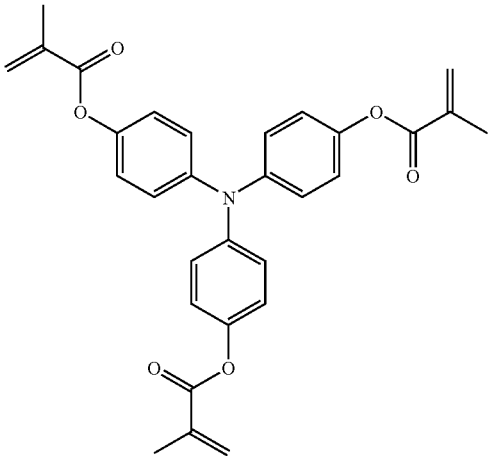
NO. 163
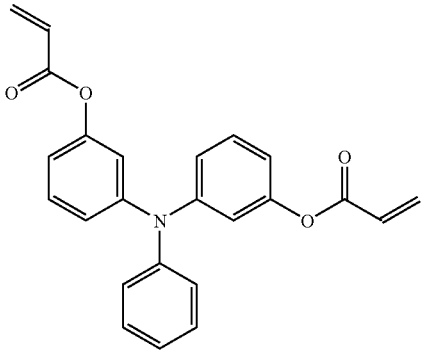
NO. 164
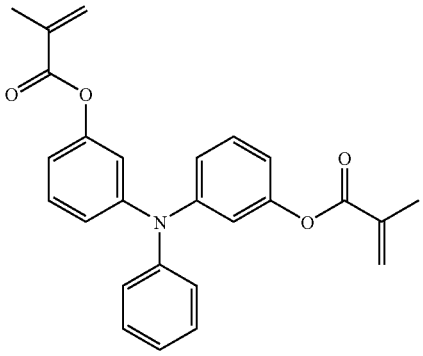
TABLE 1-10-continued
NO. 165
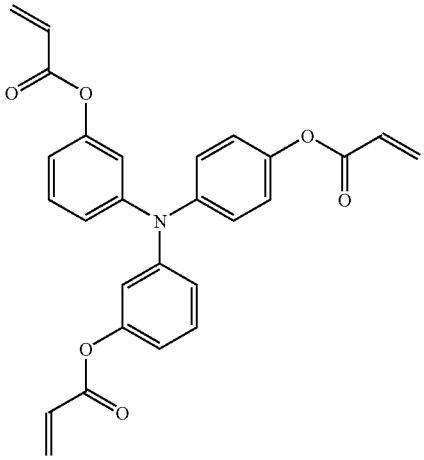
NO. 166
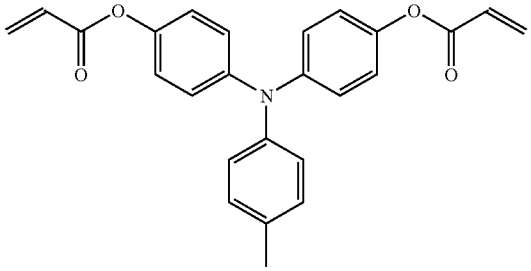
NO. 167
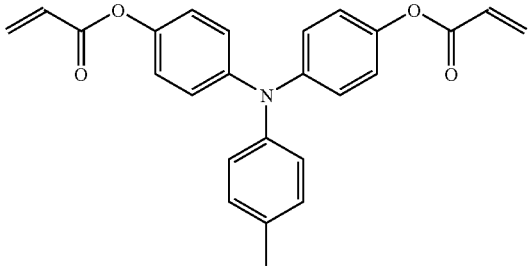
TABLE 1-11
NO. 168
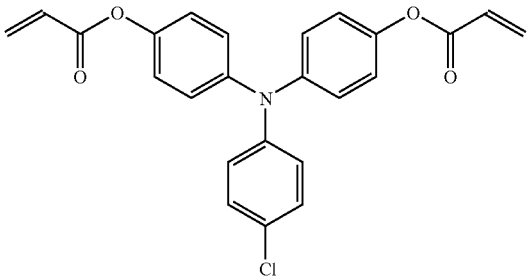

TABLE 1-11-continued
NO. 169
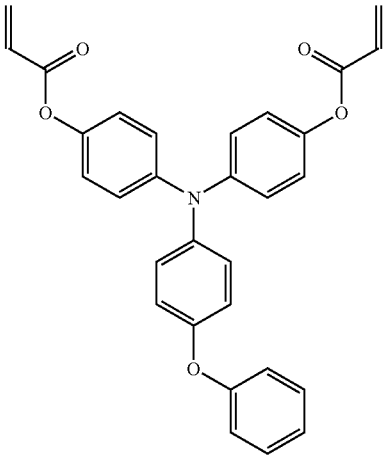
NO. 170
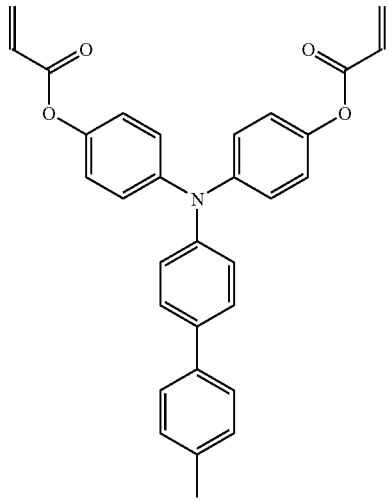
NO. 171
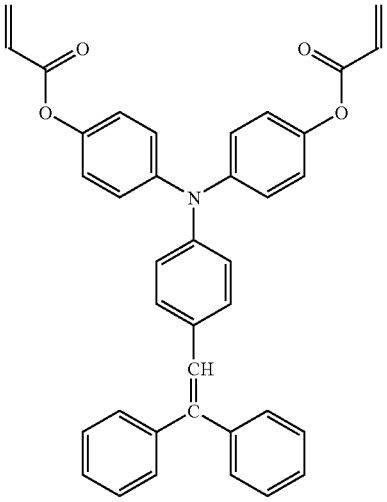
NO. 172
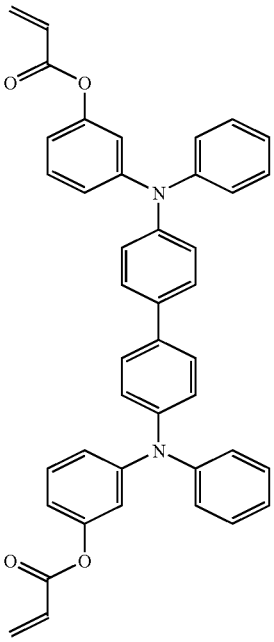
NO. 173
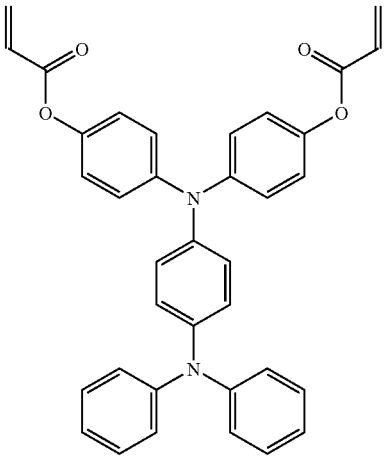

TABLE 1-11-continued
NO. 174
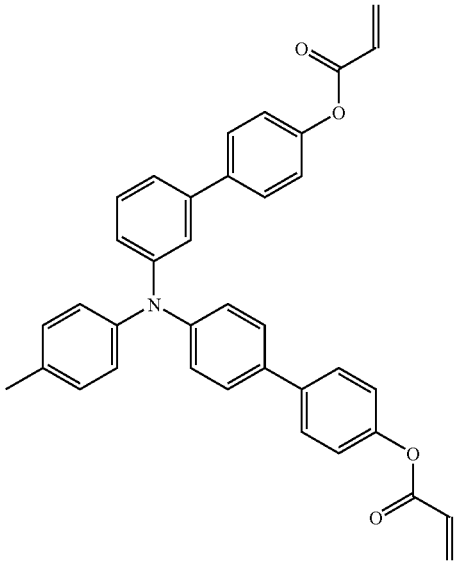
NO. 175
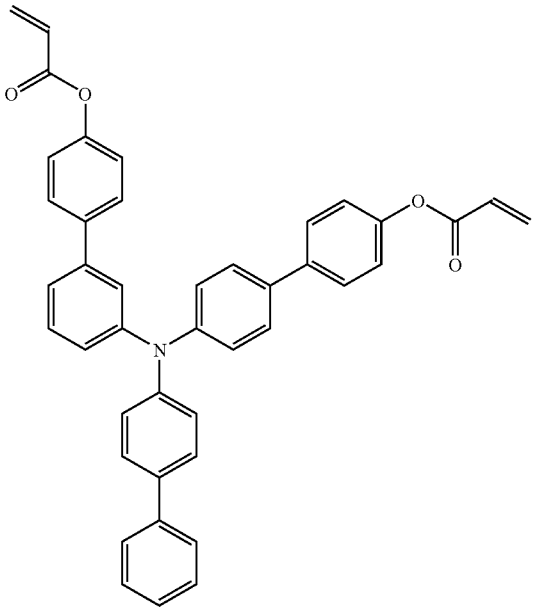
NO. 176
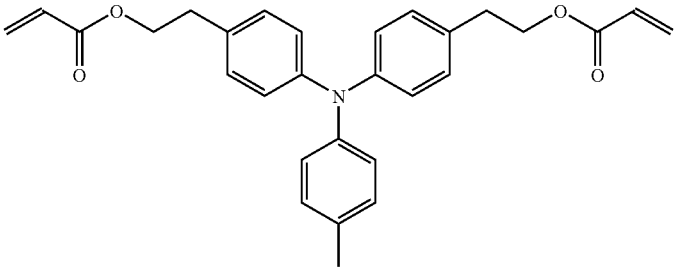

TABLE 1-12
NO. 177
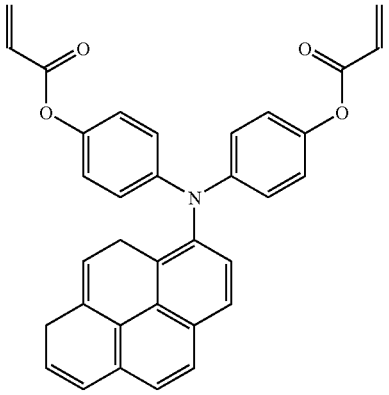
NO. 178
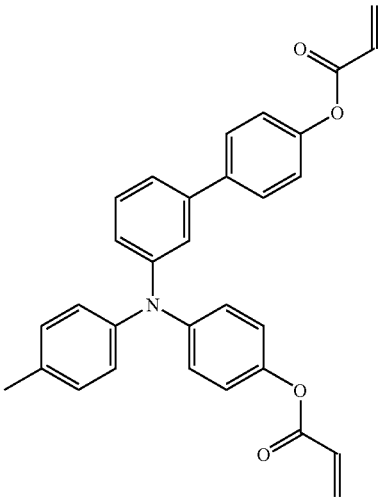
NO. 179
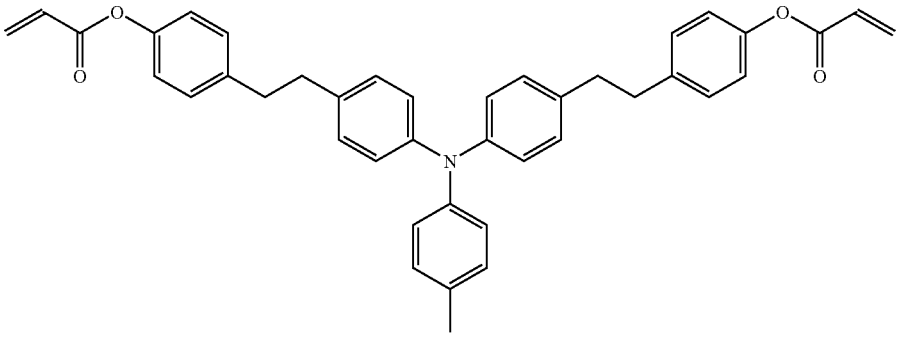
NO. 180
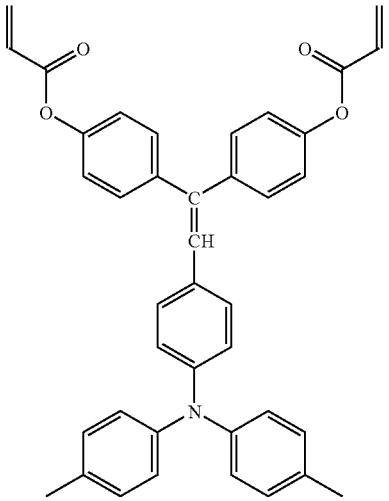
NO. 181
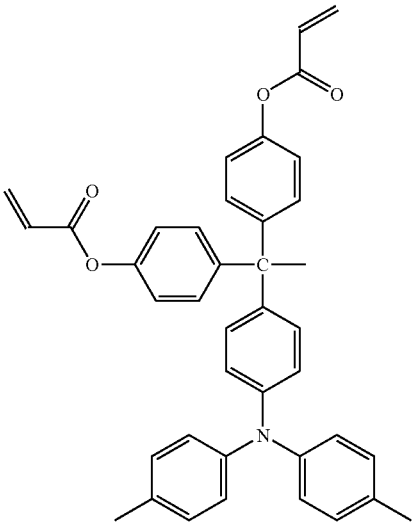

TABLE 1-12-continued
NO. 182
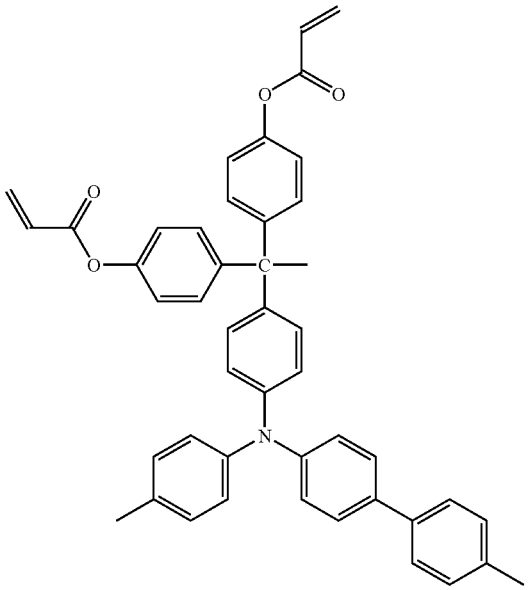
NO. 183
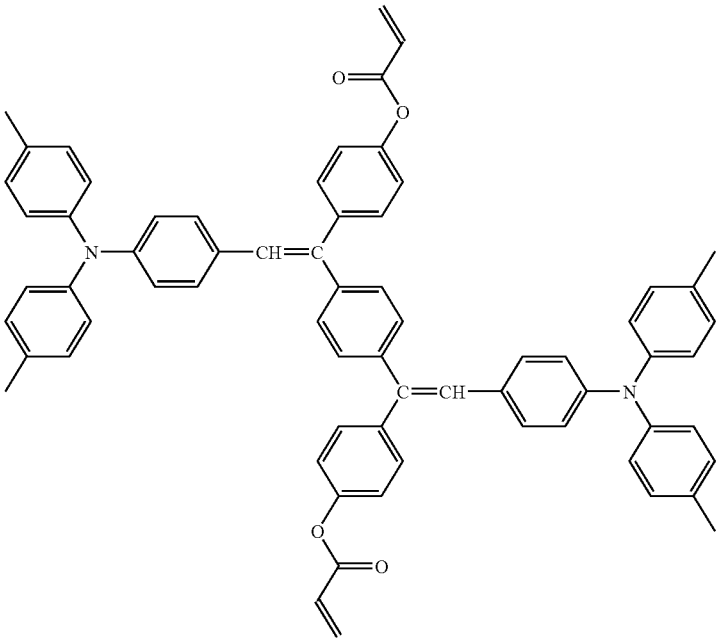
NO. 184
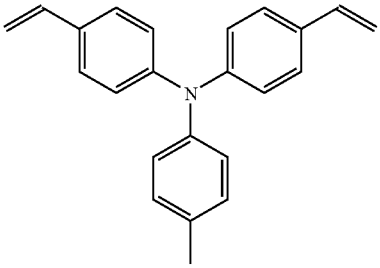
NO. 185
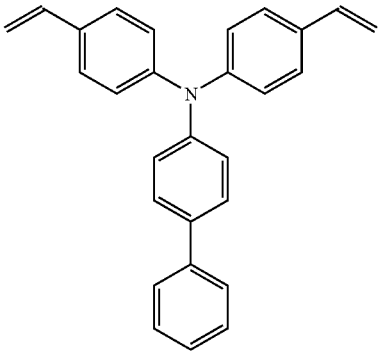

<Examples of Synthesizing Method for Monofunctional Radically Polymerizable Compound 1 with Charge Transport Structure>

Examples of the synthesizing method for the compound having a charge transport structure according to the present invention include a method disclosed in JP-B No. 3164426. An example thereof is shown as follows. The method for Example includes the following two steps (1) and (2).

(1) Synthesis of Hydroxy Group-Substituted Triarylamine Compound (Represented by the Following Formula (B'))

To 240 ml of sulfolane was added 113.85 g of a methoxy group-substituted triarylamine (represented by the following Formula (A')) and 138 g (0.92 mol) of sodium iodide, and the resultant mixture was heated at 60° C. in a nitrogen gas stream. To the mixture, 99 g (0.91 mol) of trimethylchlorosilane was added dropwise over 1 h and the mixture was stirred at about 60° C. for 4.5 h, thereby completing the reaction. The reaction mixture was mixed with about 1.5 L of toluene and the resultant solution was cooled to room temperature, followed by washing the solution repeatedly with water and an aqueous solution of sodium carbonate. Thereafter, from the toluene solution, the solvent was distilled off and the resultant residue was purified by column chromatography (adsorption medium: silica gel, developing solvent: mixture of toluene and ethyl acetate in a mixing ratio (toluene:ethyl acetate) of 20:1), thereby obtaining an oily substance. The obtained light-yellow oily substance was mixed with cyclohexane and crystals were precipitated, thereby obtaining 88.1 g (yield=80.4%) of white crystals of a compound represented by the following Formula (B'). The compound has the melting point of 64.0° C. to 66.0° C.

TABLE 2

| | C | H | N |
|---|---|---|---|
| Observed Value | 85.06% | 6.41% | 3.73% |
| Calculated Value | 85.44% | 6.34% | 3.83% |

Each value of the Table 2 represents an elemental analysis value in percentile.

(A')

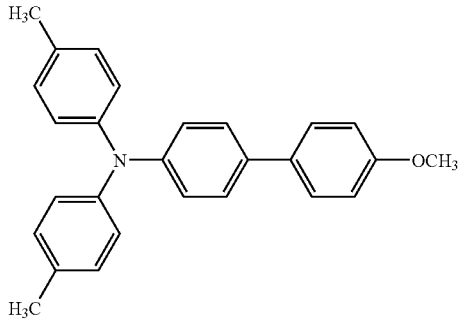

-continued (B')

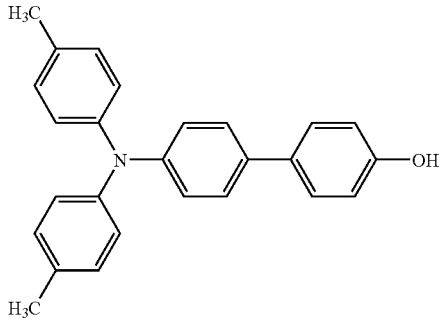

(2) Triarylamino Group-Substituted Acrylate Compound (Example Compound No. 1 in Table 1-1)

In 400 ml of tetrahydrofuran was dissolved 82.9 g (0.227 mol) of a hydroxyl group-substituted triarylamine compound (represented by Formula (B')) obtained in (1), and to the resultant solution, an aqueous solution of sodium hydroxide (prepared by dissolving 12.4 g of sodium hydroxide in 100 ml of water) was added dropwise in a nitrogen gas stream. The resultant solution was cooled to 5° C. and to the solution, 25.2 g (0.272 mol) of acrylic acid chloride was added dropwise over 40 min, followed by stirring at 5° C. for 3 hr, thereby completing the reaction. The reaction product solution was mixed with water and the resultant mixture was extracted with toluene. The extract was washed repeatedly with an aqueous solution of sodium bicarbonate and water. Thereafter, from the toluene solution, the solvent was distilled off and the resultant residue was purified by a column chromatography (adsorption medium: silica gel, developing solvent: toluene), thereby obtaining an oily substance. The obtained colorless oily substance was mixed with n-hexane and crystals were precipitated, thereby obtaining 80.73 g (yield=84.8%) of white crystals of the compound No. 1 in Table 1-1. The compound has the melting point of 117.5° C. to 119.0° C.

TABLE 3

| | C | H | N |
|---|---|---|---|
| Observed Value | 85.06% | 6.41% | 3.73% |
| Calculated Value | 85.44% | 6.34% | 3.83% |

Each value of the Table 3 represents an elemental analysis value in percentile.

(3) Synthesis example of acrylic acid ester compound

Preparation of 2-hydroxybenzylphosphonatediethyl

To a reaction vessel equipped with an agitation device, a thermometer and a dripping funnel was added 38.4 g of 2-hydroxybenzylalcohol (by Tokyo Chemical Industry Co., Ltd.) and 80 ml of o-xylene and 62.8 g of triethyl phosphate (by Tokyo Chemical Industry Co., Ltd.) was slowly added dropwise at 80° C. in a nitrogen gas stream for 1 hr reaction at the same. Thereafter, the produced ethanol, o-xylene solvent, and unreacted triethyl phosphate were removed by reduced-pressure distillation, thereby obtaining 66 g of 2-hydroxybenzylphosphonatediethyl (boiling point=120.0° C./1.5 mmHg) (yield=90%).

Preparation of 2-hydroxy-4'-(N,N-bis(4-methylphenyl)amino) stilbene)

To a reaction vessel equipped with an agitation device, a thermometer and a dripping funnel was added 14.8 g of potassium tert-butoxide and 50 ml of tetrahydrofuran, and an aqueous solution of tetrahydrofuran in which 9.90 g of 2-hydroxybenzylphosphonic acid diethyl and 5.44 g of 4-(N,N-bis(4-methylphenyl)amino) benzaldehyde were dissolved was slowly added dropwise to the reaction vessel at room temperature in a nitrogen gas stream, followed by 2 hr reaction at the same temperature. The resultant solution was cooled, added with water, and added with 2N hydrochloric acid solution for acidification. Thereafter, tetrahydrofuran was removed by an evaporator, and the crude product was extracted with toluene. The toluene phase was sequentially washed with water, sodium hydrogen carbonate solution and saturated saline, and dehydrated by the addition of magnesium sulfate. After filtration, toluene was removed to obtain an oily crude product. Then the oily crude product was purified by column chromatography on silica gel, crystallized in hexane, thereby obtaining 5.09 g of 2-hydroxy-4'-(N,N-bis (4-methylphenyl)amino)stilbene (yield=72%, melting point=136.0° C. to 138.0° C.).

Preparation of
4'-(N,N-bis(4-methylphenyl)amino)stilbene
2-ylacrylate)

To a reaction vessel equipped with an agitation device, a thermometer and a dripping funnel was added 14.9 g of 2-hydroxy-4'-(N,N-bis(4-methylphenyl)amino)stilbene, 100 ml of tetrahydrofuran and 21.5 g of 12% sodium hydroxide solution, and to the resulting solution, 5.17 g of acrylic chloride was added dropwise at 5° C. over 30 min in a nitrogen gas stream, followed by reaction for 3 hr at the same temperature. The reaction solution was immersed in water, was subject to toluene extraction, and then purified by column chromatography on silica gel. The obtained crude product was re-crystallized with ethanol, thereby obtaining 13.5 g of yellow colored, needle-shape crystal 4'-(N,N-bis(4-methylphenyl) amino)stilbene2-ylacrylate (Example compound No. 34) (yield=79.8%, melting point=104.1° C. to 105.2° C.).

Results of element analysis are as follows:

TABLE 4

| | C | H | N |
|---|---|---|---|
| Observed Value | 83.46% | 6.06% | 3.18% |
| Calculated Value | 83.57% | 6.11% | 3.14% |

Each value of the Table 4 represents an elemental analysis value in percentile.

From the above, by reacting 2-hydroxybenzylphosphonate ester derivatives and various amino-substituted benzaldehyde derivatives, many 2-hydroxystilbene derivatives can be synthesized, and by acrylation or methacrylation of these, various acrylic acid ester compounds can be synthesized.

In the electrophotographic photoconductor of the present invention, using a radically polymerizable compound with charge transport structure and the radically polymerizable compound with no charge transport structure is preferable. The radically polymerizable compound with charge transport structure employed in the present invention is essential for providing a cross-linked surface layer with charge transport ability. The content of radically polymerizable compounds is preferably 20% by mass to 80% by mass, more preferably 30% by mass to 70% by mass, based on the total mass of a cross-linked surface layer. When the content is below 20% by mass, charge transport property of a cross-linked surface layer may not be sufficiently maintained, and causes deterioration of electric property such as sensitivity reduction and residual potential increase under repeated usages. When the content of radically polymerizable compounds having single functionality is more than 80% by mass, the content of radically polymerizable monomers having three or more functionalities may become inevitably deficient, reducing the cross-link density and causing insufficient wear resistance. Although required electric property and wear resistance differ depending on the processes, and there is no specific mass percentage, the content of radically polymerizable compounds is particularly preferably 30% by mass to 70% by mass when the balance of two properties is considered.

Example of the radically polymerizable compound with no charge transport structure includes a radically polymerizable compound with charge transport structure having a radically polymerizable functional group. As the radically polymerizable functional group, acryloyloxy group, and methacryloyloxy group are preferable. From the viewpoint of the improvement of wear resistance, radically polymerizable monomers having three or more of radically polymerizable functional groups of acryloyloxy group, or methacryloyloxy group suit in use.

A compound having three or more acryloyloxy groups can be obtained by ester reaction or ester exchange reaction using a compound having three or more hydroxyl groups within a molecule for instance, and acrylic acidate, acrylic halide, and acrylic ester. A compound having three or more methacryloyloxy groups can be obtained likewise. A radically polymerizable functional group in monomer having three or more a radically polymerizable functional groups may be identical or different.

Specific examples of radically polymerizable monomers having three or more functionalities with no charge transport structure are not limited, and are properly selected according to the application but include trimethylol propane triacrylate (TMPTA), trimethylol propane trimethacrylate, HPA-modified-trimethylol propane triacrylate, EO-modified-trimethylol propane triacrylate, PO-modified-trimethylol propane triacrylate, caprolactone-modified-trimethylol propane triacrylate, HPA-modified-trimethylol propane trimethacrylate, pentaerythrytoltriacrylate, pentaerythrytoltetracrylate (PETTA), glyceroltriacrylate, ECH-modified-glyceroltriacrylate, EO-modified-glyceroltriacrylate, PO-modified-glyceroltriacrylate, tris(acryloxyethyl)isocyanurate, dipentaerythrytolhexaacrylate (DPHA), caprolactone-modified-dipentaerythrytolhexaacrylate, dipentaerythrytolhydroxypentacrylate, alkyl-modified-dipentaerythrytolpentacrylate, alkyl-modified-dipentaerythrytoltetracrylate, alkyl-modified-dipentaerythrytoltriacrylate, dimethylolpropanetetracrylate (DTMPTA), pentaerythrytolethoxytetracrylate, EO-modified-phosphatetriacrylate, 2,2,5,5-tetrahydroxymethylcyclopentanonetetracrylate. These radically polymerizable monomers may be used alone or in combination.

As the radically polymerizable monomer having three or more functionalities with no charge transport structure, to form densely spaced cross-linking bonds in the cross-linked layer, the ratio of molecular weight to the number of functional groups in the monomer (molecular weight/number of functional group) is preferably 250 or less. If this ratio exceeds 250, a cross-linked surface layer becomes soft and wear resistance drops to some extents. Thus, using an extremely long group alone is not preferable in a monomer having modified group such as HPA, EO, and PO of the exemplified monomer.

The content of the radically polymerizable monomer having three or more functional groups with no charge transport structure, which is used for the cross-linked layer, 20% by mass to 80% by mass is preferable relative to the total amount of the cross-linked layer, 30% by mass to 70% by mass is more preferable. If the content of the monomer is below 20% by mass, a three-dimensional cross-linking bond density of the cross-linked layer becomes small, and compared to the case of using a traditional thermoplastic binder resin, significant improvement of wear resistance is not achieved. If the content of the monomer is above 80% by mass, the content of a charge transport compound is reduced and deterioration of electric property may occur. There is no specific answer because wear resistance and electric property required for used process are different, but considering the balance of both properties, range of 30% by mass to 70% by mass is particularly preferable.

The cross-linked layer is formed by light-curing at least a radically polymerizable compound. Furthermore, radically polymerizable monomers, functional monomers, and radically polymerizable oligomers having one or two functionalities may be used simultaneously for viscosity control during coating, stress relief of a cross-linked surface layer, surface energy degradation, and friction coefficient reduction. Known monomers and oligomers can be used.

Examples of radical monomers having single functionality include 2-ethylhexyl acrylate, 2-hydroxyethyl acrylate, 2-hydroxypropyl acrylate, tetrahydrofurfuryl acrylate, 2-ethylhexylcarbitol acrylate, 3-methoxybutyl acrylate, benzyl acrylate, cyclohexyl acrylate, isoamyl acrylate, isobutyl acrylate, methoxytriethylene glycol acrylate, phenoxytetraethyleneglycol acrylate, cetyl acrylate, isotearyl acrylate, stearyl acrylate, styrene monomer.

Examples of chain polymerizable monomers having two functionalities include 1,3-butanediol diacrylate, 1,4-butanediol diacrylate, 1,4-butanediol dimethacrylate, 1,6-hexanediol diacrylate, 1,6-hexanediol dimethacrylate, diethylene glycol diacrylate, neopentylglycol diacrylate, EO-modified bisphenol B diacrylate, EO-modified bisphenol F diacrylate, neopentylglycoldiacrylate.

Examples of functional monomers include fluorinated monomers such as octafluoropentylacrylate, 2-perfluorooctylethyl acrylate, 2-perfluorooctylethyl methacrylate, 2-perfluoroisononylethyl acrylate,; vinyl monomers, acrylate and methacrylate having polysiloxane group such as acryloylpolydimethylsiloxaneethyl, methacryloylpolydimethylsiloxaneethyl, acryloylpolydimethylsiloxanepropyl, acryloylpolydimethylsiloxanebutyl, diacryloylpolydimethylsiloxanediethyl, which have 20 to 70 siloxane repeating units, as described in Japanese Patent Application Publication (JP-B) Nos. 05-60503 and 06-45770.

Examples of chain polymerizable oligomers include epoxy acrylates, urethane acrylates, and polyester acrylate oligomers. However, if the large content of monofunctional and bifunctional radically polymerizable monomer and radically polymerizable oligomer are contained, a three-dimensional cross-linking bond density of a cross-linked surface layer degrades substantially, resulting wear resistance degradation. For this reason, the content of these monomers or oligomers is preferably 50 parts by mass or less and more preferably 30 parts by mass or less relative to 100 parts by mass of radically polymerizable monomers having three or more functionalities.

The cross-linked layer is formed by light-curing of at least a radically polymerizable compound; however, a polymerization initiator may be used to progress this cross-linking reaction efficiently as necessary. The polymerization initiator may be any of heat polymerization initiators and photopolymerization initiators.

Examples of the thermal polymerization initiator include peroxides such as 2,5-dimethyl hexane-2,5-dihydro peroxide, dicumyl peroxide, benzoyl peroxide, t-butylcumyl peroxide, 2,5-dimethyl-2,5-di(peroxybenzoyl)hexane-3, di-t-butyl beroxide, t-butyl hydroberoxide, cumene hydroberoxide, lauroyl peroxide, etc. and azo compounds such as azobis isobutylnitrile, azobiscyclohexane carbonitrile, azobisisobutyricmethyl, azobisisobutylamidin hydrochloride, 4,4-azobis-4-cyanovaleric acid.

Examples of the photopolymerizable initiators are not limited, and can be properly selected according to the application, but include acetophenone photopolymerizable initiators, ketal photopolymerizable initiators, benzoinether photopolymerizable initiators, benzophenone photopolymerizable initiators, thioxanthone photopolymerizable initiators, and other photopolymerizable initiators. These may be used alone or in combination.

Examples of acetophenone, ketal photopolymerization initiators include diethoxyacetophenone, 2,2-dimethoxy-1,2-diphenylethan-1-one, 1-hydroxy-cyclohexyl-phenyl-ketone, 4-(2-hydroxyethoxy)phenyl-(2-hydroxy-2-propyl)ketone, 2-benzyl-2-dimethylamino 1-(4-morpholinophenyl)butanone-1,2-hydroxy-2-methyl-1-phenylpropane-1-one, 2-methyl-2-morpholino(4-methylthiophenyl)propane-1-one, and 1-phenyl-1,2-propanedione-2-(o-ethoxycarbonyl) oxime.

Examples of benzoinether photopolymerization initiators include benzoin, benzoinmethyl ether, benzomethylether, benzoinisobutylether, and benzoinisopropyl ether.

Examples of benzophenone photopolymerization initiators include benzophenone, 4-hydroxybenzophenone, methyl o-benzylbenzoate, 2-benzoylnaphthalene, 4-benzylbiphenyl, 4-benzoylphenylether, acrylated benzophenone, and 1,4-benzoylbenzene.

Examples of thioxanthone photopolymerization initiators include such as 2-isopropylthioxanthone, 2-chlorothioxanthone, 2,4-dimethylthioxanthone, 2,4-diethylthioxanthone, and 2,4-dichlorothioxanthone.

Examples of other photopolymerization initiators include ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide, bis(2,4-dimethoxybenzoyl)-2,4,4-trimethylpentylphosphine oxide, methylphenylglyoxyester, 9,10-phenanthrene compounds, acridine compounds, triazine compounds, imidazole compounds.

Besides, compounds that have photopolymerization promoting effect can be employed alone or together with the photopolymerization initiators described above; examples of photopolymerization promoters include triethanolamine, methyldiethanolamine, ethyl 4-dimethylaminobenzoate, isoamyl 4-dimethylaminobenzoate, (2-dimethylamino)ethylbenzoate, 4,4'-dimethylaminobenzophenone.

The content of the polymerization initiator is preferably 0.5 parts by mass to 40 parts by mass; more preferably 1 part by mass to 20 parts by mass per 100 parts by mass of the total amount of the entire radically polymerizable compounds.

The coating solution for a cross-linked surface layer of the present invention may contain various additives such as plasticizers for the purpose of relieving stress and improving adhesion, leveling agents, non-reactive low-molecular charge transport materials, as necessary. Known coating solution may be used. Plasticizers usable in the present invention include those commonly used for conventional resins such as dibutylphthalate, dioctylphthalate. The added amount is preferably 20% by mass or less, more preferably 10% by mass or less based on the total solid content of coating solution.

Examples of leveling agents include silicone oils such as dimethyl silicone oil, methylphenyl silicone oil, and polymers or oligomers having perfluoroalkyl group in the side chain. The added amount of leveling agent is preferably 3% by mass or less.

(Method for Producing an Electrophotographic Photoconductor)

The method for producing an electrophotographic photoconductor of the present invention is the method to produce the electrophotographic photoconductor of the present invention, and at least contains a cross-linked layer forming step in which at least a radically polymerizable compound is cured by irradiation with light, further contains additional step(s) as necessary.

<Cross-Linked Layer Forming Step>

The cross-linked layer forming step is to cure a radically polymerizable compound by irradiation with light to form a cross-linked layer.

In the cross-linked layer forming step, a cross-linked layer is formed by preparing a coating solution containing at least a radically polymerizable compound, applying the coating solution over the surface of the photoconductor, and by irradiating the coating solution with light for polymerization.

The coating solution may be diluted with solvent as necessary before being applied. For the solvent, those with a saturated vapor pressure of 100 mmHg/25° C. or less are preferable in view of improving the adhesiveness of the cross-linked layer. By using such a solvent, the amount of desolvation is reduced at the time of forming a coated film of the cross-linked surface layer for an instance, thereby swelling or some degree of dissolution of a lower layer, a photosensitive layer surface, may occur, an area having continuousness in the interface neighborhood of a cross-linked surface layer and a photosensitive layer is formed presumptively. By forming these layers, an area involving rapid property change between a cross-linked surface layer and a photosensitive layer disappears, adhesiveness is retained more than satisfactory, and to maintain high durability over the total area of the cross-linked surface layer becomes possible.

In the present invention, due to the presence of small solvent in the coated film at the time of forming the coated film, radical reactions in the cross-linked layer was progressed by solvent. As a result, the electrophotographic photoconductor that became possible to improve even-curing over the entire cross-linked layer was attained. By diluting the coating solution with a solvent whose saturated vapor pressure is 100 mmHg/25° C. or less, it succeeded in obtaining an electrophotographic photoconductor having stable electric property for prolonged periods, wherein the internal stress of the inside cross-linked layer was not locally stored, even cross-linked layer with no strain could be formed, and the electrophotographic photoconductor maintained high durability over the total area of the cross-linked layer and generated no cracking by securing adhesiveness more than satisfactory.

The saturated vapor pressure of solvent is preferably 50 mmHg/25° C. or less, more preferably 20 mmHg/25° C. or less from the viewpoint of the residual solvent amount in the coated film at the time of forming a coated film. It is thought as similar saturated vapor pressure effect, but in case that the boiling point of solvent is 60° C. to 150° C., a continuous domain of a cross-linked surface layer and a lower layer, a photosensitive layer can be well formed, and adhesiveness can be sufficiently secured. Considered desolvation step like drying by heating, the boiling point of the solvent is more preferably 100° C. to 130° C. Of the solvent, the dissoluble parameter is preferably 8.5 to 11.0, more preferably 9.0 to 9.7. By this, affinity of polycarbonate that is the main constituent material of a lower layer, a photosensitive layer of a cross-linked surface layer for the coating solution becomes high, the compatibility of each constituent material with the other materials improves in the interface of the cross-linked surface layer and the photosensitive layer, and forming a cross-linked surface layer that can retain sufficient adhesiveness becomes possible.

Examples of the solvent include hydrocarbon solvents such as heptane, octane, trimethylpentane, isooctane, nonane, 2,2,5-trimethylhexane, decane, benzene, toluene, xylene, ethylbenzene, isopropylbenzene, styrene, cyclohexane, methylcyclohexane, ethylcyclohexane, cyclohexene, alcohol solvent such as methanol, ethanol, 1-propanol, 2-propanol, 1-butanol, 2-butanol, isobutyl alcohol, tert-butyl alcohol, 1-pentanol, 2-pentanol, 3-pentanol, 2-methyl-1-butanol, tert-pentyl alcohol, 3-methyl-1-butanol, 3-methyl-1-butanol, 3-methyl-2-butanol, neopentyl alcohol, 1-hexanol, 2-methyl-1-pentanol, 4-methyl-2-pentanol, 2-ethyl1-butanol, 3-heptanol, allylalcohol, propargylalcohol, benzylalcohol, cyclohexanol, 1,2-ethynodiol, 1,2-propanediol, phenol solvents such as phenol, creson, ester solvents such as dipropylether, diisopropylether, dibutylether, butylvinylether, benzylethylether, dioxane, anisole, phenetol 1,2-epoxybutane, acetal solvents such as acetal, 1,2-dimethoxyethane, 1,2-dimetoxyethane, ketone solvents such as methylethylketone, 2-pentanone, 2-hexanone, 2-heptanone, diisobutylketone, methyloxide, cyclohexanone, methylcyclohexanone, ethylcyclohexanone, 4-methyl-2-pentanone, acetylacetone, acetonylacetone, esther solvents such as ethyl acetate, propyl acetate, butyl acetate, penpyl acetate, 3-methoxybutylacetate, diethyl carbonate, 2-methoxyethylacetate, halogen solvents such as chlorobenzene, sulfuric compound solvents such as tetrahydrothiophene, solvents having multi functional group such as 2-methoxyethanol, 2-ethoxyethanol, 2-butoxyethanol, furfurylalcohol, tetrahydrolfurfurylalcohol, 1-methoxy-2-propanol, 1-ethoxy-2-propanol, diacetonealcohol, furfural, 2-methoxyethylacetate, 2-ethoxyethylacetate, propylene glycol propylether, propylene glycol-1-monomethylether-2-acetate. These solvents may be used alone or in combination. Of these solvents, butyl acetate, chlorobenzene, acetylacetone, xylene, 2-methoxyethyl acetate, propylene glycol-1-monomethylether2-acetate, cyclohexanone are particularly preferable from the viewpoint of adhesiveness.

The dilution ratio of coating solution depends on the solubility of the cross-linked layer, the coating method, desired film thickness, and may be properly selected according to the application, but the solid concentration of the coating solution is preferably 25% by mass or less, more preferably 3% by mass to 15% by mass from the perspective of giving sufficient adhesiveness to the cross-linked layer while maintaining residual solvent volume on the coated film at the time of forming the coated film.

Coating methods of the coating solution are not limited, can be properly selected according to the application. Examples of coating method include dipping, spray coating, bead coating, ring coating. Of these, spray coating that can adjust the proper amount of residual solvent in coated film over coating is particularly preferable.

After the coating solution for a cross-linked surface layer is applied, it is cured by exposure to external energy to form a cross-linked surface layer. In order to attain an uniformed cross-linked layer of which the difference between maximum value and minimum value of the post-exposure electrical potential is within 30V when writing is conducted under the condition that the image static power is 0.53 mW and the exposure energy is 4.0 erg/cm$^2$, the difference of maximum and minimum surface temperature of photoconductor under light exposure should be within 30° C., is preferable within 20° C., is more preferable within 10° C.

Besides, in order to promote a polymerization reaction promptly, the surface temperature of the photoconductor at the time of exposing is preferably 20° C. to 170° C., more preferably 30° C. to 130° C. Furthermore, in order to promote polymerization reaction more efficiently, an increase by 10° C. or more in the surface temperature of the photoconductor in 30 sec after exposure initiation is important. As long as the surface temperature of photoconductor can be maintained within the range, any method may be applicable, but method for controlling temperature using a heating medium is preferable. That is, in case that the photoconductor has drum-shaped hollow support; there is a method for enclosing a heating medium inside of the drum-shaped hollow support and circulating the heating medium. Instead of the drum-shaped, an endless belt type hollow support may also be used. In this case, controlling the temperature of the heating medium in order to control the surface temperature of the photoconductor is preferable. Although any method may be used to achieve the desired temperature, the method for controlling the temperature outside the hollow is preferable to the method for controlling temperature inside the hollow for easy-to-use. Various methods for spreading a heating medium inside the hollow can be used, but the method for providing multiple inlets through which the heating medium enters to the inside of the hollow and a method having a mechanism or member of agitating a heating medium inside the hollow can be used effectively. A known mechanism of circulating a heating medium can be used, but for easy-to-use, existing pumps can be used for easy-to-use. Specific examples of the existing pumps include centrifugal pumps, propeller pumps, viscosity pumps of non positive displacement, reciprocating pumps, rotary pumps of positive displacement, and jet pumps, bubble pumps, water-hammer pumps, submersible pumps, vertical pumps for others. For circulating a constant amount of a heating medium, non positive-displacement pumps of a constant delivery can be used effectively.

If the flow rate is too small, this may cause temperature variations along the length of the electrophotographic photoconductor. In contrasts, if the flow rate is too large, curing may become insufficient because an increase amount of the photoconductor surface temperature becomes small but from the viewpoint of the volume of the space in the support, the range of 0.1 L/min to 200 L/min is preferably selected. As the circulation direction of a heating medium, a backward current of the convention flow is preferable when the convection flow rate of a heating medium is considered.

Specifically, when a hollow photoconductor is placed vertically so that its length is parallel to the gravity acceleration (vertical arrangement) for exposure in view of the convenience of the formation of a photosensitive layer and transfer of the photoconductor, it is effective to allow a heating medium to circulate in a direction from top to bottom of the photoconductor from the viewpoint of its convection flow because temperature variations along the length of the photoconductor are minimized. A long exposure lamp is always parallel to the photoconductor, whether vertical arrangement or horizontal arrangement.

As the heating medium, media that are thermally-stable, have large heat capacity per unit volume, and have high thermal conductivity are preferably used, of which media that do not corrode apparatus, and have no irritant property are preferably. Examples of media used as a heating medium include gas state a heating medium such as air and nitrogen, organic a heating media such as diphenylether, terphenyl, and polyalkyleneglycol medium, liquid a heating media like water. An organic heating media and water of a liquid heating medium are preferable in light of ease-to-control of thermal conductivity and temperature, water is particularly preferable from the viewpoint of ease-to-use.

Furthermore, to attain the evenness in the photoconductor surface temperature and at the same time to retain temperature increase range from the initial exposure, a method for flowing heating medium directly inside a support, and a method for providing an elastic member inside the support and circulating the heating medium inside the elastic member are effective as well. By using the elastic member, adhesiveness with a support can be retained sufficiently, uniformity of the photoconductor surface temperature can be reached, and the temperature increase range of the photoconductor surface can be controlled by selecting thermal conductivity of the elastic member.

In view of the elasticity and durability of the elastic member, the tensile strength of the elastic member is preferably 10 kg/cm$^2$ to 400 kg/cm$^2$, more preferably 30 kg/cm$^2$ to 300 kg/cm$^2$. JIS-A hardness of the elastic member is preferably 10 to 100, more preferably 15 to 70. Moreover, from the viewpoint of temperature increase ratio, thermal conductivity of the elastic member is preferably 0.1 W/m·K to 10 W/m·K, more preferably 0.2 W/m·K to 5 W/m∩K.

The tensile strength of the elastic member and JIS-A hardness can be measured according to "vulcanized rubber physical testing method" of JIS K6301, "how to measure the tensile strength of vulcanized rubber and thermoplastic rubber" of JIS K6252, "how to measure hardness of vulcanized rubber and thermoplastic rubber" of JIS K6253, wherein the measurements were conducted under the environment that the temperature was 20° C. and relative humidity was 55%. The tensile strength can be obtained by producing a specimen of dumbbell-shaped type 4, measuring a specimen under 200 mm/min of tensile speed using TE-301 Shopper-type tensile testing device type III by TESTER SANGYO Co., Ltd., and dividing maximum load which is the value until the specimen was broken by the cross-section of the specimen.

JIA-A hardness is measured by producing samples of 12 mm or more of the thickness (samples of 12 mm or less of the thickness were laminated to be 12 mm or more of the thickness), and using Digital Rubber Hardness Meter Type DD2-JA by KOUBUNSHI KEIKI Co., Ltd. Various measuring methods may be used for the measurement of thermal conductivity, but examples include a laser flush method, a steady heat current method, plate heat flow meter method, heat wave method. Here, a sample which has a size of 100 mm×50 mm×30 mm is produced and the sample can be measured using quick thermal conductivity meter QTM-500 by KYOTO ELECTRONICS MANUFACTURING CO., LTD.

Examples of materials for the elastic member include rubber materials for general use such as natural rubber, silicone rubber, fluoro silicone rubber, ethylene propylene rubber, chloroprene rubber, nitrile rubber, hydronitrile rubber, butyl rubber, hypalon, acryl rubber, urethane rubber, fluoro rubber, thermal conductivity sheet having high thermal conductivity, and thermal conductivity film. Instead of the elastic member, filter material that can adjust the amount of a heating medium of support neighborhood inside the support can be used effectively. Specifically, generally known filter sheets or sponge materials can be used effectively.

After application of the coating solution, a cross-linked layer is formed by giving it external light energy and by curing. A high pressure mercury lamp that has emission wavelength at UV radiation mainly, an UV light source like a methal halide lamp can be used as the light energy. Visible light sources can also be selected depending on the type of the radically polymerizable ingredient and/or on the absorption wavelength of the photopolymerizable initiator. Exposure dose is preferably 50 mW/cm$^2$ or more, more preferably 500 mW/cm$^2$ or more, most preferably 1,000 mW/cm$^2$ or more. By using exposure light which the irradiation light quantity is 1,000 mW/cm$^2$ or more, the progression ratio of polymerization reaction is significantly increased; thereby forming of a more uniform a cross-linked surface layer becomes possible. In order to reach an even polymerization reaction, and to form a homogeneous cross-linked surface layer, given that irradiance where irradiance over irradiated body is 100%, the irradiance range is at least 70% or more, preferably 80% or more, more preferably 90% or more. By doing so, the cross-linked layer of small irradiance unevenness having uniform property can be attained.

Other external energy such as light, heat, and radiation ray can also be used effectively. The method for adding heat energy is to heat from the coating surface side or the support side by using gas such as air, and nitrogen, steam, various types of heating media, infrared radiation, and electromagnetic wave. The heat temperature is preferably 100° C. or more, more preferably 170° C. or less. If the heat temperature is below 100° C., the reaction rates slow; thereby the reaction may fail to be completed. On the other hand, if the heat temperature is above 170° C., the reaction may progress unevenly and a large strain in the cross-linked layer may occur. For an even curing reaction, a method for heating at relative low temperature of below 100° C. and further heating with above 100° C. to complete the reaction is also effective. Examples of the radiation energy include the use of electron beam. Of these energies, the use of heat and light energy are effective from ease-to-control reaction speed, and ease-to-use of an apparatus, and light energy is effective from ease-to-handle, and property of obtained cross-linked surface layer.

Because the thickness of the cross-linked layer may differ depending on the layer structure of the photoconductor using the cross-linked layer, it is described according to the following explanation of the layer structure.

<Layer Structure of the Electrophotographic Photoconductor>

The electrophotographic photoconductor used in the present invention will be described with reference to the drawings.

Figure 2A:
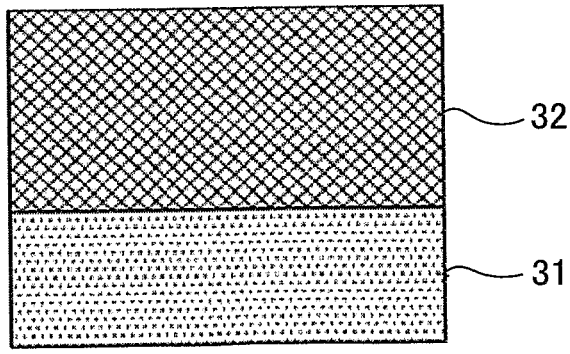
FIG. 2A is an exemplary schematic sectional view of the single-layer electrophotographic photoconductor of the present invention.
Figure 2B:
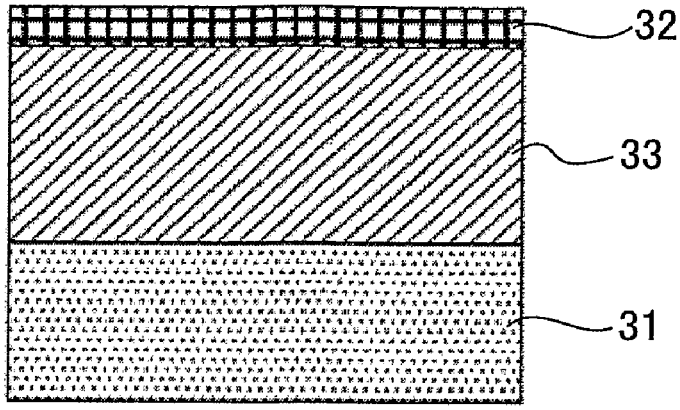
FIG. 2B is another exemplary schematic sectional view of the single-layer electrophotographic photoconductor of the present invention.

FIG. 2A and FIG. 2B are a cross-sectional view of the electrophotographic photoconductor of the present invention, showing a single-layer photoconductor in which a photosensitive layer 33 having both charge generating function and charge transport function simultaneously is formed over the support 31. FIG. 2A represents the case that a cross-linked layer (a cross-linked photosensitive layer 32) is an overall photosensitive layer. FIG. 2B represents the case that a cross-linked layer is the surface part (a cross-linked surface layer 32) of a photosensitive layer 33.

Figure 3A:
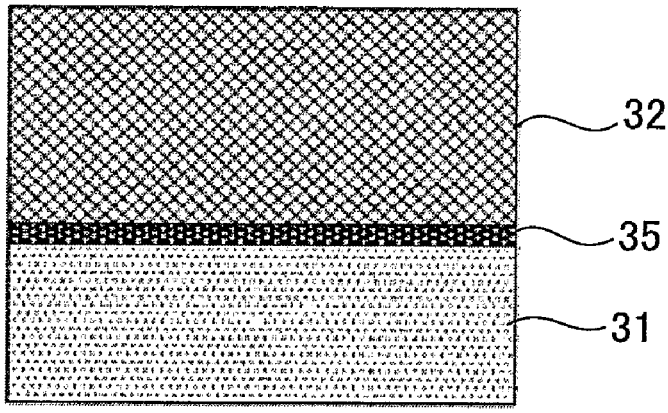
FIG. 3A is an exemplary schematic sectional view of the laminated electrophotographic photoconductor of the present invention.
Figure 3B:
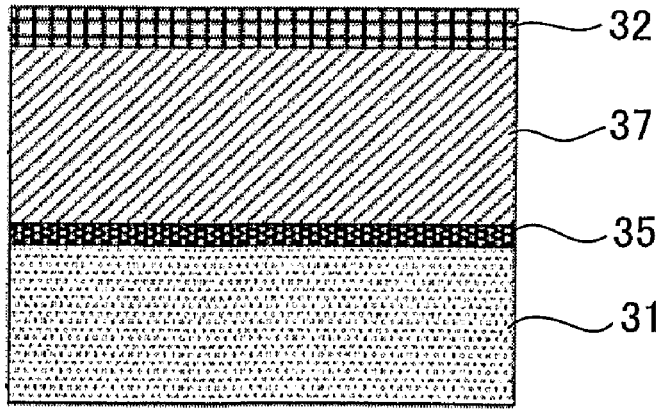
FIG. 3B is another exemplary schematic sectional view of the laminated electrophotographic photoconductor of the present invention.

FIG. 3A and FIG. 3B are laminate-structured photoconductors which are laminated by a charge generating layer 35 having charge generating function and a charge transport layer 37 having charge transport function over the support 31. FIG. 3A shows the case that a cross-linked layer (a cross-linked charge transport layer 32) is a total charge transport layer and FIG. 3B shows the case that a cross-linked layer (a cross-linked surface layer 32) is the surface part of a charge transport layer 37.

—Support—

The support is not particularly limited and can be properly selected according to the application and may be of any having electric conductivity of volume resistance, $10^{10}\Omega\cdot$cm or less. Examples of a support include film-shaped, cylindrically-shaped plastic or paper covered with metals such as aluminum, nickel, chromium, nichrome, copper, gold, silver, or platinum or metal oxides such as tin oxide or indium oxide by vapor deposition or sputtering. Or the support may be a plate of aluminum, aluminum alloy, nickel or stainless steel, or a plate formed into a tube by extrusion or drawing and surface-treating by cut, finish and polish, etc. The endless nickel belt and the endless stainless steel belt such as those disclosed in JP-A No. 52-36016 may also be employed as a support.

In addition to the support described above, those obtained by dispersing conductive powers in suitable binder resin and applying the binder resin over the support may be used as the support of the present invention.

Examples of conductive fine particles include metal powders such as carbon black, acetylene black, aluminum, nickel, iron, nichrome, copper, zinc and silver, and metal oxide fine particles such as of conductive tin oxide and ITO. Examples of simultaneous use binder resins include thermoplastic resins, thermosetting resins, or photocoagulating resins such as polystyrene, styrene acrylonitrile copolymer, styrene butadiene copolymer, styrene maleic anhydride copolymer, polyester, polyvinyl chloride, vinyl chloride-vinyl acetate copolymer, polyvinyl acetate, polyvinylidene chloride, polyacrylate resin, phenoxy resin, polycarbonate, cellulose acetate resin, ethyl-cellulose resin, polyvinyl butyral, polyvinyl formal, polyvinyl toluene, poly-N-vinylcarbazole, acrylate resin, silicone resin, epoxy resin, melamine resin, urethane resin, phenol resin, alkyd resin, etc.

The conductive layer can be prepared by dispersing these conductive fine particles and the binder resin into a suitable solvent, for example, tetrahydrofuran, dichloromethane, methyl ethyl ketone, toluene, etc and by applying this coating solution.

Furthermore, supports which are prepared by forming a conductive layer on a suitable cylindrical base with a thermal-contractive inner tube made of suitable materials such as polyvinyl chloride, polypropylene, polyester, polystyrene, polyvinylidene chloride, polyethylene, chlorinated rubber, Teflon™, etc. containing conductive fine particles may also be used as the conductive support in the present invention.

<Photosensitive Layer>

The photosensitive layer may be either a laminated structure or a singe layer structure. In case of the laminated structure, a photosensitive layer contains a charge generating layer and a charge transport layer having charge transport function. In case of the single-layer, a photosensitive layer is the layer that has charge generating function and charge transport function simultaneously.

The following are the description for the laminated structure photosensitive layer and the single-layer photosensitive layer.

<Photosensitive Layer in Laminated Structure>

The laminated photosensitive layer consists of a charge generating layer and a charge transport layer.

—Charge Generating Layer—

The charge generating layer is a layer which mainly contains a charge generating substance having charge generating function and may also contain a binder resin or other element(s) as necessary. The charge generating substances may be classified into inorganic materials and organic materials and both are suitable for use.

Examples of inorganic materials include crystalline selenium, amorphous selenium, selenium-tellurium, selenium-tellurium-halogen, selenium-arsenic compound, and amorphous silicon. The amorphous silicon may have dangling bonds terminated with hydrogen atom or a halogen atom, or it may be doped with boron or phosphorus.

The organic material may be selected from conventional materials, examples thereof include phthalocyanine pigments such as metal phthalocyanine, non-metal phthalocyanine, azulenium salt pigments, aquatic acid methine pigment, azo pigments having a carbazole skeleton, azo pigments having a triphenylamine skeleton, azo pigments having diphenylamine skeleton, azo pigments having dibenzothiophene skeleton, azo pigments having fluorenone skeleton, azo pigments having oxadiazole skeleton, azo pigments having bisstylbene skeleton, azo pigments having distyryl oxidiazole skeleton, azo pigments having distyrylcarbazole skeleton, perylene pigments, anthraquinone or polycyclic quinone pigments, quinone imine pigments, diphenylmethane or triphenylmethane pigments, benzoquinone or naphtoquinone pigments, cyanine or azomethine pigments, indigoido pigments, bisbenzimidazole pigments. These charge generating substances may be used alone or in combination.

Examples of binder resins which may be used in a charge generating layer as necessary include polyamides, polyurethanes, epoxy resins, polyketones, polycarbonates, silicone resins, acrylic resins, polyvinyl butyrals, polyvinyl formals, polyvinyl ketones, polystyrenes, poly-N-vinyl carbazoles, and polyacrylamides. These binder resins may be used alone or in combination.

As a binder resin for a charge generating layer, in addition to the binder resins listed above, polymer charge transport materials having charge transport function can be used such as polycarbonates having allylamine skeleton, benzidine skeleton, hydrazone skeleton, carbazolyl skeleton, stilbene skeleton, pyrazoline skeleton, high-polymer materials such as polyester, polyurethane, polyether, polysiloxane, acrylic resin, high-polymer materials having polysilane skeleton.

Specific examples of charge transport high polymer materials are disclosed in JP-A Nos. 01-001728, 01-009964, 01-013061, 01-019049, 01-241559, 04-011627, 04-175337, 04-183719, 04-225014, 04-230767, 04-320420, 05-232727, 05-310904, 06-234836, 06-234837, 06-234838, 06-234839, 06-234840, 06-234841, 06-239049, 06-236050, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084, 09-302085, 09-328539, etc.

Specific examples of high-molecular weight materials containing polysilane skeleton are polysilylene polymers disclosed in JP-A Nos. 63-285552, 05-19497, 05-70595 and 10-73944, etc.

Furthermore, low-molecular weight charge transport materials can be incorporated into charge generating layers. The charge transport materials can be classified into hole transport substances and electron transport substances.

Examples of an electron transport materials include electron-accepting substances such as chloroanil, bromoanil, tetracyanoethylene, tetracyano quinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indino[1,2-b]thiophene-4-on, 1,3,7-trinitrodibenzothiophene-5,5-dioxide, and diphenoquinone derivatives. These electron transport substances may be used alone or in combination.

Examples of hole transporting substances include oxazole derivatives, oxadiazole derivatives, imidazole derivatives, monoarylamine, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstylbene derivatives, enamine derivatives. These hole transporting substances may be used alone or in combination.

The method for forming a charge generating layer may be broadly classified into the following two methods: vacuum thin-film deposition, and casting method with solution dispersal.

The vacuum thin-film deposition includes vacuum evaporation, glow discharge electrolysis, ion plating, sputtering, reactive-sputtering, and CVD processes, which may form inorganic materials or organic materials satisfactory.

In order to form a charge generating layer by the casting method, the charge generating layer can be formed as follows: an inorganic or organic charge generating substance is dispersed in a solvent such as tetrahydrofuran, dioxane, dioxolane, toluene, dichloromethane, monochlorobenzene, dichloroethane, cyclohexanone, cyclopentanone, anisole, xylene, methyl ethyl ketone, acetone, ethyl acetate, or butyl acetate, together with binder resin as required, using a ball mill, ATTRITOR, sand mill, or bead mill using. The resultant dispersion liquid is then properly diluted and applied by coating. A leveling agent such as dimethyl silicone oil, methylphenyl silicone oil, or the like may be added to the dispersion liquid as required. The dispersion liquid may be applied by way of dip coating, spray coating, bead coating, ring coating.

The thickness of the charge generating layer is preferably 0.01 μm to 5 μm, more preferably 0.05 μm to 2 μm.

—Charge Transport Layer—

The charge transport layer is the layer which has a charge transport function and the cross-linked layer in the present invention may be used effectively as the charge transport layer. If the cross-linked layer is the overall charge transport layer, as described in the cross-linked layer manufacturing method, applying the coating solution containing radically polymerizable composition of the present invention (charge transport compound having the radically polymerizable compound with no charge transport structure and a radically polymerizable functional group; same as follows) over the charge generating layer, after drying as necessary, starting curing reaction by external energy, thereby forming the cross-linked charge transport layer. The thickness of the cross-linked charge transport layer is preferably 10 μm to 30 μm, more preferably 10 μm to 25 μm. If the thickness is below 10 μm, a sufficient charging potential may not be maintained. If the thickness exceeds 30 μm, peeling with lower layer may be prone to occur because of the volume constriction at the time of curing.

If the cross-linked layer is the cross-linked surface layer formed on the charge transport layer, the charge transport layer is formed by dissolving or dispersing charge transport materials having charge transport function and tying resin in a proper solvent, coating on the charge generating layer, followed by drying. The cross-linked surface layer is formed by applying the coating solution containing the radically polymerizable composition of the present invention on the charge transport layer, cross-linked curing by external energy.

As for the charge transport materials, the electron transport substances, hole transport substances, and charge transport polymers described above may be employed. Particularly, charge transport polymers are preferable because solubility of the undercoat layer may be suppressed upon coating of a cross-linked surface layer.

Examples of the binder resin include polystyrene, styrene-acrylonitrile copolymers, styrene-butadiene copolymers, styrene-maleic anhydride copolymers, polyester, polyvinyl chloride, vinylchloride-vinylacetate copolymers, polyvinyl acetate, polyvinylidene chloride, polyacrylate resins, phenoxy resins, polycarbonates, cellulose acetate resins, ethylcellulose resins, polyvinyl butyral, polyvinyl formal, polyvinyl toluene, poly-N-vinylcarbazole, acrylate resins, silicone resins, epoxy resins, melamine resins, urethane resins, phenol resins, alkyd resins. These can be used alone or in combination.

The amount of charge transport materials is preferably 20 parts by mass to 300 parts by mass, more preferably 40 parts by mass to 150 parts by mass per 100 parts by mass of the binder resin. When the charge transport material is a polymer, the charge transport materials may be employed without binder resin.

The solvent used in the coating solution of the charge transport layer may be the same as those used in the charge generating layer described above. Preferably, the solvent can dissolve well in both of charge transport materials and the binder resin. The solvent can be used alone or in combination. The same method as used for the charge generating layer may be applied for charge transport layer formation.

The plasticizer and the leveling agent may be added depending on the requirements. Specific examples of plasticizers used concomitantly with the charge transport layer include known ones that are being used for plasticizing resins such as dibutyl phthalate, dioctyl phthalate. The added amount of plasticizer is 0 part by mass to 30 parts by mass per 100 parts by mass of binder resin.

Specific examples of leveling agents used concomitantly with the charge transport layer include silicone oils such as dimethyl silicone oil, and methyl phenyl silicone oil; polymers or oligomers including a perfluoroalkyl group in their side chain. The added amount of leveling agents is 0 part by mass to 1 part by mass per 100 parts by mass of binder resin.

The thickness of the charge transport layer is preferably 5 μm to 40 μm, more preferably 10 μm to 30 μm.

As described in the surface layer producing method, the cross-linked surface layer is formed by applying the coating solution containing the radically polymerizable composition of the present invention on the charge transport layer, drying as necessary, followed by starting curing reaction by heat or light external energy.

The thickness of a cross-linked surface layer is preferably 1 μm to 20 μm, more preferably 2 μm to 10 μm. If the thickness is below 1 μm, durability may vary due to uneven thickness and when the thickness is more than 20 μm, the charge transport layer become thick and cause image reproducibility degradation due to a charge diffusion.

<Single-Layer Photosensitive Layer>

The single-layer structural a cross-linked photosensitive layer is the layer that has charge generating function and charge transport function simultaneously. By containing charge generating substances having charge generating function, the cross-linked photosensitive layer having charge transport structure of the present invention is effectively used as a single-layer cross-linked photosensitive layer. As described in the casting forming method for the charge generating layer, the cross-linked photosensitive layer is formed by dispersing charge generating substances with the coating solution containing radically polymerizable composition, drying as necessary, followed by starting curing reaction by external energy. Either the charge generating substance or dispersed liquid containing the charge generating substance with solvent may be added to the coating solution for the cross-linked photosensitive layer.

The thickness of the cross-linked photosensitive layer is preferably 10 μm to 30 μm, more preferably 10 μm to 25 μm. If the thickness is below 10 μm, sufficient charging potential may not be maintained. If the thickness exceeds 30 μm, separation from an electrically conductive support undercoat layer may be prone to occur because of volume constriction at the time of curing.

When the cross-linked surface layer is formed over the surface of single-layer photosensitive layer, the photosensitive layer is formed by dissolving or dispersing a charge generating substance, charge transport materials, and a binder resin in a proper solvent and applying the resulting coating solution, followed by drying. A plasticizer, a leveling agent, or the like may also be added as needed. The dispersion method for charge generating substances, charge transport materials, plasticizers, and leveling agents may be the same as those which are used for the charge generating layers and charge transport layers. As for the binder resin, in addition to the binder resins described for the charge transport layer, the binder resins described for the charge generating layers may be employed in combination. Besides, the charge transport polymer may be used, which is favorable in reducing the inclusion of photosensitive composition of a lower layer into the cross-linked surface layer.

The thickness of the photosensitive layer is preferably 5 μm to 30 μm, more preferably 10 μm to 25 μm.

The cross-linked surface layer is formed over the surface of a single-layer photosensitive layer, a coating solution containing radically polymerizable composition and a charge generating substance is applied on the upper layer of the photosensitive layer, followed by drying as needed, and curing by the use of external energy: heat or optical energy.

Preferably, the cross-linked surface layer has a thickness of 1 μm to 20 μm, more preferably 2 μm to 10 μm. If the thickness is below 1 μm, durability may fluctuate due to uneven thickness.

The charge generating substance contained in the single-layer photosensitive layers is preferably 1% by mass to 30% by mass. The binder resin contained in the photosensitive layer is preferably 20% by mass to 80% by mass based on the total amount of the photosensitive layer. The charge transport materials contained in the photosensitive layer is preferably 10% by mass to 70% by mass.

For the electrophotographic photoconductor of the present invention, in case of forming the cross-linked surface layer on the photosensitive layer, providing the intermediate layer is possible for the purpose of flower layer ingredient from mixing with the cross-linked surface layer or of improving adhesiveness with the lower layer. This intermediate layer is produced by the mixture of the lower part of the photosensitive layer composition in the cross-linked surface layer containing radically polymerizable composition, which prevents inhibition of a curing reaction and unevenness of the cross-linked surface layer. It is also possible to improve adhesiveness between lower layer of the photosensitive layer and the surface cross-linked layer.

The intermediate layer generally uses binder resin as the major component. Examples of these resins include polyamide, alcohol-soluble nylon, water-soluble polyvinyl butyral, polyvinyl butyral, and polyvinyl alcohol. As forming method for the intermediate layer, a coating method in general use is adopted as described the above. The thickness of the intermediate layer is preferably 0.05 μm to 2 μm.

In the photoconductor of the present invention, an undercoat layer may be formed between the support and the photosensitive layer.

The undercoat layer is typically formed of resin. The resin is preferably highly resistant against general organic solvents since photosensitive layers are usually applied on the undercoat layers using organic solvent. Examples of resins include water-soluble resins such as polyvinyl alcohol, casein and sodium polyacrylate, alcohol-soluble resins such as copolymer nylon and methoxymethylated nylon, and curing resins which form three-dimensional networks such as polyurethane, melamine resins, phenol resins, alkyd-melamine resins, and epoxy resins. Metal oxide fine powder pigments such as titanium oxide, silica, alumina, zirconium oxide, tin oxide or indium oxide may be added to the undercoat layer for preventing moiré patterns and reducing residual potential.

These undercoat layers may be formed by using suitable solvents and coating methods as the photosensitive layer. Silane coupling agents, titanium coupling agents or chromium coupling agents, etc. can be used as undercoat layer of the present invention. $Al_2O_3$ prepared by anodic oxidation, organic materials such as polyparaxylylene (parylene) and inorganic materials such as $SiO_2$, $SnO_2$, $TiO_2$, ITO, $CeO_2$ prepared by vacuum thin-film forming step, may also be used for the undercoat layer.

The thickness of the undercoat layer is preferably 0 μm to 5 μm.

For the photoconductor of the present invention, the anti-oxidant may be added to each of the cross-linked surface layer, the photosensitive layer, the protective layer, the charge transport layer, the charge generating layer, the undercoat layer, and the intermediate layer, etc. in order to improve environment resistance, particularly to prevent sensitivity decrease and residual potential increase.

Examples of the anti-oxidant include phenolic compounds, p-phenylenediamine compounds, hydroquinone compounds, organic sulfur compounds, organic phosphorus compounds. These anti-oxidants may be used alone or in combination.

Examples of the phenolic compounds include 2,6-di-t-butyl-p-cresol, butylated hydroxyanisole, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris)(3,5-di-t-butyl-4-hydroxybenzyl)benzene, tetrakis-[methylene-3-(3',5'-di-t-butyl-4'-hydroxyphenyl) propionate]methane, bis[3,3'-bis(4'-hydroxy-3'-t-butylphenyl)butylic acid]glycol ester and tocopherols.

Examples of the p-phenylenediamine compounds include N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

Examples of the hydroquinone compounds include 2,5-di-t-octylhydroquinone, 2,6-didodecylhydroquinone, 2-dodecyl hydroquinone, 2-dodecyl-5-chlorohydroquinone, 2-t-octyl-5-methylhydroquinone, and 2-(2-octadecenyl)-5-methylhydroquinone.

Examples of the organic sulfur compound include dilauryl-3,3'-thiodipropionate, distearyl-3,3'-thiodipropionate and ditetradecyl-3,3'-thiodipropionate.

Examples of the organic phosphorus compounds include triphenylphosphine, tri (nonylphenyl) phosphine, tri (dinonylphenyl) phosphine, tricresylphosphine and tri (2,4-dibutylphenoxy) phosphine.

These compounds are known as anti-oxidants for rubbers, plastics, oils and fats, etc., and are easily commercially available.

The amount of the anti-oxidant is preferably 0.01% by mass to 10% by mass, based on the total mass of the layer which includes the anti-oxidant.

The added amount of the antioxidant is not limited and be properly selected according to the application, and out of total amount of adding layer, 0.01% by mass to 10% by mass is preferable.

(Image Forming Method and Image Forming Apparatus)

The image forming apparatus of the present invention includes at least a latent electrostatic image forming unit, a developing unit, a transferring unit, a fixing unit, includes a cleaning unit preferably, and further includes other units suitably selected in accordance with the necessity such as a cleaning unit, a charge elimination unit, a recycling unit, and a controlling unit. The image forming method for the present invention includes at least a latent electrostatic image forming unit, a developing unit, a transferring unit, and a fixing unit and further includes other units suitably selected in accordance with the necessity such as a cleaning unit, a charge elimination unit, a recycling unit, and a controlling unit.

The image forming method for the present invention can be preferably carried out by means of the image forming apparatus of the present invention, the formation of a latent electrostatic image can be carried out by means of the latent electrostatic image forming unit, the developing can be carried out by means of the developing unit, the transferring can be carried out by means of the transferring unit, the fixing can be carried out by means of the fixing unit, and the other units can be carried out by means of the other units.

The image forming method and the image forming apparatus according to the present invention are an image forming method and an image forming apparatus using an electrophotographic photoconductor having a cross-linked layer includes units of charging the photoconductor, exposing the image, developing, transferring a toner image to an image carrier (transferring paper), fixing and cleaning the surface of the photoconductor.

An image forming method which an electrostatic latent image is directly transferred to a transferring medium does not always the steps.

—Latent Electrostatic Image Forming Unit and Latent Electrostatic Image Forming Unit—

The latent electrostatic image forming unit is a unit in which a latent electrostatic image is formed on an electrophotographic photoconductor.

Materials, shape, structure, and size of the electrophotographic photoconductor are not limited, and properly selected from known products, but drum shape can be a good use.

For the electrophotographic photoconductor, the electrophotographic photoconductor of the present invention can be used.

The latent electrostatic image can be formed, for example, by charging the surface of the electrophotographic photoconductor uniformly and then exposing the surface thereof imagewisely by means of the latent electrostatic image forming unit. The latent electrostatic image forming unit is provided with, for example, at least a charger configured to uniformly charge the surface of the electrophotographic photoconductor, and an exposure configured to expose the surface of the electrophotographic photoconductor imagewisely.

The surface of the electrophotographic photoconductor can be charged by applying a voltage to the surface of the electrophotographic photoconductor through the use of, for example, the charger.

The charger is not particularly limited, may be suitably selected in accordance with the intended use, and examples thereof include contact chargers known in the art, for example, which are equipped with a conductive or semi-conductive roller, a brush, a film, a rubber blade or the like, and non-contact chargers utilizing corona discharge such as corotron and scorotron.

The surface of the electrophotographic photoconductor can be exposed, for example, by exposing the surface of the electrophotographic photoconductor imagewisely using the exposing apparatus.

The exposing apparatus is not particularly limited, provided that the surface of the electrophotographic photoconductor which has been charged by the charger can be exposed imagewisely, may be suitably selected in accordance with the intended use, and examples thereof include various types of the exposing apparatus such as reproducing optical systems, rod lens array systems, laser optical systems, and liquid crystal shutter optical systems.

In the present invention, the back light method may be employed in which exposing is performed imagewisely from the back side of the electrophotographic photoconductor.

When image forming apparatus is used as a copier or a printer, image exposure is done by irradiating specula light or transmitted light to the photoconductor from documents or by irradiation lights to the photoconductor by laser beam scan, LED alley drive or liquid crystal shutter alley drive according to the signals converted by reading documents with sensors.

-Developing and Developing Unit-

The developing unit is a unit in which the latent electrostatic image is developed using a toner or a developer to form a visible image.

The visible image can be formed by developing the latent electrostatic image using, for example, a toner or a developer by means of the developing unit.

The developing unit is not particularly limited and may be suitably selected from those known in the art, as long as a latent electrostatic image can be developed using a toner or a developer. Preferred examples thereof include the one having at least an image developing device which houses a toner or a developer therein and enables supplying the toner or the developer to the latent electrostatic image in a contact or a non-contact state.

The image developing device normally employs a dry-developing process. It may be a monochrome color image developing device or a multi-color image developing device. Preferred examples thereof include the one having a stirrer by which the toner or the developer is frictionally stirred to be charged, and a rotatable magnet roller.

In the image developing device, for example, a toner and the carrier are mixed and stirred, the toner is charged by frictional force at that time to be held in a state where the toner is standing over the surface of the rotating magnet roller to thereby form a magnetic brush. Since the magnet roller is located near the electrophotographic photoconductor, a part of the toner constituting the magnetic brush formed over the surface of the magnet roller moves to the surface of the electrophotographic photoconductor by electric attraction force. As a result, the latent electrostatic image is developed using the toner to form a visible toner image over the surface of the electrophotographic photoconductor.

The developer to be housed in the image developing device is a developer containing a toner, and the developer may be a one component developer or may be a two-component developer. Commercially available products can be used for the toner.

—Transferring and Transferring Unit—

In the transferring unit, the visible image is transferred onto a recording medium, and it is preferably an embodiment in which an intermediate transfer member is used, the visible image is primarily transferred to the intermediate transfer member and then the visible image is secondarily transferred onto the recording medium. An embodiment of the transferring unit is more preferable in which two or more color toners are used, an embodiment of the transferring is still more preferably in which a full-color toner is used, and the embodiment includes a primary transferring in which the visible image is transferred to an intermediate transfer member to form a composite transfer image thereon, and a secondary transferring in which the composite transfer image is transferred onto a recording medium.

The transferring can be performed, for example, by charging a visible image formed over the surface of the electrophotographic photoconductor using a transfer-charger to transfer the visible image, and this is enabled by means of the transferring unit. For the transferring unit, it is preferably an embodiment which includes a primary transferring unit configured to transfer the visible image to an intermediate transfer member to form a composite transfer image, and a secondary transferring unit configured to transfer the composite transfer image onto a recording medium.

The intermediate transfer member is not particularly limited, may be suitably selected from among those known in the art in accordance with the intended use, and preferred examples thereof include transferring belts.

The transferring unit (the primary transferring unit and the secondary transferring unit) preferably includes at least an image-transfer device configured to exfoliate and charge the visible image formed on the electrophotographic photoconductor to transfer the visible image onto the recording medium. For the transferring unit, there may be one transferring unit or two or more transferring units.

Examples of the image transfer device include corona image transfer devices using corona discharge, transferring belts, transfer rollers, pressure transfer rollers, and adhesion image transfer units.

The recording medium is typically standard paper. As long as it is transferable of unfixed image after the development, it is not limited, and properly selected according to the application, and PET base for OHP can also be used.

—Fixing and Fixing Unit—

The fixing unit is a unit in which a visible image which has been transferred onto a recording medium is fixed using a fixing apparatus, and the image fixing may be performed every time each color toner is transferred onto the recording medium or at a time so that each of individual color toners are superimposed at the same time.

The fixing unit is not particularly limited, may be suitably selected in accordance with the intended use, and heat-pressurizing units known in the art are preferably used. Examples of the heat-pressurizing units include a combination of a heat roller and a pressurizing roller, and a combination of a heat roller, a pressurizing roller, and an endless belt.

The heating temperature in the heat-pressurizing unit is preferably 80° C. to 200° C.

In the present invention, for example, an optical fixing apparatus known in the art may be used in the fixing unit and the fixing unit, or instead of the fixing unit.

-Cleaning and Cleaning Unit-

The cleaning step is a step in which the electrophotographic photoconductor is cleaned using a cleaning unit.

Examples of the cleaning unit include cleaning blades, magnetic brush cleaners, electrostatic brush cleaners, magnetic roller cleaners, blade cleaners, brush cleaners, web cleaners.

The charge elimination step is a step in which charge is eliminated by applying a charge-eliminating bias to the electrophotographic photoconductor, and it can be suitably performed by means of a charge-eliminating unit.

The charge-eliminating unit is not particularly limited as long as a charge-eliminating bias can be applied to the electrophotographic photoconductor, and may be suitably selected from among charge-eliminating units known in the art. For example, a charge-eliminating lamp or the like is preferably used.

The recycling unit is a unit in which the electrophotographic toner that had been eliminated in the cleaning is recycled in the developing, and the recycling can be suitably performed by means of a recycling unit.

The recycling unit is not particularly limited, and examples thereof include carrying units known in the art.

The controlling unit is a unit in which each of the steps are controlled, and the each of these steps can be preferably controlled by using a controlling unit.

The controlling unit is not particularly limited and may be suitably selected in accordance with the intended use as long as operations of each of the units can be controlled, and examples thereof include equipment such as sequencers and computers.

Next, the image forming method and the image forming apparatus according to the present invention will be described in detail with reference to the drawings.

Figure 4:
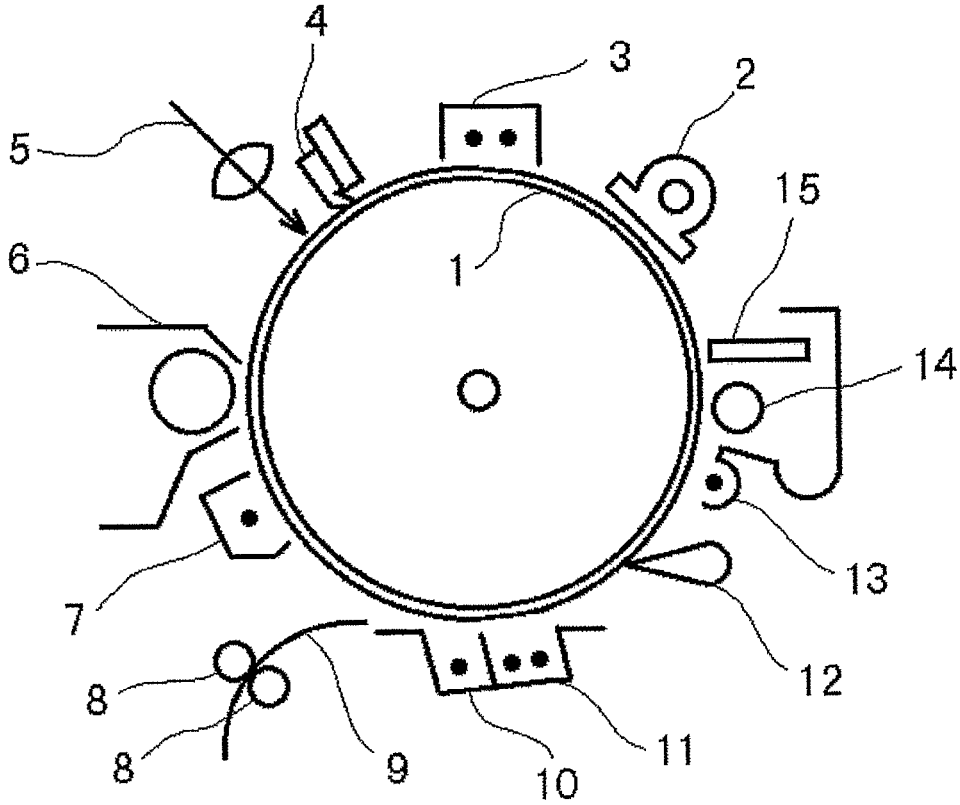
FIG. 4 is an exemplary schematic view of an image forming apparatus of the present invention.

FIG. 4 is a schematic view showing an example of the image forming apparatus. As a charging unit for charging the photoconductor uniformly, the charging charger 3 is used. Examples of the charging unit include a conventional unit, such as a corotron device, a scorotron device, a solid discharging element, a needle electrode device, a roller charging device and an electrically-conductive brush device.

The configuration of the present invention is particularly effective if a charging unit that the photoconductor composition is dissolved by proximity discharging from charging unit such as contact charging system or non-contact proximity placement charging system is used. The term "the contact charging system" means the charging system in which a charged roller, a charged brush, a charged blade, directly touches the photoconductor. On the other hand, proximity charging system is the one that the charged roller is proximity placed with non-contact state having air gap of 200 μm or less between the photoconductor surface and the charging unit for instance. If this air gap is too large, charging tends to be unstable, whereas if this air gap is too small, in case that the residual toner exist the photoconductor, a charging member surface may be contaminated. Consequently, the air gap is preferably 10 μm to 200 μm, more preferably 10 μm to 100 μm.

Next, for forming an electrostatic latent image in the photoconductor 1 charged uniformly, the image exposing unit 5 is used. Examples of the light source of the image exposing unit 5 include a general illuminant, such as a fluorescent light, a tungsten lamp, a halogen lamp, a mercury vapor lamp, a sodium lamp, a light emitting diode (LED), a laser diode (LD) and an electro luminescence (EL). For exposing a light having only a desired wavelength, various filters, such as a sharp cut filter, a band pass filter, a near-infrared cutting filter, a dichroic filter, an interference filter and a color conversion filter can be used.

Next, for visualizing an electrostatic latent image formed on the photoconductor 1, the developing unit 6 is used. Examples of the developing method include a one-component developing and a two-component developing using a dry toner and a wet developing using a wet toner. By charging the photoconductor 1 positively (negatively) and by exposing the image in the photoconductor 1, a positive (negative) electrostatic latent image is formed on the surface of the photoconductor 1. Further, by developing the formed latent image with a negative (positive) toner (voltage-detecting fine particles), a positive image can be obtained and by developing the formed latent image with a positive (negative) toner, a negative image can be obtained.

Next, for transferring the visualized toner image in the photoconductor 1 to the transferring medium 9, the transferring charger 10 is used. For transferring the toner image more advantageously, the transferring pre-charger 7 may be also used. Examples of the transferring method include an electrostatic transferring method using a transferring charger and a bias roller; a mechanical transferring method, such as an adhesion transferring method and a pressing transferring method; and a magnetic transferring method. The electrostatic transferring method can use the charging unit.

Next, as an unit for peeling the transferring medium 9 from the photoconductor 1, the peeling charger 11 and the peeling claw 12 can be used. Examples of the other peeling unit include an electrostatic adsorption inducing peeling unit, a side belt peeling unit, a top grip conveying unit and a curvature peeling unit. As the peeling charger 11, the charging unit can be used.

Next, for cleaning a residual toner on the photoconductor 1 after the transferring, the fur brush 14 and the cleaning blade 15 are used. For cleaning the residual toner more effectively, the cleaning pre-charger 13 may be also used. Examples of the other cleaning unit include a web cleaning unit and a magnetic brush cleaning unit. These cleaning units may be used individually or in combination.

Next, optionally for removing the latent image formed in the photoconductor 1, a neutralizing unit is used. Examples of the neutralizing unit include the neutralizing lamp 2 and a neutralizing charger. As the neutralizing lamp 2 and the neutralizing charger respectively, the exposing light source and charging unit respectively can be used.

As other units, such as a document reading unit, a paper feeding unit, a fixing unit and a paper discharging unit, which are arranged distantly from the photoconductor 1, conventional units may be used.

The present invention is an image forming method and image forming apparatus using the photoconductor for the electrophotography of the present invention as the image forming unit.

The image forming unit may be either fixed and incorporated in a copying machine, a facsimile machine or a printer; or detachably incorporated as a process cartridge described in the following.

(Process Cartridge)

The process cartridge of the present invention including the electrophotographic photoconductor of the present invention and any one of at least:

a charging unit configured to charge the surface of the electrophotographic photoconductor, an exposing unit configured to expose the surface of the exposed photoconductor to form latent electrostatic image, a developing unit configured to develop latent electrostatic image formed on the electrophotographic photoconductor using toner to form visible image, a transferring unit, a cleaning unit, and a charge elimination unit.

Figure 5:
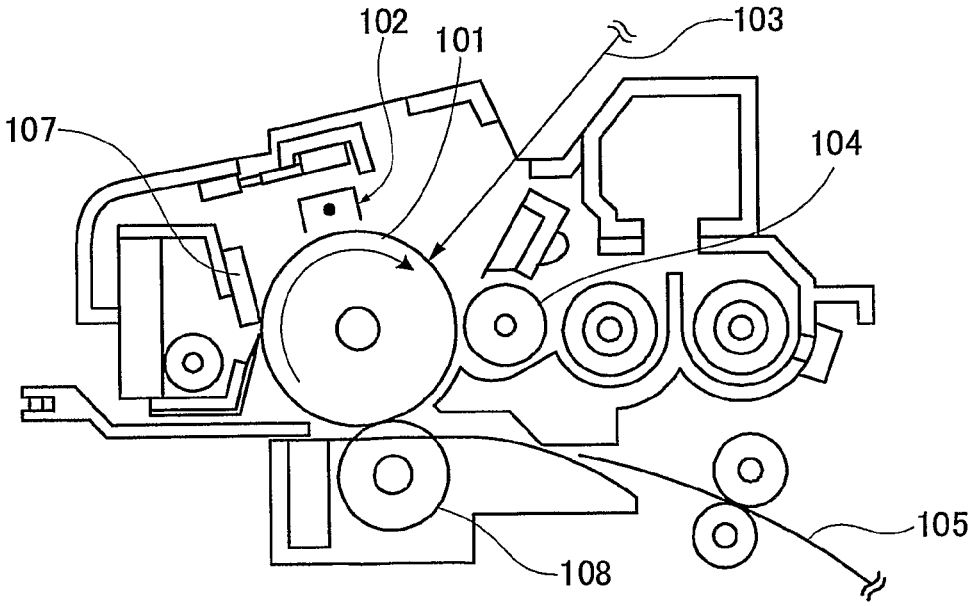
FIG. 5 is an exemplary schematic view of a process cartridge of the present invention.

An example of the process cartridge is shown in FIG. 5. The process cartridge includes the photoconductor 101 and at least one of the charging unit 102, the developing unit 104, the transferring unit 106, the cleaning unit 107 and a neutralizing unit (not disclosed in FIG. 5), and the process cartridge is detachably attached in the main body of the image forming apparatus.

The image forming step using the process cartridge shown in FIG. 5 includes rotating the photoconductor 101 in the direction shown by the arrow; charging the photoconductor 101 using the charging unit 102; exposing the photoconductor 101 using the exposing unit 103; thereby forming an electrostatic latent image corresponding to the exposed image in the surface of the photoconductor 101; toner-developing the electrostatic latent image using the developing unit 104; transferring the developed toner image to the transferring medium 105 using the transferring unit 106, thereby printing out the image; cleaning the surface of the photoconductor 101 after the image transferring using the cleaning unit 107; and neutralizing the photoconductor 101 using a neutralizing unit (not disclosed in FIG. 5), wherein during the process, the photoconductor 101 is rotated. This process is repeated.

As is clear from explanations given above, the photoconductor for the electrophotography according to the present invention can be widely applied not only to copying apparatuses for the electrophotography, but also to electrophotography application fields, such as laser beam printers, CRT printers, LED printers, liquid crystal printers and laser plate makings.

EXAMPLES

Herein below, with referring to Examples and Comparative Examples, the present invention is explained in detail and the following Examples and Comparative Examples should not be construed as limiting the scope of this invention. All parts are expressed by mass unless indicated otherwise.

Example 1

An undercoat layer of 3.5 μm in thickness, a charge generating layer of 0.2 μm in thickness, and the charge transport layer of 23 μm in thickness were formed on aluminum cylinder of 30 mm in diameter by sequentially applying the coating solution for undercoat layer of the following, applying the coating solution for the charge generating layer of the following, applying the coating solution for the charge transport layer of the following, and followed by drying.

Figure 6A:
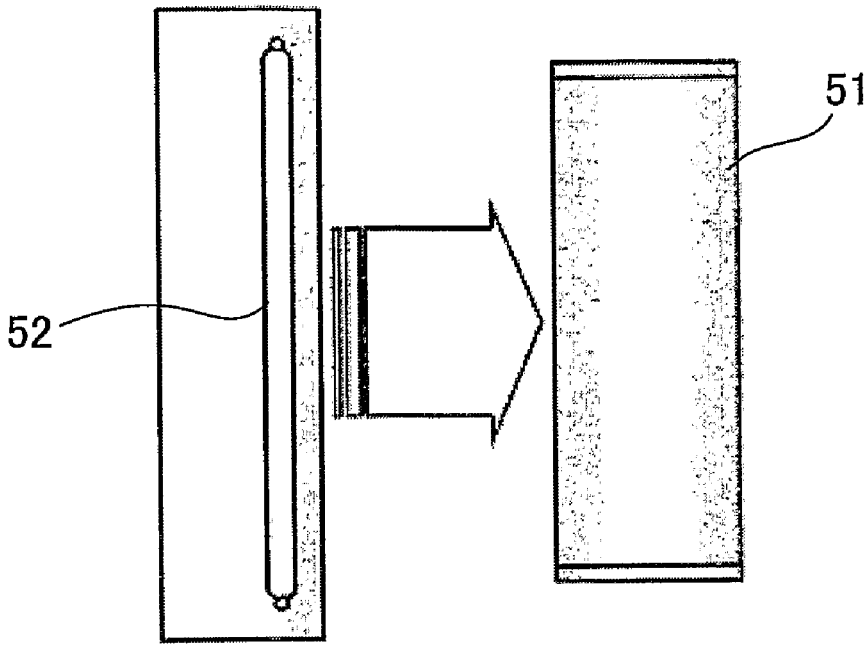
FIG. 6A is a block diagram of a vertical exposing UV lamp system used in Examples.
Figure 6B:
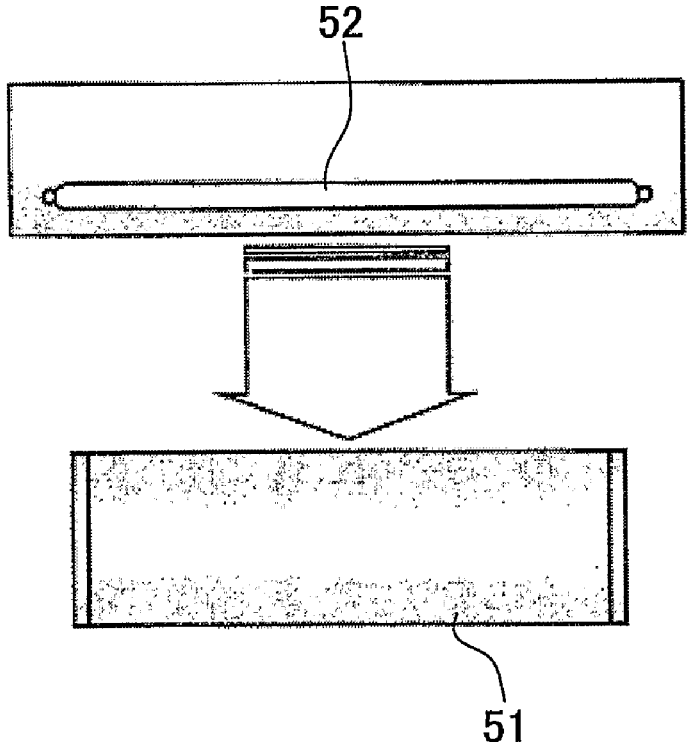
FIG. 6B is a block diagram of a horizontal exposing UV lamp system used in Examples.

Then, the surface cross-linked layer of 7 μm in thickness was provided by spray-coating coating solution for a cross-linked surface layer of the following on the charge transport layer, exposing under the condition of 150 sec exposing time by using UV lamp system by Fusion shown in FIG. 6A and UV lamp system by USHIO shown in FIG. 6B, and followed by drying for 20 min at 130° C. Hereinbefore, the electrophotographic photoconductor of Example 1 was produced.

Here, FIG. 6A shows a (vertical radiation) UV lamp system by Fusion, 51 in FIG. 6A denotes a vertically placed photoconductor, 52 is a lamp, and arrows in FIG. represent irradiation light. FIG. 6B shows a (horizontal radiation) UV lamp system manufactured by USHIO, 51 in FIG. 6A denotes a horizontally placed photoconductor, 52 is a lamp, and arrows in FIG. represent irradiation light.

| [Composition of Coating solution for Undercoat Layer] | |
|---|---|
| Alkyd resin<br>(Beckosol 1307-60-EL by Dainippon Ink and Chemicals, Inc.) | 6 parts |
| Melamine resin<br>(Super Beckamine G-821-60 by Dainippon Ink and Chemicals, Inc.) | 4 parts |
| Titanium oxide | 40 parts |
| Methyl ethyl ketone | 50 parts |

| [Composition of Coating Solution for Charge Generating Layer] | |
|---|---|
| Titanylphthalocyanin | 2.5 parts |
| Polyvinylbutyral (XYHL by UCC Inc.) | 0.5 parts |
| Cyclohexanone | 200 parts |
| Methyl ethyl ketone | 80 parts |

| [Composition of Coating solution for Charge Transport Layer] | |
|---|---|
| Bisphenol z-type polycarbonate<br>(Panlight TS-2050 by TEIJIN CHEMICALS LTD.) | 10 parts |
| Low-molecule charge transport material expressed by the following Structural Formula (II) | 7 parts |

Structural Formula (II)

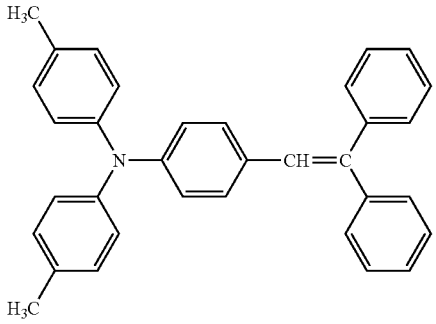

| | |
|---|---|
| Tetrahydrofuran | 100 parts |
| Tetrahydrofuran solution of 1% by mass of silicone oil<br>(KF50-100CS by Shinetsu Chemical Co., Ltd.) | 0.2 parts |

| [Composition of Coating Solution for a Cross-Linked Surface Layer] | |
|---|---|
| A radically polymerizable compound with charge transport structure<br>Example compound No. 54 (molecular weight: 419, number of functional group: 1) | 10 parts |
| Radically polymerizable monomer with no charge transport structure<br>Trimethylol propane triacrylate (KAYARAD TMPTA by Nippon Kayaku Co., Ltd., molecular weight: 296, number of functional groups: 3) | 10 parts |
| Photopolymerizable initiator<br>IRGACURABLE 184 (by Nippon Kayaku Co., Ltd., molecular weight: 204) | 1 part |
| Solvent | |
| Tetrahydrofuran<br>(boiling point: 66° C., saturated vapor pressure: 176 mmHg/25° C.) | 90 parts |

-continued

| [Composition of Coating Solution for a Cross-Linked Surface Layer] | |
|---|---|
| Butyl acetate (boiling point: 126° C., saturated vapor pressure: 13 mmHg/25° C.) | 30 parts |

[Exposure Condition and Method for Controlling Temperature]

Fusion (vertical radiation) UV lamp system (light intensity: 3300 W/cm$^2$)

Irradiation chamber atmosphere: air

Heating medium: water (flow rate: 3.5 L/min, circulation direction: top to bottom of the photoconductor)

Elastic member: NA

Example 2

An electrophotographic photoconductor of Example 2 was produced similar to that in that in Example 1 except for altering the composition to the following of the coating solution for a cross-linked surface layer, exposure condition, and the method for controlling temperature for Example 1.

| [Coating Solution for a Cross-Linked Surface Layer] | |
|---|---|
| A radically polymerizable compound with charge transport structure<br>Example compound No. 180 (molecular weight: 591, number of functional groups: 2) | 10 parts |
| Radically polymerizable monomer with no charge transport structure<br>Dipentaerythrytolhexalcrylate (by Nippon Kayaku Co., Ltd., KAYARAD DPHA, average molecular weight: 536, number of functional groups: 5.5) | 10 parts |
| Photopolymerizable initiator<br>IRGACURE 2959 (by Nippon Kayaku Co., Ltd., molecular weight: 224) | 1 part |
| Solvent | |
| Tetrahydrofuran<br>(boiling point: 66° C., saturated vapor pressure: 176 mmHg/25° C.) | 60 parts |
| Cyclohexanone<br>(boiling point: 156° C., saturated vapor pressure: 3.95 mmHg/25° C.) | 60 parts |

[Exposure Condition and Method for Controlling Temperature]

UV lamp system by Fusion (light intensity: 2700 W/cm$^2$)

Irradiation chamber atmosphere: air

Heating medium: water (flow rate: 3.5 L/min, circulation direction: top to bottom of the photoconductor)

Elastic member: natural rubber sheet of 3 mm thickness (tensile strength: 300 kg/cm$^2$, JIS-A hardness: 50, thermal conductivity: 0.13 W/m·K)

Example 3

The electrophotographic photoconductor of Example 3 was produced similar to that in Example 1 except for altering the composition to the following of the coating solution for a cross-linked surface layer, exposure condition, and the method for controlling temperature

| [Coating Solution for a Cross-Linked Surface Layer] | |
|---|---|
| A radically polymerizable compound with charge transport structure<br>Example compound No. 105 (molecular weight: 445, number of functional groups: 1) | 10 parts |
| Radically polymerizable monomer with no charge transport structure<br>Dipentaerythrytolhexyacrylate (by Nippon Kayaku Co., Ltd., KAYARAD DPHA, average molecular weight: 536, number of functional group: 5.5) | 5 parts |
| Trimethylol propane trimethacrylate (by Kayaku Sartomer, SR-350, average molecular weight: 338, number of functional groups: 3) | 5 parts |
| Photopolymerizable initiators<br>KAYACURE CTX (by Nippon Kayaku Co., Ltd., molecular weight: 204) | 1 part |
| Solvent<br>Tetrahydrofuran (boiling point: 66° C., saturated vapor pressure: 176 mmHg/25° C.) | 120 parts |

[Exposure Condition and Method for Controlling Temperature]

UV lamp system by Fusion (light intensity: 1300 W/cm$^2$)

Irradiation chamber atmosphere: air

Heating medium: BARRELSAM 200 (by Matsumura Oil, organic a heating medium oil)

Flow rate: 3.5 L/min, circulation direction: top to bottom of the photoconductor)

Elastic member: silicone rubber sheet of 3 mm thickness (tensile strength: 45 kg/cm$^2$, JIS-A hardness: 48, thermal conductivity: 0.35 W/m·K)

Example 4

The electrophotographic photoconductor was produced similar to that in Example 1 except for altering the composition to the following of the coating solution for a cross-linked surface layer, exposure condition, and the method for controlling temperature for Example 1.

| [Coating Solution for a Cross-Linked Surface Layer] | |
|---|---|
| A radically polymerizable compound with charge transport structure<br>Example compound No. 173 (molecular weight: 628, number of functional groups: 2) | 10 parts |
| Radically polymerizable monomer with no charge transport structure<br>Caprolactone-modified-dipentaerythrytol hexaacrylate (by Nippon Kayaku Co., Ltd., KAYARAD DPCA-120, average molecular weight: 1948, number of functional groups: 6) | 5 parts |
| Pentaerythrytoltetracrylate (by KAYAKU Sartomer, SR-295, average molecular weight: 3528, number of functional groups: 4) | 5 parts |
| Photopolymerizable initiator<br>IRGACURE 819 (by Nippon Kayaku Co., Ltd., molecular weight: 204) | 1 part |
| Solvent | |
| Tetrahydrofuran (boiling point: 66° C., saturated vapor pressure: 176 mmHg/25° C.) | 60 parts |
| 2-propanol (boiling point: 82° C., saturated vapor pressure: 32.4 mmHg/25° C.) | 60 parts |

[Exposure Condition and Method for Controlling Temperature]

UV lamp system by Fusion (light intensity: 1000 W/cm$^2$)

Irradiation chamber atmosphere: air

Heating medium: BARRELSAM 200 (by Matsumura Oil, organic a heating medium oil, flow rate: 3.5 L/min, circulation direction: top to bottom of the photoconductor)

Elastic member: urethane sponge of 5 mm in thickness (tensile strength: 0.05 kg/cm$^2$, JIS-A hardness: 12, thermal conductivity: 0.043 W/m·K)

Example 5

The electrophotographic photoconductor was produced similar to that in Example 1 except for altering the composition to the following of the coating solution for a cross-linked surface layer, exposure condition, and the method for controlling temperature.

| [Coating Solution for a Cross-Linked Surface Layer] | |
|---|---|
| A radically polymerizable compound with charge transport structure<br>Example compound No. 135 (molecular weight: 581, number of functional groups: 1) | 10 parts |
| Radically polymerizable monomer with no charge transport structure<br>Caprolactone-modified-dipentaerythrytol hexaacrylate (by Nippon Kayaku Co., Ltd., KAYARAD DPCA-120, average molecular weight: 1948, number of functional groups: 6) | 5 parts |
| Trimethylol propane triacrylate (by Nippon Kayaku Co., Ltd., KAYARAD TMPTA, molecular weight: 296, number of functional groups: 3) | 5 parts |
| Photopolymerizable initiator<br>KAYACURE DETX-S (by Nippon Kayaku Co., Ltd., molecular weight: 268) | 1 part |
| Solvent<br>Tetrahydrofuran (boiling point: 66° C., saturated vapor pressure: 176 mmHg/25° C.) | 120 parts |

[Exposure Condition and Method for Controlling Temperature]

UV lamp system by Fusion (light intensity: 3300 W/cm$^2$)

Irradiation chamber atmosphere: air

Heating medium: water (flow rate: 3.5 L/min, circulation direction: from top to bottom of the photoconductor)

Elastic member: radiating silicone rubber sheet of 1 mm of the thickness (by Shin-Etsu Chemical Co. Ltd., thermal conductivity: 5.0 W/m·K, tensile strength: 20 kg/cm$^2$, JIS-A hardness: 23)

Example 6

The electrophotographic photoconductor of the Example 6 was produced similar to that in the Example 1 except for altering the composition to the following of the coating solution for a cross-linked surface layer, exposure condition, and method for controlling temperature.

| [Coating Solution for a Cross-Linked Surface Layer] | |
|---|---|
| A radically polymerizable compound with charge transport structure<br>Example compound No. 54 (molecular weight: 419, number of functional groups: 1) | 10 parts |
| Radically polymerizable monomer with no charge transport structure<br>Trimethylol propane triacrylate (by Nippon Kayaku Co., Ltd., KAYARAD TMPTA, molecular weight: 296, number of functional groups: 3) | 10 parts |
| Photopolymerizable initiator<br>IRGACURE 184 (by Nippon Kayaku Co., Ltd., molecular weight: 204) | 1 part |
| Solvent | |
| Tetrahydrofuran (boiling point: 66° C., saturated vapor pressure: 176 mmHg/25° C.) | 90 parts |

-continued

| [Coating Solution for a Cross-Linked Surface Layer] | |
|---|---|
| Butyl acetate (boiling point: 126° C., saturated vapor pressure: 13 mmHg/25° C.) | 30 parts |

[Exposure Condition and Method for Controlling Temperature]

By USHIO (horizontal radiation) UV lamp system (light intensity: 800 W/cm$^2$)

Irradiation chamber atmosphere: air

Heating medium: water (flow rate: 3.5 L/min, circulation direction: left to right of the photoconductor)

Elastic member: NA

Example 7

The electrophotographic photoconductor of Example 7 was produced similar to that in the Example 1 except for altering the composition to the following of the coating solution for a cross-linked surface layer, exposure condition, and the method for controlling temperature.

| [Coating solution for a cross-linked surface layer] | |
|---|---|
| A radically polymerizable compound with charge transport structure<br>Example compound No. 54 (molecular weight: 419, number of functional groups: 1) | 10 parts |
| Radically polymerizable monomer with no charge transport structure<br>Trimethylol propane triacrylate (by Nippon Kayaku Co., Ltd., KAYARAD TMPTA, molecular weight: 296, number of functional groups: 3) | 10 parts |
| Photopolymerizable initiator<br>IRGACURE 184 (by Nippon Kayaku Co., Ltd., molecular weight: 204) | 1 part |
| Solvent | |
| Tetrahydrofuran (boiling point: 66° C., saturated vapor pressure: 176 mmHg/25° C.) | 90 parts |
| Butyl acetate (boiling point: 126° C., saturated vapor pressure: 13 mmHg/25° C.) | 30 parts |

[Exposure Condition and Method for Controlling Temperature]

UV lamp system by Fusion (light intensity: 3300 W/cm$^2$)

Irradiation chamber atmosphere: nitrogen substituted (oxygen concentration: 1% or less)

Heating medium: water (flow rate: 3.5 L/min, circulation direction: top to bottom of the photoconductor)

Elastic member: NA

Example 8

The electrophotographic photoconductor of Example 8 was produced similar to that in the Example 1 except altering following composition of the coating solution for a cross-linked surface layer, exposure condition, and the method for controlling temperature.

| [Coating solution for a cross-linked surface layer] | |
|---|---|
| A radically polymerizable compound with charge transport structure | 10 parts |

-continued

| [Coating solution for a cross-linked surface layer] | |
|---|---|
| Example compound No. 54 (molecular weight: 419, number of functional groups: 1) | |
| Radically polymerizable monomer with no charge transport structure | 10 parts |
| Trimethylol propane triacrylate (by Nippon Kayaku Co., Ltd., KAYARAD TMPTA, molecular weight: 296, number of functional group: 3) | |
| Photopolymerizable initiator | 1 part |
| IRGACUE 184 (by Nippon Kayaku Co., Ltd., molecular weight: 204) | |
| Solvent | |
| Tetrahydrofuran (boiling point: 66° C., saturated vapor pressure: 176 mmHg/25° C.) | 90 parts |
| Butyl acetate (boiling point: 126° C., saturated vapor pressure: 13 mmHg/25° C.) | 30 parts |

[Exposure Condition and Method for Controlling Temperature]

UV lamp system by Fusion (light intensity: 3300 W/cm$^2$)

Irradiation chamber atmosphere: air

Heating medium: water (flow rate: 3.5 L/min, circulation direction: bottom to top of the photoconductor)

Elastic member: NA

Example 9

The electrophotographic photoconductor of Example 9 was produced similar to that in the Example 1 except that a radically polymerizable monomer having no charge transport structure was changed to ethoxy bis phenol A diacrylate (by SHINNAKAMURA Co., Ltd., ABE-300).

Example 10

The electrophotographic photoconductor of Example 10 was produced similar to that in the Example 1 except that the exposure time for the cross-linked surface layer was 100 sec, and the thickness of the cross-linked surface layer was 5 μm.

Example 11

The electrophotographic photoconductor of Example 11 was produced similar to that in the Example 1 except that a photoconductive coating solution, of which the charge generating layer and the charge transport layer were the followings were coated, dried, and the thickness of the photosensitive layer was 23 μm.

| Composition of Photosensitive Layer Coating Solution | |
|---|---|
| Titanylphthalocyanin | 1 part |
| Charge transport material expressed by the following Structural Formula | 30 parts |

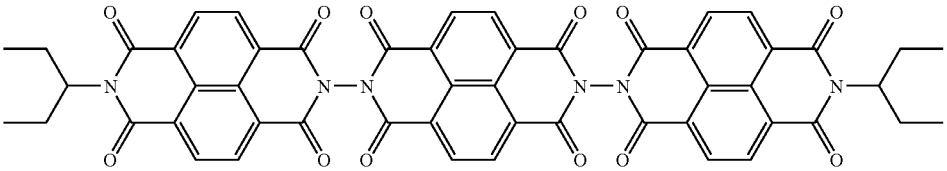

| | |
|---|---|
| Charge transport material expressed by the following Structural Formula | 20 parts |

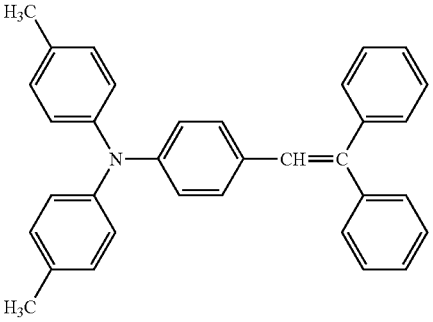

| | |
|---|---|
| Bis phenol Z polycarbonate (Panlight TS-2050, by TEIJIN CHEMICALS Ltd.) | 50 parts |
| Tetrahydroflan | 400 parts |

Comparative Example 1

The electrophotographic photoconductor was produced similar to that in Example 1 except that a cross-linked surface layer was not provided and the thickness of a charge transport layer was set to 27 μm.

Comparative Example 2

The electrophotographic photoconductor was produced similar to that in the Example 1 except that a cross-linked surface layer was formed according to Example 1 of JP-A No.

2001-125297. The air cooling method was used as a method for controlling the initial surface temperature of photoconductor to be 25° C.

Comparative Example 3

The electrophotographic photoconductor was produced similar to that in Example 1 except that a cross-linked surface layer was formed according to Example 2 of JP-A No. 2004-302450 of Example 1. The air cooling method was used as a controlling method for being the surface temperature of photoconductor to be 50° C. or less.

Comparative Example 4

The electrophotographic photoconductor was produced similar to that in Comparative Example 3 expect that UV exposing time was 150 sec in Comparative Example 3. The air cooling method was used as a controlling method for the surface temperature of the photoconductor; however, surface temperature of photoconductor was 50° C. or more.

<Surface Observation>

A surface observation of each electrophotographic photoconductor at 32-fold magnification was conducted using an optical microscope (by CARL ZEISS). The results were given in Table 5.

<Temperature Measurement>

A surface temperature of photoconductor at the time of exposure was measured using a thermocouple. The surface temperature of photoconductor was measured at 1 cm intervals over the length of the photoconductor except for areas 3 cm away from both ends of the photoconductor in order to prevent the measurement area from being direct hit by exposing light. Surface temperature of photoconductor was measured during the exposure. Initial temperature of the central part of the photoconductor, temperature in 30 sec after exposure, maximum temperature, and the difference between maximum temperature and minimum temperature of photoconductor circuit just before exposure in all measurement points were shown in Table 6.

<Measurement of the Post-Exposure Electrical Potential>

In the potential property evaluation equipment shown in FIG. 1, the charging unit 202 was the scorotron system which grid voltage could be reached till ±1500V, and main high-voltage power supply had ±10 kV of peak voltage. An exposure unit 203 was used under the condition that the LD scanning system was 780 nm of light source wavelength, fθ lens focal length was 251 mm, main scanning beam diameter was 68.5 μm, vertical scanning beam diameter was 81.5 μm, image static power (intensity) was 0.833 mW to 3.3 mW (no filter), writing width was 60 mm, lighting frequency was continuous lighting only, number of polygon mirror planes was 6, polygon revolutions was 6,000 rpm to 40,000 rpm (variable rotation), and polygon rotation stability time was 5 sec. A neutralization unit 204 was used under the condition that light source LED was around 660 nm wavelength, maximum intensity was 1,060 μW/cm$^2$ (variable intensity), exposing width was 2 mm width on the photoconductor (2 mm away from the surface of the photoconductor).

In the potential property evaluation equipment shown in FIG. 1, specific measurement conditions were as follows: image static power was 0.53 mW, exposure energy was 4.0 erg/cm$^2$, photoconductor linear speed was 251 mm/sec, feed size was 210 mm, recurrence interval was 500 ms, the charging unit 202 was 0 degree position, the surface potential meter 210 was 70 degree position, the exposure unit 203 was 90 degree position, the surface potential meter 211 was 120 degree position, the neutralization unit 204 was 270 degree position, and the charging grid bias was −800V. The surface potential of the photoconductor 201 measured by the surface potential meter 210 was −800V. Measurement was conducted at 1 cm intervals in the longitudinal direction over the area which 3 cm portion from the edge photoconductor was removed. Maximum value, minimum value of all measurement points, and the difference between maximum value and minimum value were shown in Table 7.

<Durability Test>

Initial dark place potential was set to −700V by the altered image forming apparatus (by Ricoh Company, Ltd., IMAGIO MF 2200 altered machine) where each electrophotographic photoconductor shown in Examples and Comparative Examples was attached to a process cartridge, a semiconductor laser of 780 nm wavelength was used as the image exposing light source, and the contact pressure of cleaning blade was altered 1.5 times. Then, sheet test was provided, thickness was measured and image quality was evaluated initially and per 10,000 sheets, and 30,000 sheets of A4 size was tested. As electric property at the end of sheet test, dark space and exposed area potential over the same places as the initial dark space potential measured part were measured. The thickness of the photoconductor was measured by eddy-current style thickness measurement apparatus (by Fisher Instrument). The results were given in Table 8.

<Image Quality Evaluation>

The image quality was evaluated by outputting a halftone image after the durability test, and by four grades of image density evenness. The results were given in Table 8.

[Evaluation Criteria]

A: no unevenness in image density
B: little unevenness in image density
C: a little unevenness in image density
D: unevenness in image density

TABLE 5

| | |
|---|---|
| Example 1 | no surface unevenness |
| Example 2 | no surface unevenness |
| Example 3 | no surface unevenness |
| Example 4 | no surface unevenness |
| Example 5 | no surface unevenness |
| Example 6 | no surface unevenness |
| Example 7 | no surface unevenness |
| Example 8 | no surface unevenness |
| Example 9 | no surface unevenness |
| Example 10 | no surface unevenness |
| Example 11 | no surface unevenness |
| Comparative Example 1 | no surface unevenness |
| Comparative Example 2 | partial little surface unevenness |
| Comparative Example 3 | partial little surface unevenness |
| Comparative Example 4 | partial surface unevenness |

From the results shown in Table 5, in Examples 1 to 11 and Comparative Example 1, it is conceivable that the surface had no unevenness, the surface has good surface smoothness, the surface temperature of photoconductor at the time of light-curing was evenly controlled, and an even cross-linked surface layer was formed. From here onwards, in Examples of the present invention, it may be said that the surface smoothness was enough to supply sufficient safety margin for cleaning.

In contrast, in Comparative Examples 2 to 4, it is conceivable that there seemed to have partial unevenness for some parts, polymerization reaction was not evenly progressed because even surface temperature of photoconductor was not accomplished, thereby uneven cross-linked layers were formed.

TABLE 6

| | Central Part Photoconductor Surface Temperature | | | |
|---|---|---|---|---|
| | Initial | 30 sec after exposure | Maximum Temp | Max Temp – Min Temp |
| Example 1 | 20° C. | 35° C. | 40° C. | 10° C. |
| Example 2 | 30° C. | 55° C. | 80° C. | 15° C. |
| Example 3 | 25° C. | 60° C. | 130° C. | 15° C. |
| Example 4 | 35° C. | 80° C. | 160° C. | 20° C. |
| Example 5 | 40° C. | 60° C. | 65° C. | 15° C. |
| Example 6 | 20° C. | 30° C. | 35° C. | 10° C. |
| Example 7 | 20° C. | 35° C. | 40° C. | 10° C. |
| Example 8 | 20° C. | 35° C. | 40° C. | 20° C. |
| Example 9 | 20° C. | 35° C. | 40° C. | 10° C. |
| Example 10 | 20° C. | 35° C. | 37° C. | 10° C. |
| Example 11 | 20° C. | 35° C. | 40° C. | 10° C. |
| Comparative Example 1 | — | — | — | — |
| Comparative Example 2 | 25° C. | 60° C. | 60° C. | 40° C. |
| Comparative Example 3 | 30° C. | No Data because exposing time was 20 sec | 50° C. | 35° C. |
| Comparative Example 4 | 20° C. | 55° C. | 135° C. | 55° C. |

From the results in Table 6, in Examples 1 to 11, the surface temperature of the photoconductor was increased by 10° C. or more after 30 sec of initial exposure, the difference between the maximum and the minimum temperature was 20° C. or less, and the values were smaller than that in Comparative Examples 2 to 4. It could be thought that the cross-linked layer was formed through sufficient and an even polymerization reaction. In Comparative Examples 2 to 4, the temperature increase after 30 sec of exposure was large, the difference between maximum and minimum temperature exceeded 30° C., and thereby the result indicated that even cross-linked layer was not achieved.

TABLE 7

| | Min Value | Max Value | Exposed Area Potential Difference |
|---|---|---|---|
| Example 1 | −110 V | −100 V | 10 V |
| Example 2 | −115 V | −100 V | 15 V |
| Example 3 | −130 V | −110 V | 20 V |
| Example 4 | −145 V | −120 V | 25 V |
| Example 5 | −115 V | −105 V | 10 V |
| Example 6 | −105 V | −95 V | 10 V |
| Example 7 | −100 V | −90 V | 10 V |
| Example 8 | −125 V | −100 V | 25 V |
| Example 9 | −110 V | −100 V | 10 V |
| Example 10 | −65 V | −55 V | 10 V |
| Example 11 | −110 V | −100 V | 10 V |
| Comperative Example 1 | −65 V | −60 V | 5 V |
| Comperative Example 2 | −155 V | −90 V | 65 V |
| Comperative Example 3 | −145 V | −85 V | 60 V |
| Comperative Example 4 | −185 V | −105 V | 80 V |

From the results shown in Table 7, in Examples 1 to 11, the difference between maximum and minimum value of the post-exposure electrical potential was below 30V, it was found out that electric property of a cross-linked surface layer was even. On the other hand, in Comparative Examples 2 to 4, the difference between maximum and minimum value of the post-exposure electrical potential was 35V or more, thereby a cross-linked surface layer did not have even electric property.

TABLE 8

| | Wear Volume (μm) | | | Image Quality Evaluation Result | |
|---|---|---|---|---|---|
| | 10,000 Sheets | 20,000 Sheets | 30,000 Sheets | Beginning | After Durability Test |
| Example 1 | 0.12 | 0.26 | 0.39 | A | A |
| Example 2 | 0.11 | 0.23 | 0.36 | A | A |
| Example 3 | 0.10 | 0.20 | 0.31 | B | B |
| Example 4 | 0.09 | 0.17 | 0.28 | C | C |
| Example 5 | 0.12 | 0.25 | 0.36 | A | A |
| Example 6 | 0.16 | 0.32 | 0.49 | A | A |
| Example 7 | 0.12 | 0.26 | 0.38 | A | A |
| Example 8 | 0.13 | 0.26 | 0.40 | C | C |
| Example 9 | 0.21 | 0.40 | 0.61 | A | A |
| Example 10 | 0.22 | 0.42 | 0.63 | A | A |
| Example 11 | 0.13 | 0.25 | 0.40 | A | A |
| Comperative Example 1 | 1.88 | 3.78 | 5.69 | A | A |
| Comperative Example 2 | 0.20 | 0.39 | 0.59 | D | D |
| Comperative Example 3 | 0.22 | 0.45 | 0.68 | D | D |
| Comperative Example 4 | 0.11 | 0.22 | 0.37 | D | D |

From the results shown in Table 8, in the electrophotographic photoconductor of Examples 1 to 11, wear volume was small, image density unevenness of the image after prolonged period durability test did not occur, and the electrophotographic photoconductor having uniform electrophotographic property and high wear resistance was attained. On the other hand, in the photoconductor of the Comparative Example 1 having no protective layer, wear volume was large, degree of image density unevenness was poor from the beginning because even cross-linking was not provided in the photoconductor of Comparative Examples 2, 3, and 4, and distinct image density unevenness was generated after durability test.

INDUSTRIAL APPLICABILITY

An image forming method, an image forming apparatus, and a process cartridge using the electrophotographic photoconductor of the present invention can maintain high wear resistance for prolonged periods, have little fluctuation of electric property, have small the dependencies of places of wear resistance and electric property, provide superior durability and stable electric property, and can attain high quality image forming for prolonged periods so that they can be widely used for full color printer, full color laser printer, and full color standard paper facsimile machine, or these complex machines using direct or indirect electrophotographic multiple color image development system.

The invention claimed is:

1. A method for producing an electrophotographic photoconductor comprising:

forming a cross-linked layer by curing at least a radically polymerizable compound by irradiation with light, wherein the difference between the maximum and minimum values of the surface temperature over the entire surface of the electrophotographic photoconductor, measured just before completion of curing for the formation of the cross-linked layer, is within 30° C., and wherein the electrophotographic photoconductor comprises:

a support; and the cross-linked layer formed over the support, wherein the cross-linked layer comprises a cured material of a cross-linked layer composition containing at least the radically polymerizable compound, and wherein when the photoconductor is exposed at a field static power of 0.53 mw and exposure energy of 4.0 erg/cm$^2$, the difference between the maximum and minimum values of post-exposure electrical potential is within 30V;

wherein the electrophotographic photoconductor is a hollow electrophotographic photoconductor and a heating medium exists in the hollow space of the electrophotographic photoconductor during curing for the formation of the cross-linked layer, wherein the heating medium is water.

2. The method for producing an electrophotographic photoconductor according to claim 1, wherein the surface temperature of the electrophotographic photoconductor during curing for the formation of the cross-linked layer is 20° C. to 170° C.

3. The method for producing an electrophotographic photoconductor according to claim 1, wherein an elastic member is closely attached to the inside of the hollow electrophotographic photoconductor during curing for the formation of the cross-linked layer and the heating medium exists inside of the elastic member.

4. The method for producing an electrophotographic photoconductor according to claim 3, wherein the tensile strength of the elastic member is 10 kg/cm2 to 400 kg/cm2.

5. The method for producing an electrophotographic photoconductor according to claim 3, wherein the JIS-A hardness of the elastic member is 10 to 100.

6. The method for producing an electrophotographic photoconductor according to claim 3, wherein the thermal conductivity of the elastic member is 0.1 W/m ·K to 10 W/m ·K.

7. The method for producing an electrophotographic photoconductor according to claim 1, wherein during curing for the formation of the cross-linked layer, the hollow electrophotographic photoconductor is placed so that the length of the electrophotographic photoconductor is substantially vertical.

8. The method for producing an electrophotographic photoconductor according to claim 1, wherein the heating medium is circulated during curing for the formation of the cross-linked surface layer in a direction from top to bottom of the hollow electrophotographic photoconductor.

9. The method for producing an electrophotographic photoconductor according to claim 2, wherein the exposure intensity for light curing is 1000 mW/cm2 or more.

* * * * *